US005254446A

United States Patent [19]

Ikenoue et al.

[11] Patent Number: 5,254,446

[45] Date of Patent: Oct. 19, 1993

[54] SILVER HALIDE COLOR NEGATIVE PHOTOSENSITIVE MATERIAL

[75] Inventors: Shinpei Ikenoue; Toshiyuki Watanabe; Seiji Ichijima, all of Minami-Ashigara, Japan

[73] Assignee: Fuji Photo Film Co., Ltd., Kanagawa, Japan

[21] Appl. No.: 705,439

[22] Filed: May 24, 1991

[30] Foreign Application Priority Data

May 29, 1990 [JP] Japan ..... 2-138819

[51] Int. Cl.[5] ..... G03C 1/46

[52] U.S. Cl. ..... 430/503; 430/558; 430/140; 430/359; 430/504; 430/505

[58] Field of Search ..... 430/558, 140, 359, 504, 430/505, 503

[56] References Cited

U.S. PATENT DOCUMENTS

| | | | |
|---|---|---|---|
| 3,005,712 | 10/1961 | Saunders et al. | 430/555 |
| 3,782,947 | 1/1974 | Krall et al. | 430/21 |
| 3,870,525 | 3/1975 | Yamamoto et al. | 430/140 |
| 4,277,559 | 7/1981 | Jaeken et al. | 430/549 |
| 4,279,945 | 7/1981 | Audran et al. | 430/140 |
| 4,302,523 | 11/1981 | Audran et al. | 430/140 |
| 4,755,455 | 7/1988 | Iwasa | 430/558 |
| 4,764,456 | 8/1988 | Watanabe et al. | 430/558 |
| 5,147,768 | 9/1992 | Sakakibara | 430/140 |

FOREIGN PATENT DOCUMENTS

| | | |
|---|---|---|
| 0313083 | 4/1989 | European Pat. Off. . |
| 3815469 | 11/1989 | Fed. Rep. of Germany . |
| 2128339 | 10/1972 | France . |
| 2382325 | 9/1978 | France . |

*Primary Examiner*—Charles L. Bowers, Jr.
*Assistant Examiner*—Thomas R. Neville
*Attorney, Agent, or Firm*—Sughure, Mion, Zinn, Macpeak & Seas

[57] ABSTRACT

A silver halide color negative photosensitive material comprises at least one red-sensitive silver halide emulsion layer containing a cyan coupler, at least one green-sensitive silver halide emulsion layer containing a magenta coupler and at least one blue-sensitive silver halide emulsion layer containing a yellow coupler formed on a transparent support, wherein it contains $4\times10^{-4}$ to 3 g, per $m^2$ of the support, of a ferromagnetic fine powder and that the green-sensitive emulsion layer contains a coupler such as The photosensitive material makes it possible to shorten a printing time and has an excellent sharpness.

13 Claims, 1 Drawing Sheet

SILVER HALIDE COLOR NEGATIVE PHOTOSENSITIVE MATERIAL

BACKGROUND OF THE INVENTION

The present invention relates to a silver halide color photosensitive material for color photography which has a transparent magnetic recording layer. In particular, the present invention relates to a silver halide color negative photosensitive material having a transparent magnetic recording layer having an improved printability.

For example, U.S. Pat. Nos. 378,294, 4,279,945 and 4,302,523 disclose that a magnetic recording layer is formed on the back surface of a silver halide photosensitive material having a transparent support, the magnetic recording layer having a transparency required of the silver halide photosensitive material for taking a picture which transparency is attained by suitably selecting the amount and size of magnetic grains contained in the magnetic recording layer. This magnetic recording layer exerts no bad influence on the graininess. Methods for inputting signals on the magnetic recording layer are disclosed in International Publication Nos. 90-4205 and 90-04212. However, they are silent with the influences of transparent magnetic base on printing time. Japanese Patent Unexamined Published Application (hereinafter referred to as "J. P. KOKAI") No. 61-22342 discloses that the printing time can be reduced without impairing reproduction of vivid colors by using a combination of a pyrazoloazole coupler and a phenol coupler. However, J. P. KOKAI No. 61-22342 does not suggest that the incorporation of a pyrazoloazole coupler into a color negative film having a transparent magnetic recording layer is preferred. Further, it does not suggest that the color negative film having the transparent magnetic recording layer is suitable for the system of panorama prints or pseudo telephoto zoom.

SUMMARY OF THE INVENTION

After intensive investigations, the inventors have found a problem that when magnetizing grains in such an amount that a signal level necessitated for the magnetic recording can be assured are contained in a magnetic recording layer, the absorption of blue light is not negligible in the film base particularly in a color negative film. Since a long time is required for forming each color print from a color negative film having a transparent magnetic recording layer, the productivity of the color prints is reduced. Particularly in the panorama prints or pseudo telephoto zoom system, the magnification of the enlargement is higher than that in ordinary prints and, therefore, prolongation of the printing time due to the presence of the transparent magnetic recording layer is a quite important problem.

The first object of the present invention is to provide a silver halide color negative photosensitive material having a transparent magnetic recording layer which makes it possible to shorten a printing time.

The second object of the present invention is to provide a silver halide color negative photosensitive material having a transparent magnetic recording layer which makes it possible to shorten a printing time and which has an excellent sharpness.

The objects of the present invention can be attained by a silver halide color photosensitive material which comprises at least one red-sensitive silver halide emulsion layer containing a cyan coupler, at least one green-sensitive silver halide emulsion layer containing a magenta coupler and at least one blue-sensitive silver halide emulsion layer containing a yellow coupler formed on a transparent support, characterized in that it contains $4\times10^{-4}$ to 3 g, per $m^2$ of the support, of a ferromagnetic fine powder and that the green-sensitive emulsion layer contains a coupler of the following general formula [A]:

general formula [A]:

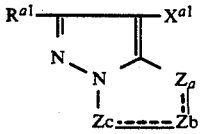

wherein $R^{a1}$ represents a hydrogen atom or a substituent, $X^{a1}$ represents a hydrogen atom or a group which can be split off by coupling reaction with an oxidation product of an aromatic primary amine developing agent, Za, Zb and Zc each represent a methine, substituted methine, =N— or —NH—, one of Za-Zb bond and Zb-Zc bond is a double bond and the other is a single bond; when Zb-Zc is a carbon-to-carbon double bond, it may be a part of the aromatic ring; the coupler may form a dimer or polymer through $R^{a1}$ or $X^{a1}$; and when Za, Zb or Zc is the substituted methine, the coupler may form a dimer or polymer through the substituted methine.

The above-described process was not solved before the inventors combined a finding in the field of magnetic materials that the transparent magnetic recording layer has an absorption in blue light region with another finding in the field of couplers that since a magenta dye formed from a pyrazoloazole magenta coupler has only a low subabsorption in the blue light region, it is capable of reduce in amount of yellow-colored magenta coupler.

DESCRIPTION OF PREFERRED EMBODIMENTS

Figure 1:
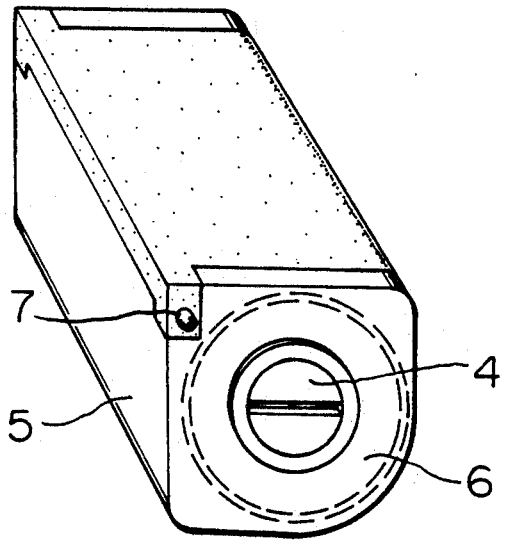
FIG. 1 shows a cartridge used in Example 2. In a camera, a cover fixed with a pin (7) is opened. The attitude of the cartridge in the camera depends on the face 5.

The ferromagnetic fine powders used in the present invention include, for example, fine powder of ferromagnetic iron oxide, fine powder of Co-doped ferromagnetic iron oxide, fine powder of ferromagnetic chromium dioxide, ferromagnetic metal powders, fellomagnetic alloy powders and barium ferrite.

Examples of the ferromagnetic alloy powders include those comprising at least 75% by weight of metals which comprise at least 80% by weight of at least one ferromagnetic metal or alloy (such as Fe, Co, Ni, Fe-Co, Fe-Ni, Co-Ni or Co-Fe-Ni) and 20% or less of other components (such as Al, Si, S, Sc. Ti, v, Cr, Mn, Cu, Zn, Y, Mo, Rh, Pd, Ag, Sn, Sb, B, Ba, Ta, W, Re, Au, Hg, Pb, P, La, Ce, Pr, Nd, Te and Bi). The ferromagnetic metals may contain a small amount of water, a hydroxide or an oxide.

Processes for producing these ferromagnetic powders have been known. The ferromagnetic powders used in the present invention can be produced by known processes.

The shape and size of the ferromagnetic powder are not particularly limited. The shape may be any of needle, rice grain, spherical, cubic and tabular shapes. Among them, the needle and tabular grains are preferred from the viewpoint of electromagnetic transduction characteristics. Although the size and specific surface area of the crystals are not particularly limited either, the crystal size is preferably 400 A or smaller and SBET is preferably at least 20 $m^2/g$, particularly at least 30 $m^2/g$. The pH of the ferromagnetic powder and the surface-treating agent therefor are not particularly limited. Namely, it can be surface-treated with a substance containing an element such as titanium, silicon or aluminum or with an organic compound such as a carboxylic acid, sulfonic acid, sulfuric ester, phosphonic acid, phosphoric ester or an adsorbing compound having a nitrogen-containing heterocyclic ring. Preferred pH ranges from 5 to 10. In the fine powder of ferromagnetic iron oxide, the ratio of iron (II) to iron (III) is not particularly limited.

The amount of the fine ferromagnetic powder is $4\times10^{-4}$ to 3 g, preferably $10^{-3}$ to 1 g and more preferably $4\times10^{-3}$ to $10^{-1}$ g, per $m^2$ of the transparent support. The prolongation of the printing time due to the coupler of the present invention can be effectively inhibited by controlling the Optical density in the blue light region to not higher than 0.4, preferably not higher than 0.3 and more preferably from 0.05 to 0.20 as determined with a densitometer of X-Rite Co.

Binders usable in the present invention include known thermoplastic resins, thermosetting resins, radiation-cured resins, reactive resins and mixtures of them usually used as binders for magnetic recording media.

Tg of the resin ranges from −40° C. to 150° C. and the weight-average molecular weight thereof ranges from 10,000 to 300,000, preferably 10,000 to 100,000.

Examples of the thermoplastic resins include vinyl copolymers (such as vinyl chloride/vinyl acetate copolymer, copolymer of vinyl chloride or vinyl acetate with vinyl alcohol, maleic acid and/or acrylic acid, vinyl chloride/vinylidene chloride copolymer, vinyl chloride/acrylonitrile copolymer and ethylene/vinyl acetate copolymer), cellulose derivatives (such as nitrocellulose, cellulose acetate propionate and cellulose acetate butyrate), acrylic resin, polyvinyl acetal resin, polyvinyl butyral resin, polyester polyurethane resin, polyether polyurethane, polycarbonate polyurethane resin, polyester resin, polyether resin, polyamide resin, amino resin, rubber resins (such as styrene butadiene resin and butadiene acrylonitrile resin), silicone resin and fluorine resin.

Among them, the vinyl chloride resin is preferred, since it has a high dispersibility in the fine ferromagnetic powder.

Examples of the thermosetting resins and reactive resins include those whose molecular weights are remarkably increased by heating such as phenolic resin, phenoxy resin, epoxy resin, cured polyurethane resin, urea resin, melamine resin, alkyd resin, silicone resin, acrylic reactive resin, epoxy-polyamide resin, nitrocellulose melamine resin, mixture of high molecular polyester resin and isocyanate prepolymer, urea formaldehyde resin, mixture of low molecular glycol/high molecular diol/polyisocyanate, polyamine resin and mixtures of them.

The radiation-cured resins herein include those produced by bonding the above-described thermoplastic resin with a group having a carbon-to-carbon unsaturated bond as a radiation-curable functional group. Preferred functional groups include acryloyl group and methacryloyl group.

It is preferred for the dispersibility and durability of the magnetic material to introduce a polar group (such as epoxy group, $CO_2M$, OH, $NR_2$, NR3X, $SO_3M$, $OSO_3M$, $PO_3M_2$ or $OPO_3M_2$, wherein M represents a hydrogen, alkali metal or ammonium and when the group contains plural M's, they may be the same or different from one another, and R represents a hydrogen or alkyl group) into the above-described binder molecules. In such a case, the effect of the fluorine oligomer surfactant of the present invention is remarkably exhibited. The amount of the polar group is preferably $10^{-7}$ to $10^{-3}$ more preferably $10^{-6}$ to $10^{-4}$ equivalent, per gram of the polymer.

The above-described polymer binders are used either solely or in the form of a mixture of two or more of them. Further, a known isocyanate crosslinking agent and/or a radiation-curable vinyl monomer can be incorporated thereinto to cure it.

Examples of the isocyanate crosslinking agents include polyisocyanate compounds having two or more isocyanate groups such as tolylene diisocyanate, 4,4'-diphenylmethane diisocyanate, hexamethylene diisocyanate, xylylene diisochyanate, naphthylene-1,5-diisocyanate, o-toluidine diisocyanate, isophorone diisocyanate and triphenylmethane diisocyanate; reaction products of such an isocyanate with a polyalcohol; and polyisocyanates formed by condensation of these isocyanates. These polyisocyanates are put on the market under the trade names of COLLONATE L, COLLONATE HL, COLLONATE H, COLLONATE EH, COLLONATE 2014 , COLLONATE 2030, COLLONATE 2031, COLLONATE 2036, COLLONATE 3015, COLLONATE 3040, COLLONATE 3041, MILLIONATE MR, MILLIONATE MTL, DALTSEC 1350, DALTSEC 2170 and DALTSEC 2280 by Nippon Polyurethane Industries, Ltd.; Takenate D 102, Takenate D 110N, Takenate D 200 and Takenate D 202 by Takeda Chemical Industries, Ltd.; Sumidur N 75 by Sumitomo Bayer Co., Ltd.; Desmodur L, Desmlodur IL, Desmodur N and Desmodur HL by West German Bayer; and BORNOCK D 850 and BORNOCK D 802 by Dainippon Ink & Chemicals, Inc.

The radiation-curable vinyl monomers are compounds polymerizable by radiation and having at least one carbon-to-carbon unsaturated bond in the molecule such as (meth)acrylic esters, (meth)acrylamides, allyl compounds, vinyl ethers, vinyl esters, vinyl heterocyclic compounds, N-vinyl compounds, styrene, (meth)acrylic acid, crotonic acid, itaconic acid and olefins. Among them, preferred are those having at least two (meth)acryloyl groups such as polyethylene glycol (meth)acrylates, e.g. diethylene glycol di(meth)acrylate and triethylene glycol di(meth)acrylate, trimethylolpropane tri(meth) acrylate, pentaerythritol tetra(meth)acrylate, dipentaerythritol penta(meth)acrylate, dipentaerythritol hexa(meth)acrylate and a reaction product of a polyisocyanate with a hydroxy(meth)acrylate compound.

The amount of such a crosslinking agent is preferably 5 to 45% by weight based on the total binders including this crosslinking agent.

A hydrophilic binder can be incorporated into the magnetic recording layer of the present invention.

The hydrophilic binders usable herein are described in Research Disclosure No. 17643 (p. 26) and No. 18716 (p. 651). Examples of them given therein include water-soluble polymers, cellulose esters, latex polymers and water-soluble polyesters. Examples of the water-soluble polymers include gelatin, gelatin derivatives, casein, agar, sodium alginate, starch, polyvinyl alcohol, polyacrylic acid copolymers and maleic anhydride copolymers. The cellulose esters include carboxymethyl cellulose and hydroxyethyl cellulose. The latex polymers include vinyl chloride copolymers, vinylidene chloride copolymers, acrylic ester copolymers, vinyl acetate copolymers and butadiene copolymers. Among them, gelatin is most preferred.

Gelatin may be any of so-called alkali-treated (lime-treated) gelatin which was immersed in an alkali bath prior to extraction thereof, an acid-treated gelatin which was immersed in an acid bath, a double immersed gelatin which was immersed in both baths and enzyme-treated gelatin. If necessary, gelatin can be used in combination with colloidal albumin, casein, a cellulose derivative (such as carboxymethyl cellulose or hydroxyethyl cellulose), agar, sodium alginate, a saccharide derivative (such as a starch derivative or dextran), a synthetic hydrophilic colloid (such as polyvinyl alcohol, poly-N-vinylpyrrolidone, a polyacrylic acid copolymer, polyacrylamide or a derivative or partial hydrolyzate thereof) or a gelatin derivative.

It is preferred to harden the magnetic recording layer containing gelatin. Hardeners usable for hardening the magnetic recording layer include, for example, aldehyde compounds such as formaldehyde and glutaraldehyde; ketone compounds such as diacetyl and cyclopentanedione; compounds having reactive halogens such as bis(2-chloroethylurea), 2-hydroxy-4,6-dichloro-1,3,5-triazine and those described in U.S. Pat. Nos. 3,288,775 and 2,732,303 and British Patent Nos. 974,723 and 1,167,207; divinylsulfone, 5-acetyl-1,3-diacryloylhexahydro-1,3,5-triazine and compounds having reactive olefins described in U.S. Pat. Nos. 3,635,718 and 3,232,763 and British patent No 994,869; N-hydroxymethylphthalimide; N-methylol compounds described in U.S. Pat. Nos. 2,732,316 and 2,586,168; isocyanates described in U.S. Pat. No. 3,103,437; aziridine compounds described in U.S. Pat. Nos. 3,017,280 and 2,983,611; acid derivatives described in U.S. Pat. Nos. 2,725,294 and 2,725,295; epoxy compounds described in U.S. Pat. No. 3,091,537; and halogenated carboxyaldehydes such as mucochloric acid. Examples of the inorganic compounds usable as the hardener include chromium alum, zirconium sulfate and hardeners of carboxyl group activating type described in Japanese Patent Publication for Opposition Purpose (hereinafter referred to as "J. P. KOKOKU") Nos. 56-12853 and 58-32699, Belgian Patent No. 825,726, J. P. KOKAI Nos. 60-225148 and 51-126125, J. P. KOKOKU No. 58-50699, J. P. KOKAI No. 52-54427 and U.S. Pat. No. 3,321,313.

The amount of the hardener is usually 0.01 to 30% by weight, preferably 0.05 to 20% by weight, based on dry gelatin.

The thickness of the magnetic recording layer is 0.1 to 10 μm , preferably 0.5 to 5 μm and more preferably 1 to 3 μm .

The magnetic recording layer of the present invention may contain an antistatic agent, lubricant, matting agent and surfactant.

The lubricants usable herein include saturated and unsaturated fatty acids (such as fatty acids, e.g. myristic acid, stearic acid and oleic acid and a mixture of fatty acids produced by decomposing a natural animal or vegetable oil and, if necessary, hydrogenating the decomposition products); metallic soaps; N-substituted or N-unsubstituted fatty acid amides; fatty acid esters (such as monoesters, fatty acid esters of polyhydric compounds, e.g. sorbitan and glycerol, and esterified polybasic acids); ester compounds having an ether bond; higher aliphatic alcohols; monoalkyl phosphates; dialkyl phosphates; trialkyl phosphates; paraffins; silicone oil; vegetable and animal oils; mineral oils; higher aliphatic amines; fine powders of inorganic substances such as graphite, silica, molybdenum disulfide and tungsten disulfite; and resins such as polyethylene, polypropylene, polyvinyl chloride, ethylene/vinyl chloride copolymer and polytetrafluoroethylene.

Examples of the antistatic agents include electroconductive fine powders such as carbon black and carbon black graft polymers; natural surfactants such as saponin; nonionic surfactants such as alkylene oxides, glycerols and glycidols; cationic surfactants such as higher alkylamines, quaternary ammonium salts, salts of heterocyclic compounds, e.g. pyridine, phosphoniums and sulfoniums; anionic surfactants having an acid group such as carboxylic acid, phosphoric acid, sulfuric ester or phosphoric ester group; and amphoteric surfactants such as amino acids, aminosulfonic acids, and sulfuric or phosphoric esters of amino alcohols.

Further, fine particles of metal oxides such as ZnO, $TiO_3$, $SnO_2$, $Al_2O_3$, $In_2O_3$, $SiO_2$, MgO, BaO and $MoO_3$ are preferred antistatic agents.

The magnetic recording layer is formed preferably on the back surface of the photosensitive material. This layer can be formed on the back surface of a transparent support by application or printing. It is also preferred to prepare a transparent support having a magnetic recording layer by casting a polymer solution containing magnetized grains dispersed therein together with a polymer solution for forming the transparent support. In this case, the compositions of the two polymers are preferably substantially the same.

The magnetic recording layer may have lubricity-improving effect, curl-controlling effect, antistatic effect and adhesion-inhibiting effect or, alternatively, other functional layers may be provided to impart these functions to the photosensitive material. If necessary, a protecting layer adjacent to the magnetic recording layer may be formed to improve scarring resistance thereof.

The smoothness and S/N ratio of the magnetic signals can be improved by calendering the back surface of the transparent support having the magnetic recording layer. In this case, a photosensitive layer is preferably formed by coating on the transparent support after the calendering process.

The detailed description will be made on the couplers of the general formula [A] of the present invention.

The polymers of the general formula [A] are those having at least two groups of the formula [A] in the molecule including bis-compounds and polymer couplers. The polymer couplers may be homopolymers comprising only a monomer represented by the general formula [A] (preferably that having a vinyl group; hereinafter referred to as 'vinyl polymer') or they may form copolymers with a non-coloring ethylenic monomer which does not couple with an oxidation product of the aromatic primary amine developing agent.

The compounds represented by the general formula [A] are nitrogen-containing heterocyclic couplers of 5-membered ring/5-membered ring condensation type. The coloring mother nucleus has a chemical structure generally called azapentalene and aromatic properties isoelectronic with those of naphthalene. Among the couplers of the general formula [A], preferred are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by the general formulae [A-1], [A-2], [A-3], [A-4], [A-5] and [A-6], respectively. Among them, preferred are those of the formulae [A-1], [A-3] and [A-4] and particularly preferred are those of the formulae [A-3] and [A-4].

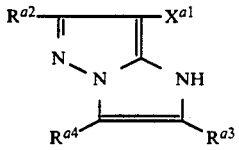
[A-1]

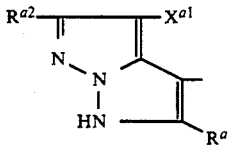
[A-2]

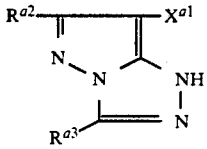
[A-3]

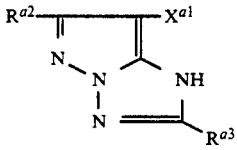
[A-4]

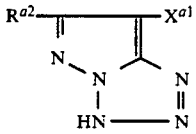
[A-5]

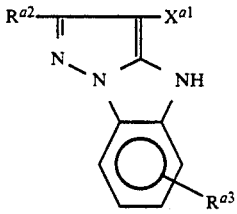
[A-6]

The substituents $R^{a2}$, $R^{a3}$ and $R^{a4}$ in the general formulae [A-1] through [A-6] each represent a hydrogen or halogen atom, or an alkyl, aryl, heterocyclic, cyano, alkoxyl, aryloxy, heterocyclic oxy, acyloxy, carbamoyloxy, silyloxy, sulfonyloxy, acylamino, anilino, ureido, imide, sulfamoylamino, alkylthio, arylthio, heterocyclic thio, alkoxycarbonylamino, aryloxycarbonylamino, sulfonamide, carbamoyl, acyl, sulfamoyl, sulfonyl, sulfinyl, alkoxycarbamoyl or aryloxycarbonyl group, and $X^{a1}$ represents a hydrogen or halogen atom, a carboxyl group or a coupling-off group linked with a carbon at coupling position through an oxygen, nitrogen or sulfur atom.

The substituents $R^{a2}$, $R^{a3}$, $R^{a4}$ or $X^{a1}$ may be each a divalent group to form a bis-compound. When the part represented by any of [A-1] to [A-6] is in the vinyl monomer, $R^{a2}$, $R^{a3}$ or $R^{a4}$ each represent a single bond or a connecting group through which the part represented by any of [A-1] to [A-6] is bonded with the vinyl group.

In particular, $R^{a2}$, $R^{a3}$ and $R^{a4}$ each represent a hydrogen atom, halogen atom (such as chlorine or bromine atom), alkyl group (such as methyl, propyl, t-butyl, trifluoromethyl, tridecyl or 3-(2,4-di-t-amylphenoxy)propyl, 2-dodecyloxyethyl, 3-phenoxypropyl, 2-hexylsulfonylethyl, cyclopentyl or benzyl group), an aryl group (such as phenyl, 4-t-butylphenyl, 2,4-di-t-amylphenyl or 4-tetradecanamidophenyl group), heterocyclic group (such as 2-furyl, 2-thienyl, 2-pyrimidinyl or 2-benzothiazolyl group), cyano group, an alkoxyl group (such as methoxyl, ethoxyl, 2-methoxyethoxyl, 2-dodecyloxyethoxy or 2-methanesulfonylethoxy group), aryloxy group (such as phenoxy, 2-methylphenoxy or 4-t-butylphenoxy group), heterocyclic oxy group (such as 2-benzimidazolyloxy group), acyloxy group such as acetoxy or hexadecanoyloxy group), carbamoyloxy group (such as N-phenylcarbamoyloxy or N-ethylcarbamoyloxy group), silyloxy group (such as trimethylsilyloxy group), sulfonyloxy group (such as dodecylsulfonyloxy group), acylamino group [such as acetamide, benzamide, tetradecanamide, α-(2,4-di-t-aminophenoxy)butanamide, γ-(3-t-butyl-4-hydroxyphenoxy)butanamide or α-{4-(4-hydroxyphenylsulfonyl)phenoxy} decanamide], anilino group [such as phenylamino, 2-chloroanilino, 2-chloro-5-tetradecanamidanilino, 2-chloro-5-dodecyloxycarbonylanilino, N-acetylanilino or 2-chloro-5-{α-(3-t-butyl-4-hydroxyphenoxy)dodecanamido} anilino], ureido group (such as phenylureido, methylureido or N,N-dibutylureido group), imide group [such as N-succinimide, 3-benzylhydantoinyl or 4-(2-ethylhexanoylamino)phthalimide group], sulfamoylamino group (such as N, N-dipropylsulfamoylamino or N-methyl-N-decylsulfamoylamino group), alkylthio group [such as methylthio, octylthio, tetradecylthio, 2-phenoxyethylthio, 3-phenoxypropylthio or 3-(4-t-butylphenoxy) propylthio group], arylthio group (such as phenylthio, 2-butoxy-5-t-octylphgenylthio, 3-pentadecylphenylthio, 2-carboxyphenylthio or 4-tetradecanamidephenylthio group), heterocyclic thio group (such as benzothiazolylthio group), alkoxycarbonylamino group (such as methoxycarbonylamino or tetradecyloxycarbonylamino group), aryloxycarbonylamino group (such as phenoxycarbonylamino or 2,4-di-tert-butylphenoxycarbonylamino group), sulfonamide group (such as methanesulfonamide, hexadecanesulfonamide, benzenesulfonamide, p-toluenesulfonamide, octadecanesulfonamide or 2-methyloxy-5-t-butylbenzenesulfonamide group), carbamoyl group [such as N-ethylcarbamoyl, N,N-dibutylcarbamoyl, N-(2-dodecyloxyethyl)carbamoyl, N-methyl-N-dodecylcarbamoyl or N- {3-(2,4-di-tert-amylphenoxy)propyl}carbamoyl group], acyl group [such as acetyl, (2,4-di-tert-amylphenoxy)acetyl or benzoyl group], sulfamoyl group [such as N-ethylsulfamoyl, N,N-dipropylsulfamoyl, N-(2-dodecyloxyethyl)sulfamoyl, N-ethyl-N-dodecylsulfamoyl or N,N-diethylsulfamoyl group], sulfonyl group (such as methanesulfonyl, octanesulfonyl, benzenesulfonyl or toluenesulfonyl group), sulfinyl group (such as octylsulfinyl, dodecylsulfinyl or phenylsulfinyl group), alkoxycarbonyl group (such as methoxycarbonyl, butyloxycarbonyl, dodecyloxycarbonyl or octadecyloxycarbonyl group) or aryloxycarbonyl group (such as phenyloxycarbonyl or 3-pentadecylphenyloxycarbonyl group).

$X^{a1}$ represents a hydrogen atom, halogen atom (such as chlorine, bromine or iodine atom), carboxyl group, a group connected through an oxygen atom (such as acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy or 2-benzothiazolyloxy group), a group connected through a nitrogen atom such as benzenesulfonamide, N-ethyltoluenesulfonamide, heptafluorobutanamide, 2,3,4,5,6-pentafluorobenzamide, octanesulfonamide, p-cyanophenylureide, N,N-diethylsulfamoylamino, 1-piperidyl, 5,5-dimethyl-2,4-dioxo-3-oxazolydinyl, 1-benzylethoxy-3-hydantoinyl, 2N-1,1-dioxo-3(2H)-oxo-1,2-benzoisothiazoly, 2-oxo-1,2-dihydro-1-pyridinyl, imidazolyl, pyrazolyl, 3,5-diethyl-1,2,4-triazolyl-1-yl, 5- or 6-bromobenzotriazol-1-yl, 5-methyl-1,2,3-triazol-1-yl, benzimidazolyl, 3-benzyl-1-hydantoinyl, 1-benzyl-5-hexadecyloxy-3-hydantoinyl, 5-methyl-1-tetrazolyl, 4-methoxyphenylazo, 4-pivaloylaminophenylazo or 2-hydroxy-4-propanoylphenylazo group], a group connected through a sulfur atom [such as phenylthio, 2-carboxyphenylthio, 2-methoxy-5-t-octylphenylthio, 4-methanesulfonylphe nylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio or 2-phenyl-3-dodecyl-1,2,4-triazolyl-5-thio group].

$R^{a2}$, $R^{a3}$, $R^{a4}$ or $X^{a1}$ may be a divalent group to form a bis-compound. In this case, the divalent group may be a substituted or unsubstituted alkylene group (such as methylene, ethylene, 1,10-decylene or $—CH_2CH_2—O—CH_2CH_2—$), substituted or unsubstituted phenylene group (such as 1,4-phenylene, 1,3-phenylene,

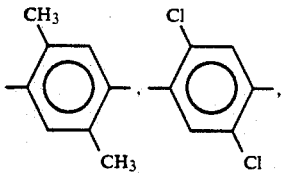

or —NHCO—$R^{a5}$CONH— in which $R^{a5}$ represents a substituted or unsubstituted alkylene group or phenylene group.

When a part represented by any of the general formulae [A-1] through [A-6] is in a vinyl monomer, the connecting group represented by $R^{a2}$, $R^{a3}$ or $R^{a4}$ may be a combination of groups selected from among an alkylene group (substituted or unsubstituted alkylene group such as methylene, ethylene, 1,10-decylene or $—CH_2CH_2OCH_2CH_2—$), phenylene group (substituted or unsubstituted phenylene group such as 1,4-phenylene, 1,3-phenylene,

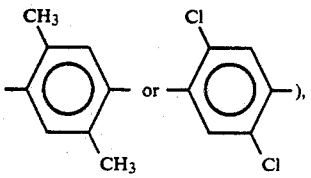

—NHCO—, —CONH—, —O—, —OCO— and aralkylene group (such as

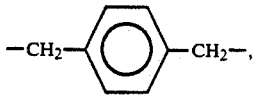

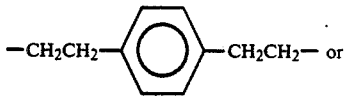

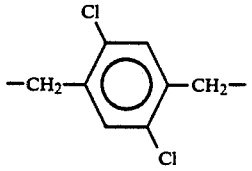

The vinyl groups in the vinyl monomers of the general formula [A-1] to [A-6] include those having a substituent. In this respect, preferred substituents are hydrogen atom, chlorine atom and lower alkyl groups having 1 to 4 carbon atoms.

The non-coloring ethylenically unsaturated monomers which do not couple with the oxidation product of the aromatic primary amine developing agent include acrylic acid, α-chloroacrylic acid, α-alkylacrylic acid (such as methacrylic acid) and amides and esters derived from these acrylic acids (such as acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxymethacrylate), methylene bisacrylamide, vinyl esters (such as vinyl acetate, vinyl propionate and vinyl laurate), acrylonitrlle, methacrylonitrile, aromatic vinyl compounds (such as styrene and derivatives thereof, vinyltoluene, divinylbenzene, vinylacetophenone and sulfostyrene), itaconic acid, citraconic acid, crotonic acid, vinylidene chloride, vinyl alkyl ethers (such as vinyl ethyl ether), maleic acid, maleic anhydride, maleic esters, N-vinyl-2-pyrrolidone, N-vinylpyridine and 2- and 4-vinylpyridines. The non-coloring ethylenically unsaturated monomers may be used either alone or in combination of two or more of them.

Among the compounds of the general formula [A-4] preferably used in the present invention, particularly preferred are those of the following general formula [M]:

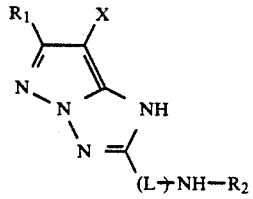

wherein $R_1$ represents an alkyl group, alkoxyl group or aryloxy group, $R_2$ represents an acyl group or sulfonyl group, —(—L—)— represents an alkylene group of the formula:

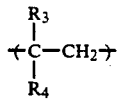

or phenylene group and when it is an alkylene group, the carbon atom bonded with $R_3$ and $R_4$ is bonded with the mother nucleus of the coupler and $R_3$ and $R_4$ each represent a hydrogen atom, alkyl group or aryl group with the proviso that both $R_3$ and $R_4$ cannot be hydrogen atom at the same time, and X represents an aryloxy group, alkoxyl group, 1-azolyl group, alkylthio group or arylthio group; or $R_1$, $R_2$ or X may be a divalent group to form a bis-compound; or when the part represented by the general formula (M) is contained in the vinyl monomer, one of $R_1$, $R_2$ and X represents a mere bond or a connecting group through which it is bonded with the vinyl group.

The detailed description will be made on the substituents $R_1$, $R_2$, —(—L—)— and X.

$R_1$ represents an alkyl, alkoxyl or aryloxy group. In particular, it represents a straight chain or branched alkyl group having 1 to 30 carbon atoms, an alkoxyl group having 1 to 20 carbon atoms or an aryloxy group having 6 to 20 carbon atoms. Namely, $R_1$ represents an alkyl group such as methyl, ethylpropyl, isopropyl, t-butyl, 2-ethylhexyl, dodecyl, 1-ethylpentyl, tridecyl, 2-methanesulfonylethyl, 3-(3-pentadecylphenoxy)propyl, 3- {4- {2-[4-(4-hydroxyphenylsulfonyl) phenoxy]-dodecanamido} phenyl} propyl, 2-ethoxytridecyl, trifluoromethyl, cyclohexyl or 3-(2,4-di-t-amyl)phenoxy group; an alkoxylgroup such as methoxyl, ethoxyisopropoxyl, t-butoxyl, 2-methoxyethoxyl, 2-dodecylethoxyl, 2-methanesulfonylethoxyl or 2-phenoxyethoxyl group; or an aryloxy group such as phyenoxy, 2-naphthyloxy, 2-methylphenoxy, 2-methoxyphenoxy, 4-methoxyphenoxy, 4-t-butylphenoxy, 3-nitrophenoxy, 3-acetamidophenoxy or 2-benzamidophenoxy group. Among these groups, those which can be further substituted may have a substituent such as a halogen atom, or an alkyl, aryl, heterocyclic, cyano, hydroxyl, nitro, carboxyl, sulfo, amino, alkoxyl, aryloxy, acylamino, alkylamino, anilino, ureido, sulfamoylamino, alkylthio, arylthio, alkoxycarbonylamino, sulfonamide, carbamoyl, sulfamoyl, sulfonyl, alkoxycarbonyl, heterocyclic oxy, azo, acyloxy, carbamoyloxy, silyloxy, aryloxycarbonylamino, imide, heterocyclic thio, sulfinyl, phosphonyl, aryloxycarbonyl, acyl or azolyl group. $R_1$ is preferably an alkyl group such as methyl, ethyl, isopropyl or t-butyl group, an alkoxyl group such as methoxyl, ethoxyl, isopropoxyl, 2-methoxtyethoxyl or 2-phenoxyethoxyl group, or an aryloxy group such as phenoxy, 2-methoxyphenoxy, 4-methoxyphenoxy or 2-methylphenoxy group.

$R_2$ in the above formula represents an acyl or sulfonyl group. In particular, it represents an acyl having 8 to 40 carbon atoms such as an alkanoyl or aryloyl group, or a sulfonyl group having 10 to 40 carbon atoms such as alkylsulfonyl or arylsulfonyl group. In particular, $R_2$ represents a straight chain or branched alkanoyl group such as 2-ethylhexanoyl, decanoyl, tetradecanoyl, pentadecanoyl, stearoyl or isostearoyl group; a straight chain alkanoyl group of the following general formula (A):

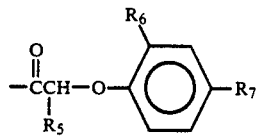

wherein $R_5$ represents a hydrogen atom or an alkyl group, and $R_6$ and $R_7$ each represent an alkyl group; an aryloyl group such as 1-stearyloxybenzoyl, 3-(2-ethylhexanoylamino) benzoyl, 2,4-dioctyloxybenzoyl, 4-(4-dodecyloxybenzenesulfonamide) benzoyl or 1-octyloxy-2-naphthoyl group; an alkylsulfonyl group such as dodecylsulfonyl or octadecylsulfonyl group; or an arylsulfonyl group such as 2-butyloxy-5-t-octylbenzenesulfonyl, 1-octyloxy-4-naphthylsulfonyl, 2-octyloxy-5-t-octylbenzenesulfonyl, 2-(2-hexyloxyethoxy)-5-t-octylbenzenesulfonyl, 2-(2-ethoxyethoxy)-5-(2-octyloxy-5-t-octylbenzenesulfonamide)benzenesulfonyl or 2-octyloxy-5-(2-octyloxy-5-t-octylbenzenesulfonamide)benzenesulfonyl group. These groups may further have the substituents given above for $R_1$, $R_2$ is preferably a substituted alkanoyl or arylsulfonyl group of the general formula (A).

—(—L—)— represents an alkylene or phenylene group of the formula:

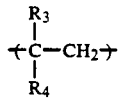

wherein $R_3$ and $R_4$ each represent a hydrogen atom, an alkyl group such as methyl, ethyl, propyl, isopropyl, t-butyl or octyl group or an aryl group such as phenyl, tolyl or 2-naphthyl group with the proviso that both $R_3$ and $R_4$ cannot be hydrogen atom at the same time. Examples of the phenylene groups include 1,2-phenylene, 1,3-phenylene, 1,4-phenylene, 4-methoxy-1,3-phenylene or 5-methyl-1,3-phenylene group. —(—L—)— is preferably an alkylene group of the above general formula wherein $R_3$ and $R_4$ each represent a hydrogen atom, methyl group or phenyl group, or a phenylene group such as 1,3-phenylene or 1,4-phenylene group. X represents an aryloxy, alkoxyl, 1-azolyl, alkylthio or arylthio group. In particular, X represents an aryloxy group such as phenoxy, 4-methylphenoxy, 4-cyanophenoxy, 4-methanesulfonamidophenoxy, 4-acetamidophenoxy, 4-ethoxycarbonylphenoxy, 4-carboxyphenoxy, 3-carboxyphenoxy, 2-carboxyphenoxy, 4-[{1,1-dimethyl-1-(4-hydroxyphenyl)} methyl]phenoxy, 4-(4-hydroxybenzenesulfonyl)phenoxy, 4-methoxyphenoxy, 1-naphthoxy, 2-phenethyloxy, 5-phenyltetrazolyloxy or 2-benzothiazolyloxy group; an alkoxyl group such as methoxy, ethoxy, isopropoxy, t-butoxy, ethoxycarbonylmethoxy, 2-ethoxycarbonylethoxy, 2-cyanoethoxy, 2-methanesulfonylethoxy, 2-benzenesulfonylethoxy or 2-phenoxyethoxy group; a 1-azolyl group such as 1-pyrazolyl, 1-imidazolyl, 3,5-dimethyl-1,2,4-triazol-1-yl, 5- or 6-bromobenzotriazol-1-yl, 5-methyl-1,2,3,4-tetrazol-1yl, 1-benzimidazolyl, 4-chloropyrazol-1-yl, 4-nitropyrazol-1yl, 4-ethoxycarbonyl-1-yl, 3- or 5-acetamidopyraol-1-yl or 2-acetamidoimidazolyl-1yl group; an alkylthio group such as dodecylthio or 1-carboxydodecylthio group; or an arylthio group such as phenylthio, 2-naphthylthio, 2-butoxy-5-t-octylphenylthio, 2-pivaloylaminophenylthio, 4-dodecylphenylthio, 4-octyloxyphenylthio, 2-octyloxy-5-carboxyphenylthio or 2-(3-carboxyproipyloxy)-5-t-octylphenylthio group. These groups may further have the substituents given above for $R_1$. X is preferably an aryloxy, 1-azolyl or arylthio group. X is more preferably a substituted phenoxy group, substituted pyrazol-1-yl group or substituted phenylthio group.

Examples of the couplers represented by the general formula (A) of the present invention will be given below, which by no means limit the present invention.

Exmaples of the compounds represented by the general formulae [A-1] through [A-6] and processes for producing them are given in literatures which will be described below.

Compounds of the general formula [A-2] are described KOKAI No. 59-162548, those of the general formula [A-2] are described [A-3] are in J. P. KOKAI No. 60-43659, those of the general formula described in J. P. KOKOKU No. 47-27411, those of the general formula [A-4] are described in J. P. KOKAI Nos. 59-171956 and 60-172982, those of the general formula [A-5] are described in J. P. KOKAI No. 60-33552, and those of the general formula [A-6] are described in U.S. Pat. No. 3,061,432.

High coloring ballast groups described in J. P. KOKAI Nos. 58-4205, 59-214854, 59-177553, 59-177554 and 59-177557 are applicable to any of the compounds of the above general formulae [A-1] through [A-6].

Examples of the pyrazoloazole couplers usable in the present invention will be given below, which by no means limit the invention.

[A-1]-1

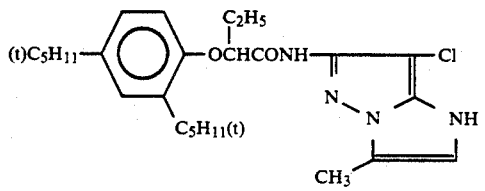

[A-1]-2

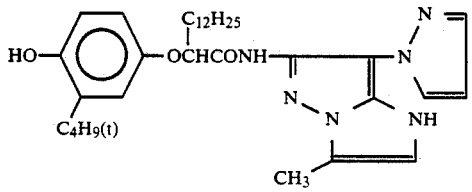

[A-1]-3

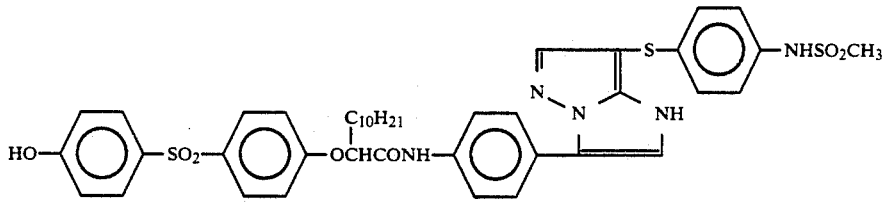

[A-2]-1

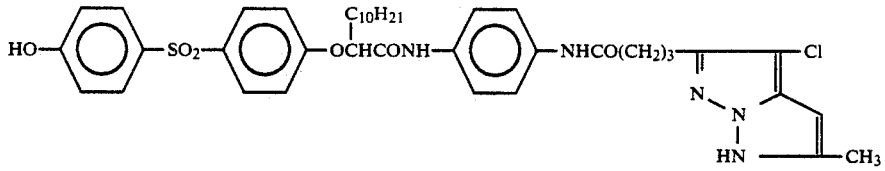

general formula [A-3]

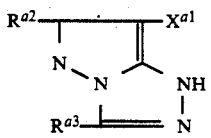

| Coupler | $R^{a2}$ | $R^{a3}$ | $X^{a1}$ |
|---|---|---|---|
| [A-3]-1 | $CH_3$ | 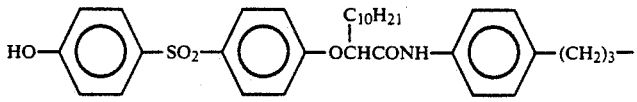 | Cl |

-continued
general formula [A-3]
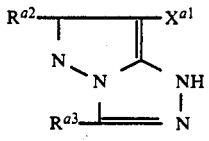
| Coupler | $R^{a2}$ | $R^{a3}$ | $X^{a1}$ |
|---|---|---|---|
| [A-3]-2 | $CH_3$ | 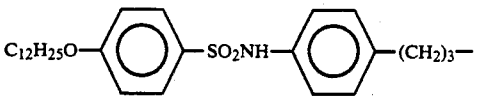 | Cl |
| [A-3]-3 | 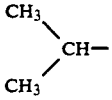 | 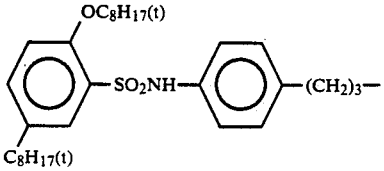 | Cl |
| [A-3]-4 | $CH_3$ | 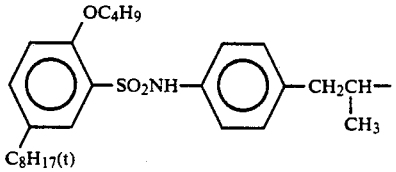 | Cl |
| [A-3]-5 | 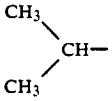 | 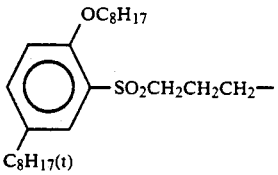 | Cl |
| [A-3]-6 | 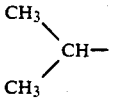 | 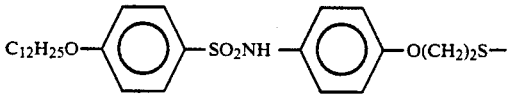 | 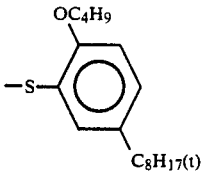 |
| [A-3]-7 | $CH_3$— | 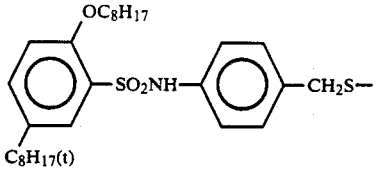 | 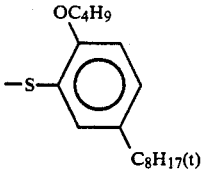 |
| [A-3]-8 | $(CH_3)_3C$— | 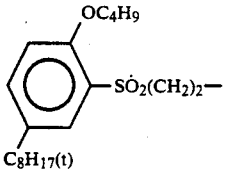 | Cl |
| [A-3]-9 | $CH_3$— | 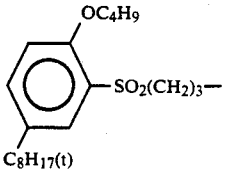 | 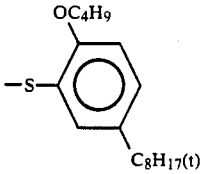 |

-continued
general formula [A-3]
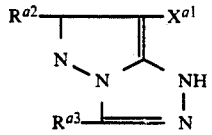
| Coupler | $R^{a2}$ | $R^{a3}$ | $X^{a1}$ |
|---|---|---|---|
| [A-3]-10 | $CH_3$— | 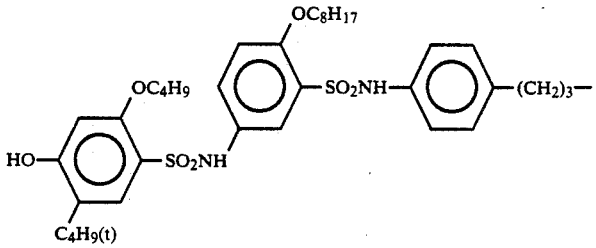 | Cl |
| [A-3]-11 | $CH_3$— | 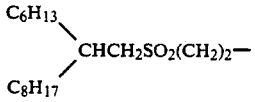 | Cl |
| [A-3]-12 | | 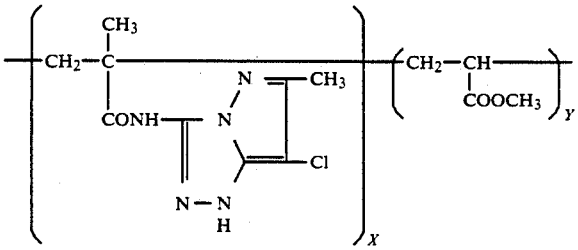 X:Y = 40:60 (molar ratio) | |
general formula [A-4]
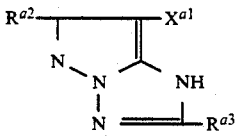
| Coupler | $R^{a2}$ | $R^{a3}$ | $X^{a1}$ |
|---|---|---|---|
| [A-4]-1 | $CH_3$ | 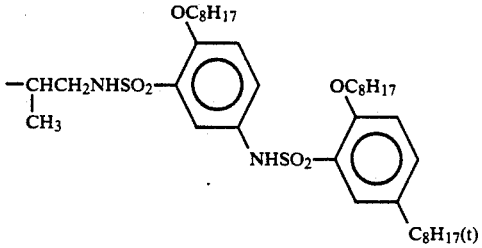 | Cl |
| [A-4]-2 | $CH_3$ | 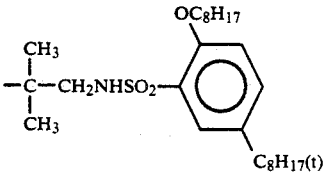 | Cl |

-continued
general formula [A-4]
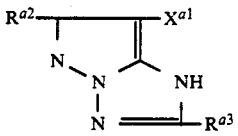
| Coupler | $R^{a2}$ | $R^{a3}$ | $X^{a1}$ |
|---|---|---|---|
| [A-4]-3 | $C_2H_5O-$ | 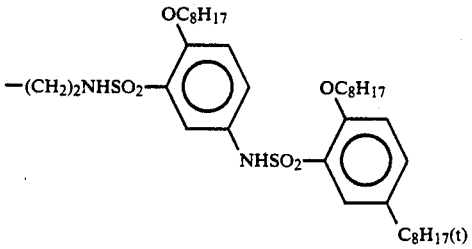 | 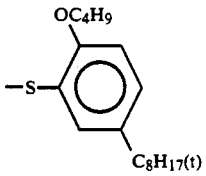 |
| [A-4]-4 | 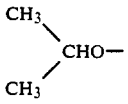 | 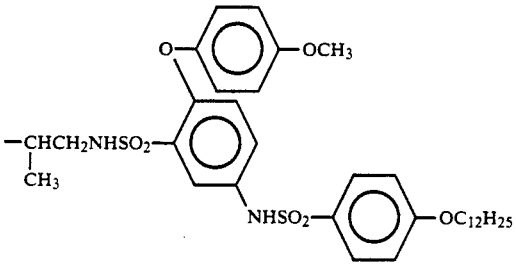 | 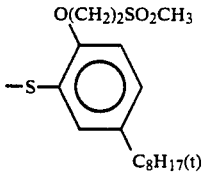 |
| [A-4]-5 | $CH_3O(CH_2)_2O-$ | 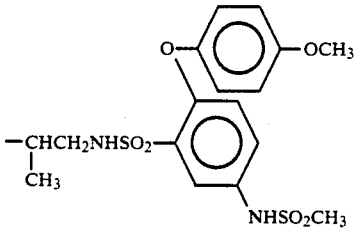 | 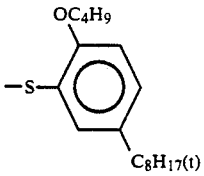 |
| [A-4]-6 | $CH_3NHCONH-$ | 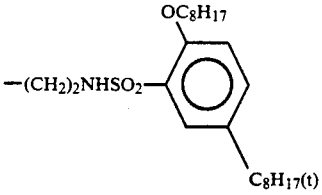 | " |
| [A-4]-7 | 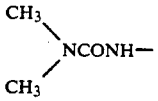 | 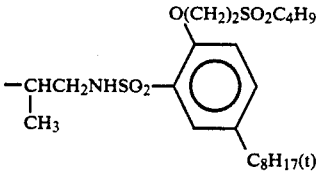 | 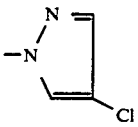 |
| [A-4]-8 | $CF_3CH_2O$ | 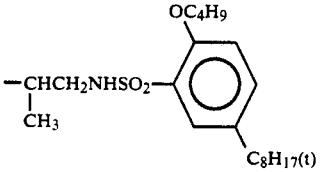 | 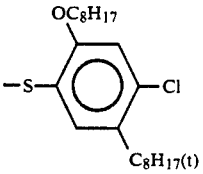 |

-continued
general formula [A-4]
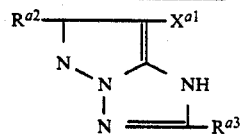
| Coupler | $R^{a2}$ | $R^{a3}$ | $X^{a1}$ |
|---|---|---|---|
| [A-4]-9 | 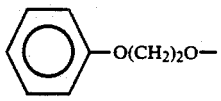 | 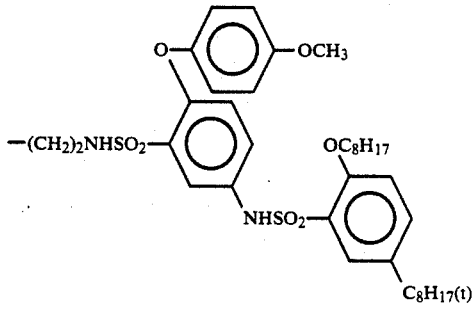 | 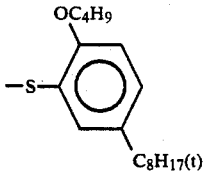 |
| [A-4]-10 | $CH_3SO_2(CH_2)_2O-$ | 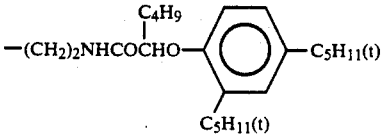 | |
| [A-4]-11 | 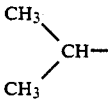 | 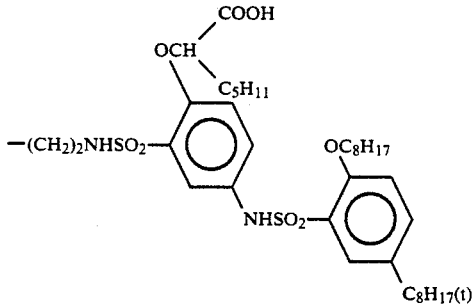 | 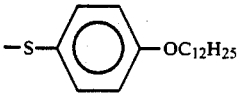 |
| [A-4]-12 | $CH_3-$ | 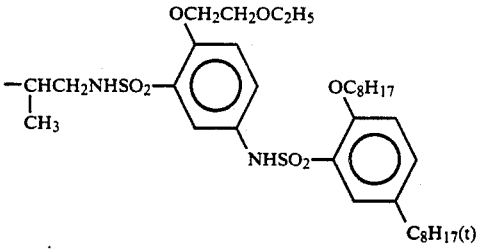 | Cl |
| [A-4]-13 | $CH_3-$ | 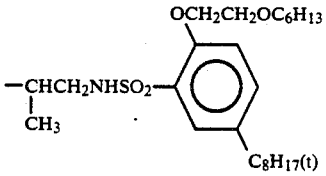 | Cl |
| [A-4]-14 | 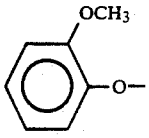 | 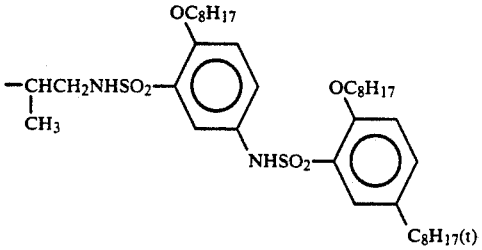 | 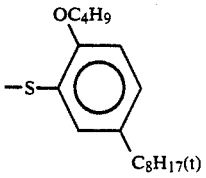 |

-continued
general formula [A-4]
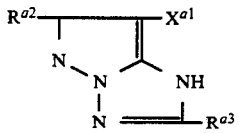
| Coupler | $R^{a2}$ | $R^{a3}$ | $X^{a1}$ |
|---|---|---|---|
| [A-4]-15 | 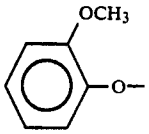 | 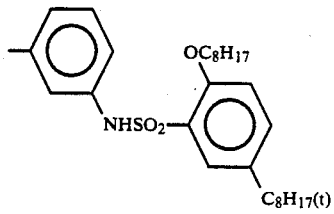 | " |
| [A-4]-16 | 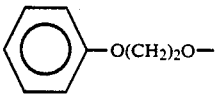 | 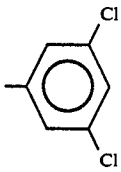 | 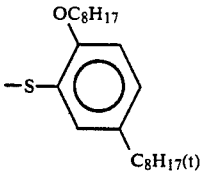 |
| [A-4]-17 | 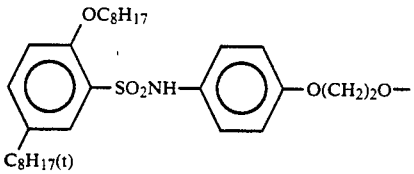 | 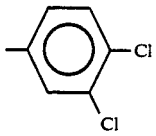 | 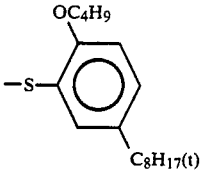 |
| [A-4]-18 | $CH_3$— | 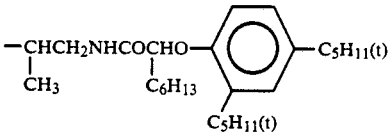 | Cl |
| [A-4]-19 | 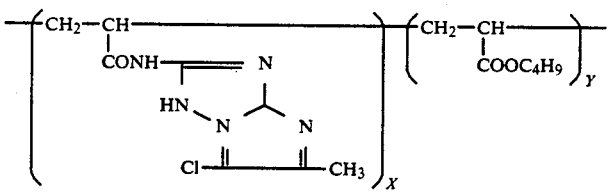 X:Y = 50:50 (molar ratio) | | |
| [A-4]-20 | 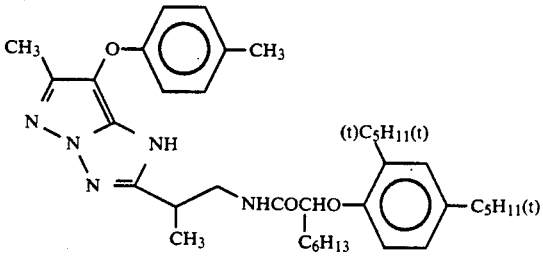 | | |

-continued
general formula [A-4]
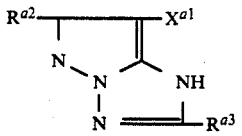
| Coupler | $R^{a2}$ | $R^{a3}$ | $X^{a1}$ |
|---|---|---|---|
| [A-4]-21 | | 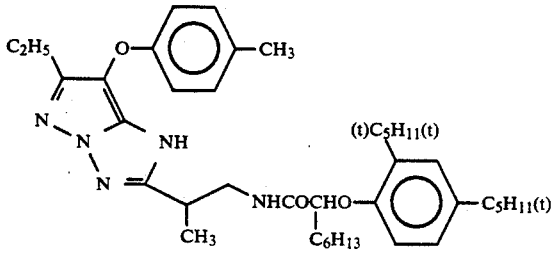 | |
| [A-4]-22 | | 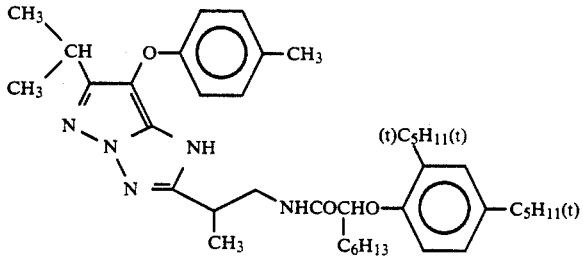 | |
| [A-4]-23 | | 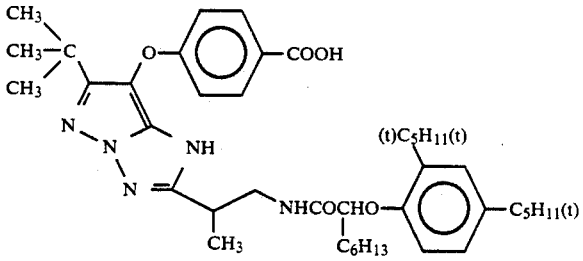 | |
| [A-4]-24 | | 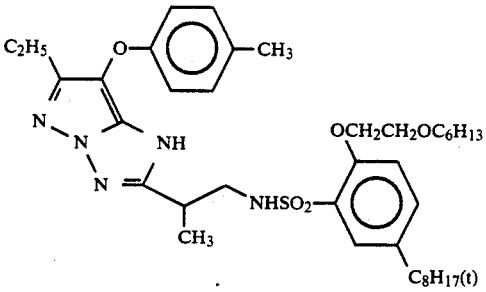 | |
| [A-4]-25 | | 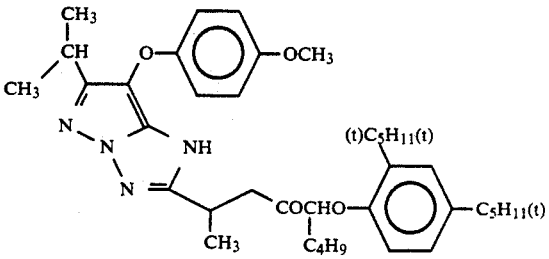 | |

-continued
general formula [A-4]
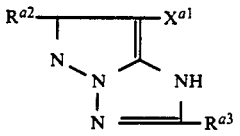
| Coupler | $R^{a2}$ | $R^{a3}$ | $X^{a1}$ |
|---|---|---|---|
| [A-4]-26 | 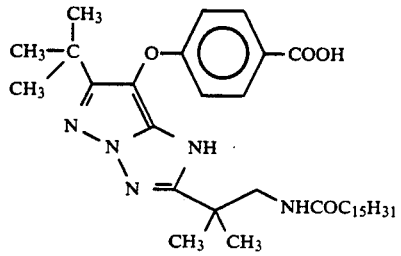 | | |
| [A-4]-27 | 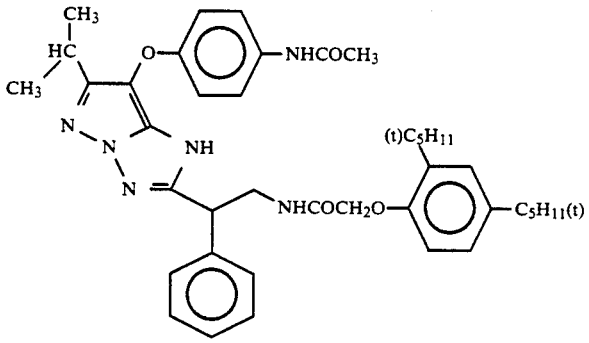 | | |
| [A-4]28 | 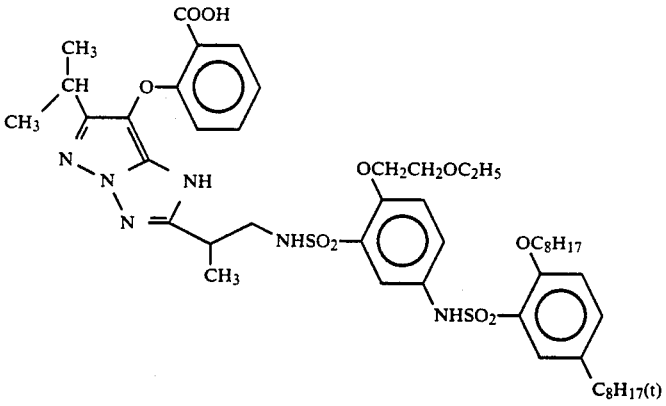 | | |
| [A-4]29 | 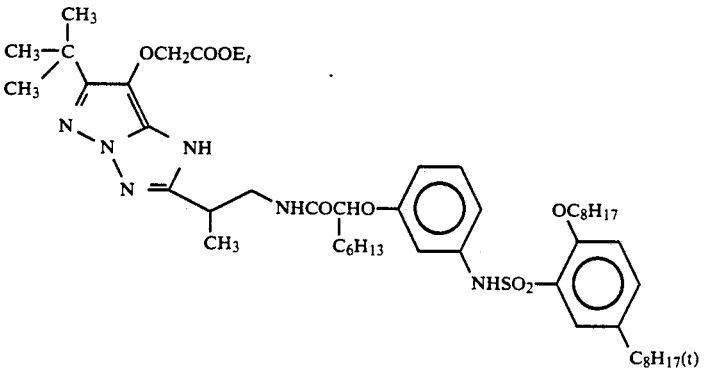 | | |

-continued
general formula [A-4]
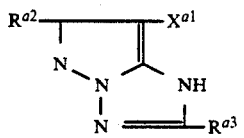
| Coupler | $R^{a2}$ | $R^{a3}$ | $X^{a1}$ |
|---|---|---|---|
| [A-4]30 | | 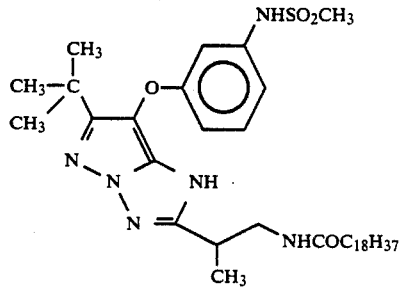 | |
| [A-4]31 | | 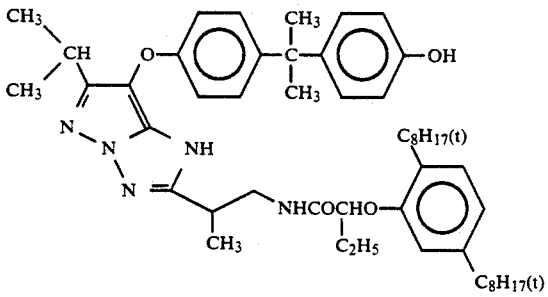 | |
| [A-4]32 | | 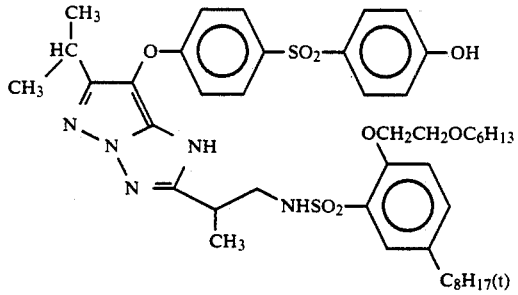 | |
| [A-4]33 | | 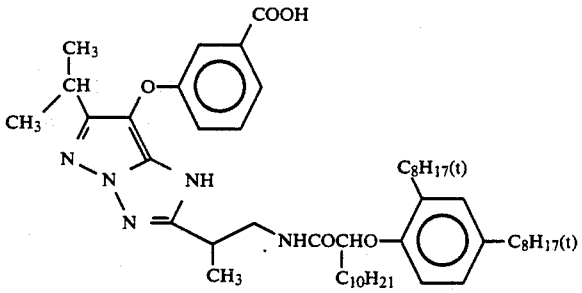 | |
| [A-4]34 | | 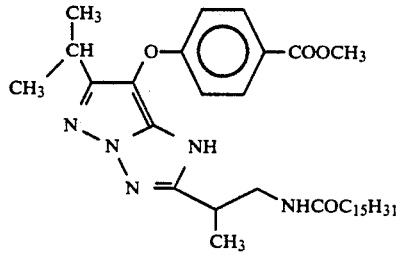 | |

-continued
general formula [A-4]
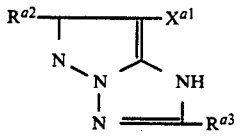
| Coupler | $R^{a2}$ | $R^{a3}$ | $X^{a1}$ |
|---|---|---|---|
| [A-4]35 | 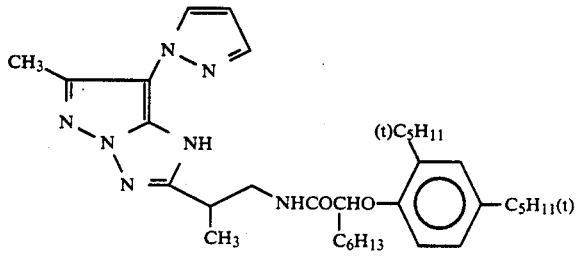 | | |
| [A-4]36 | 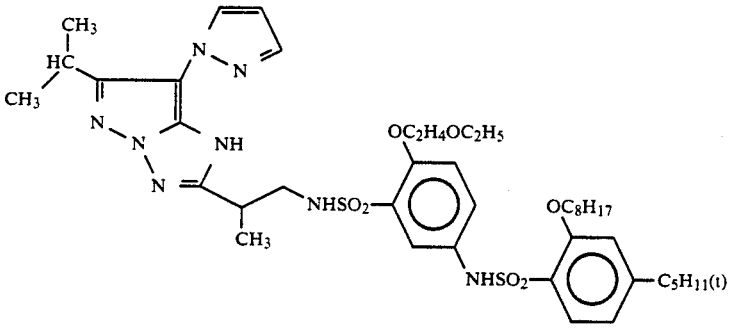 | | |
| [A-4]37 | 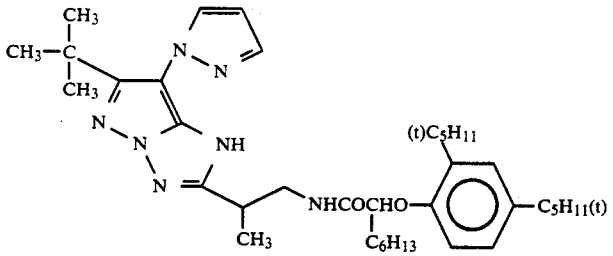 | | |
| [A-4]38 | 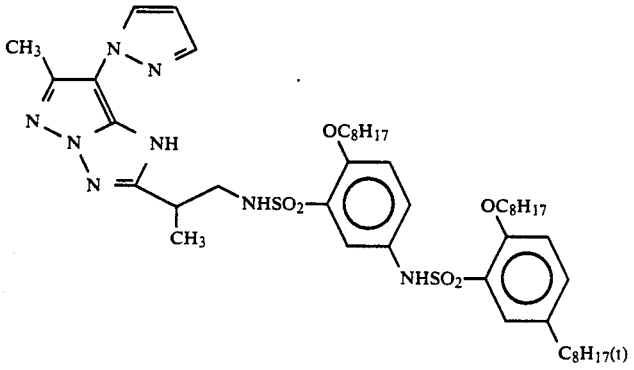 | | |

-continued
general formula [A-4]
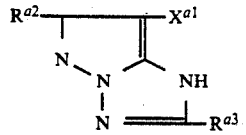
| Coupler | $R^{a2}$ | $R^{a3}$ | $X^{a1}$ |
|---|---|---|---|
| [A-4]39 | 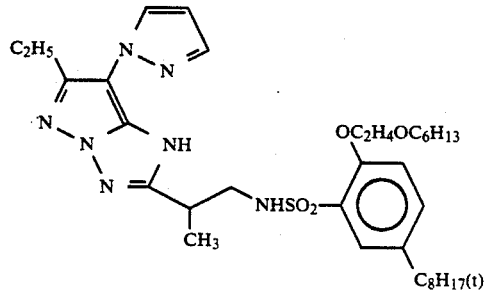 | | |
| [A-4]40 | 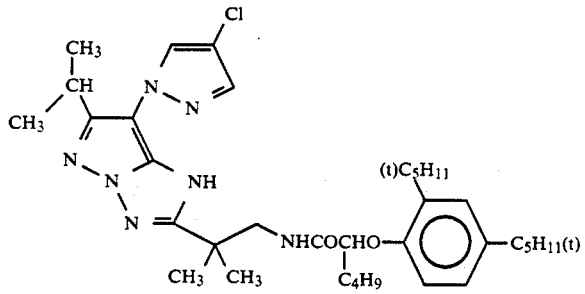 | | |
| [A-4]41 | 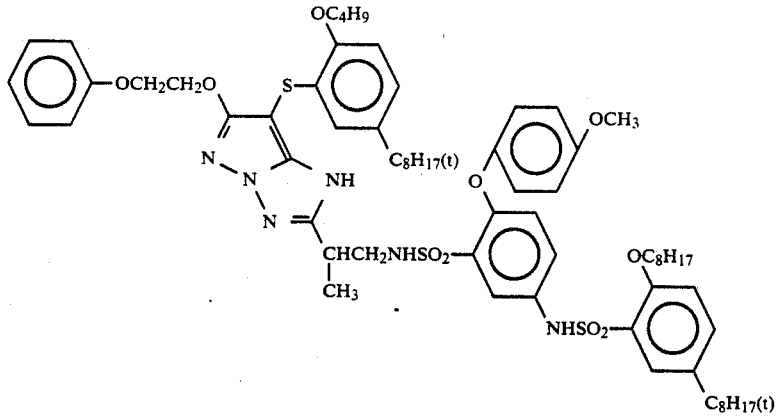 | | |
| [A-4]42 | 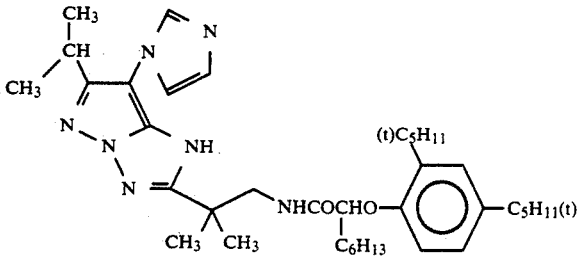 | | |

-continued
general formula [A-4]
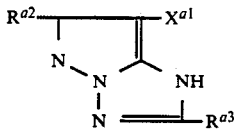
| Coupler | $R^{a2}$ | $R^{a3}$ | $X^{a1}$ |
|---|---|---|---|
| [A-4]43 | 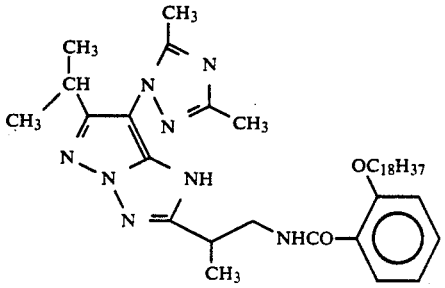 | | |
| [A-4]44 | 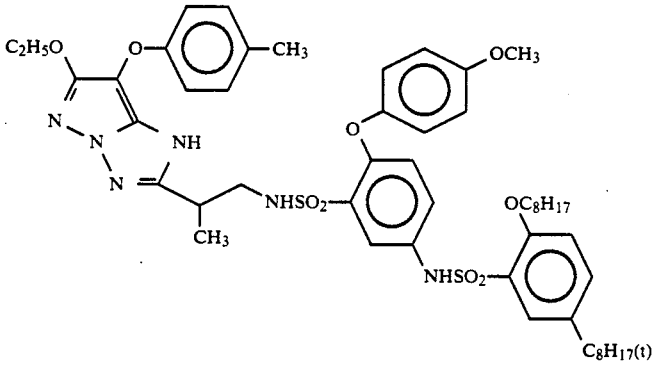 | | |
| [A-4]45 | 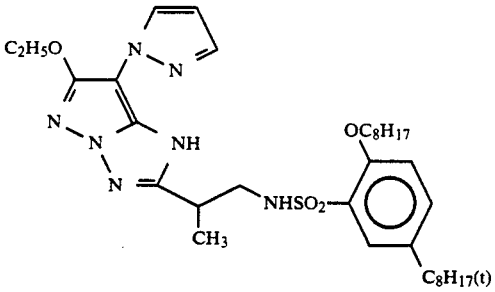 | | |
| [A-4]46 | 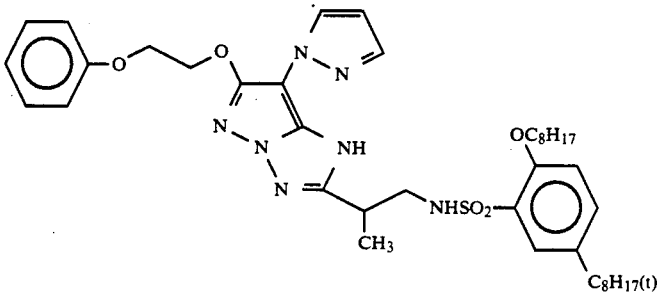 | | |

-continued
general formula [A-4]
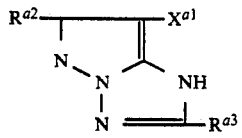
| Coupler | $R^{a2}$ | $R^{a3}$ | $X^{a1}$ |
|---|---|---|---|
| [A-4]47 | 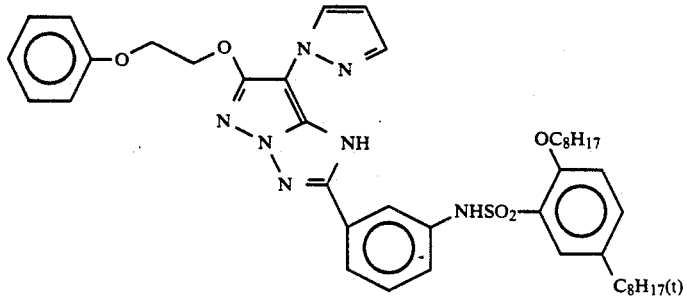 | | |
| [A-4]48 | 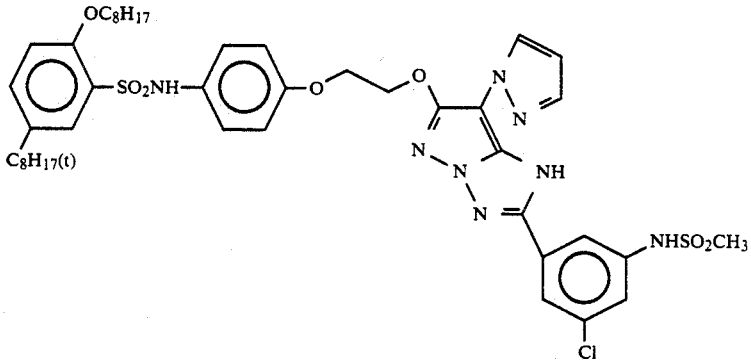 | | |
| [A-4]49 | 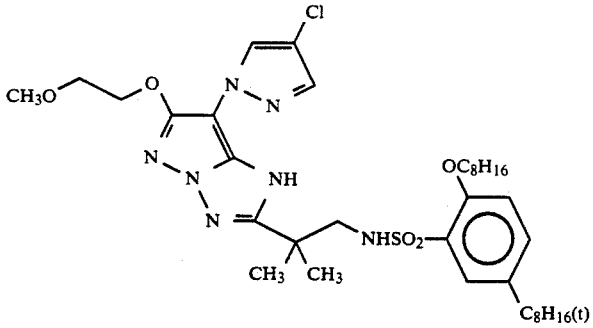 | | |
| [A-4]-50 | 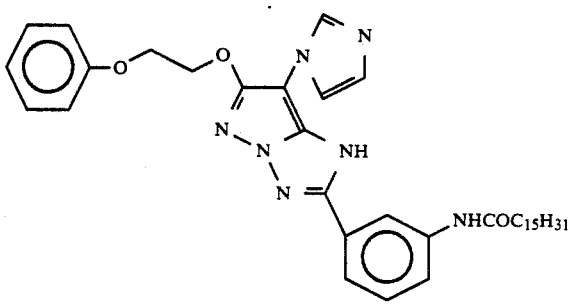 | | |

-continued
general formula [A-4]
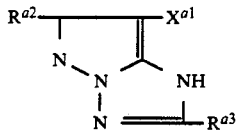
| Coupler | $R^{a2}$ | $R^{a3}$ | $X^{a1}$ |
|---|---|---|---|
| [A-4]-51 | 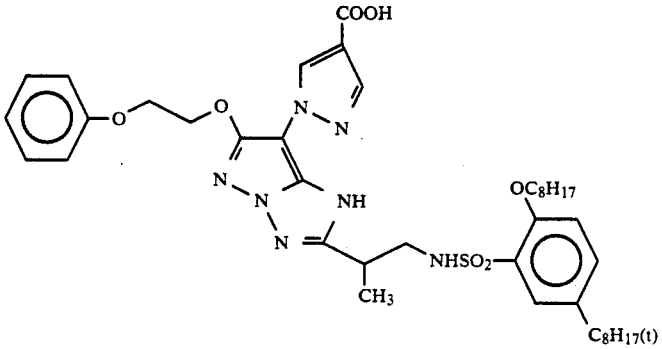 | | |
| [A-4]-52 | 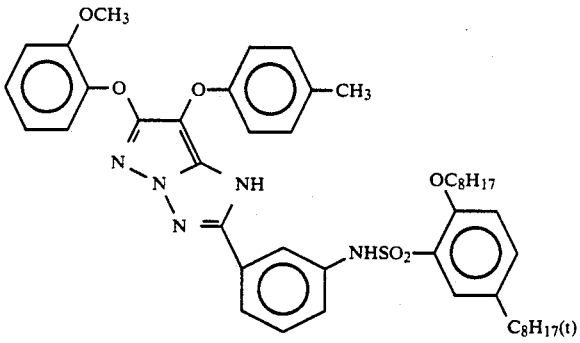 | | |
| [A-4]-53 | 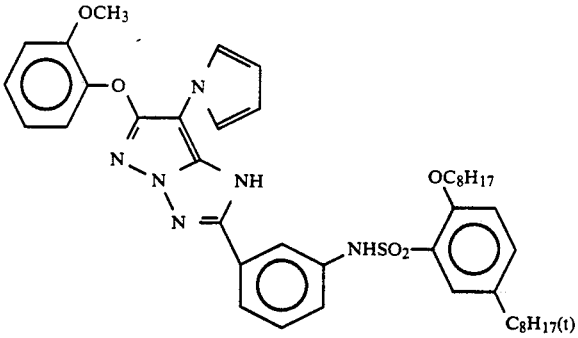 | | |
| [A-4]-54 | 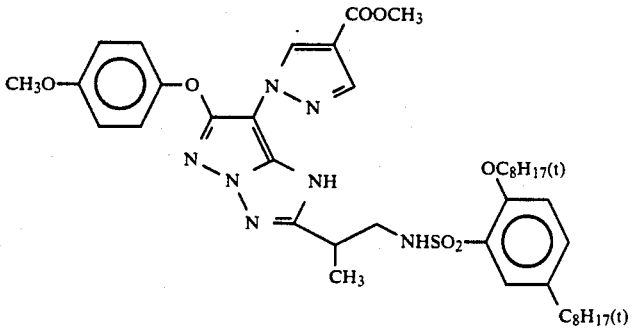 | | |

-continued
general formula [A-4]
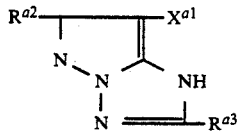
| Coupler | $R^{a2}$ | $R^{a3}$ | $X^{a1}$ |
|---|---|---|---|
| [A-4]-55 | 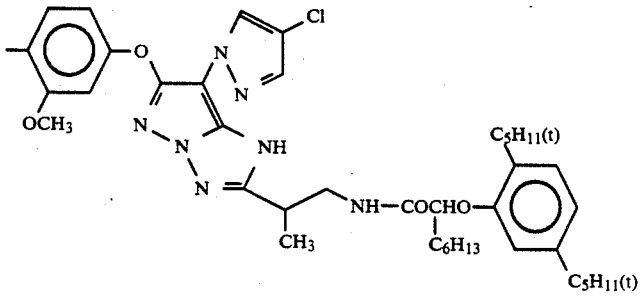 | | |
| [A-4]-56 | 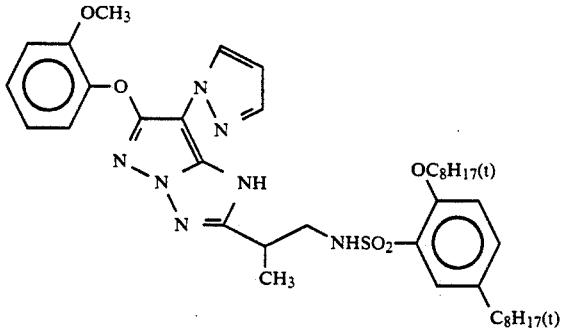 | | |
| [A-4]-57 | 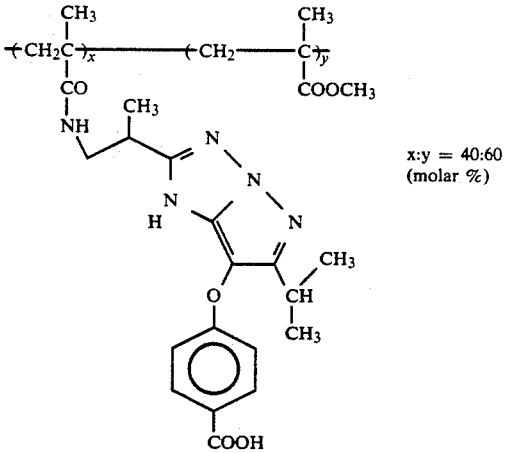 x:y = 40:60 (molar %) | | |
| [A-4]-58 | 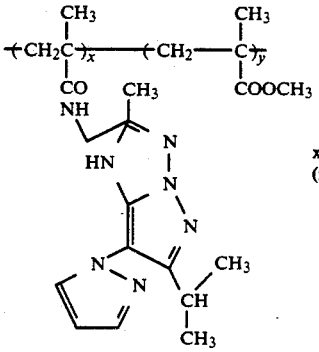 x:y = 30:70 (molar %) | | |

-continued
general formula [A-4]
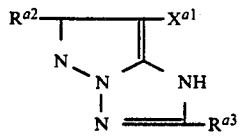
| Coupler | $R^{a2}$ | $R^{a3}$ | $X^{a1}$ |
|---|---|---|---|
| [A-4]-59 | | 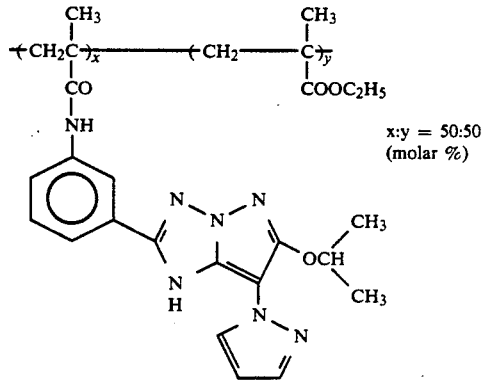 x:y = 50:50 (molar %) | |
| [A-4]-60 | | 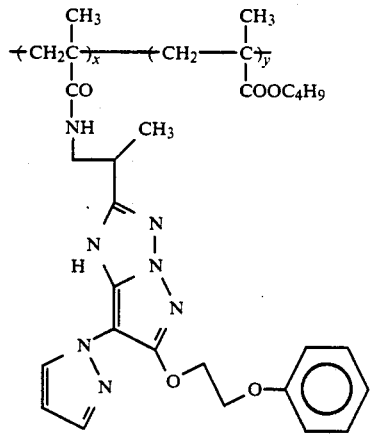 | |
| [A-4]-61 | | 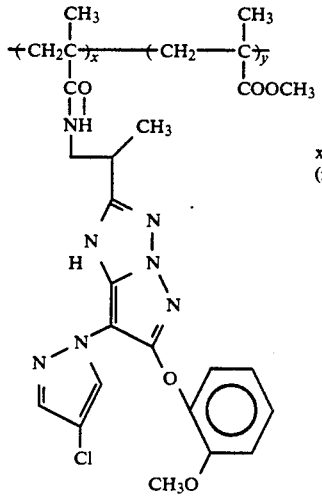 x:y = 45:55 (molar %) | |

-continued
general formula [A-4]
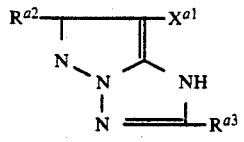
| Coupler | $R^{a2}$ | $R^{a3}$ | $X^{a1}$ |
|---|---|---|---|
| [A-4]-62 | | 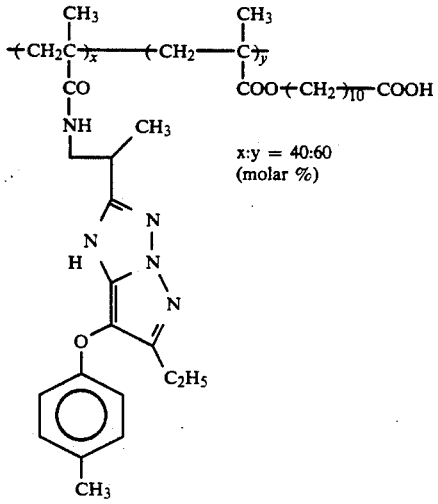 x:y = 40:60 (molar %) | |
| [A-4]-63 | | 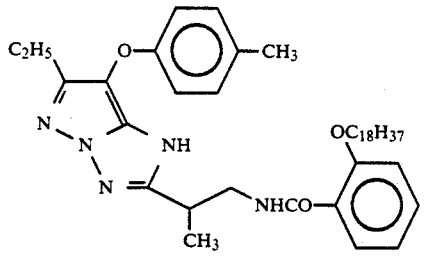 | |
| [A-4]-64 | | 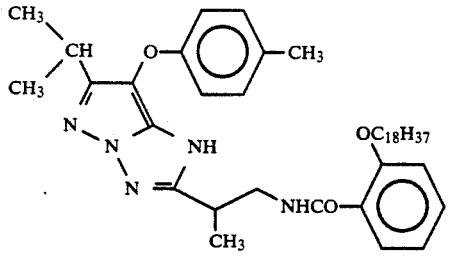 | |
| [A-4]-65 | | 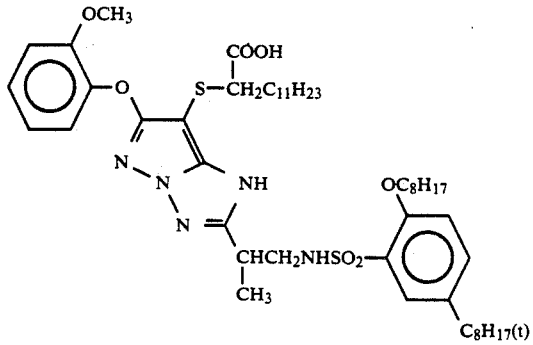 | |

-continued
general formula [A-4]
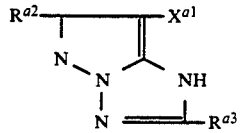
| Coupler | $R^{a2}$ | $R^{a3}$ | $X^{a1}$ |
|---|---|---|---|
| [A-4]-66 | | 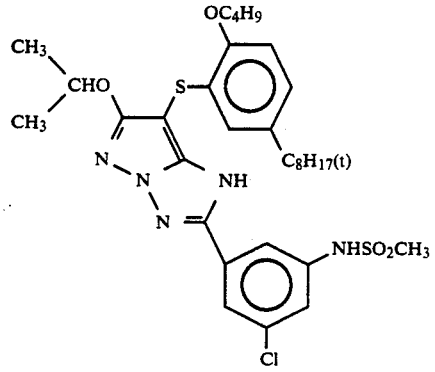 | |
| [A-4]-67 | | 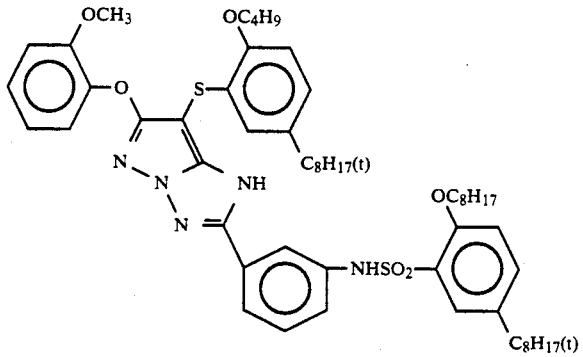 | |
| [A-4]-68 | | 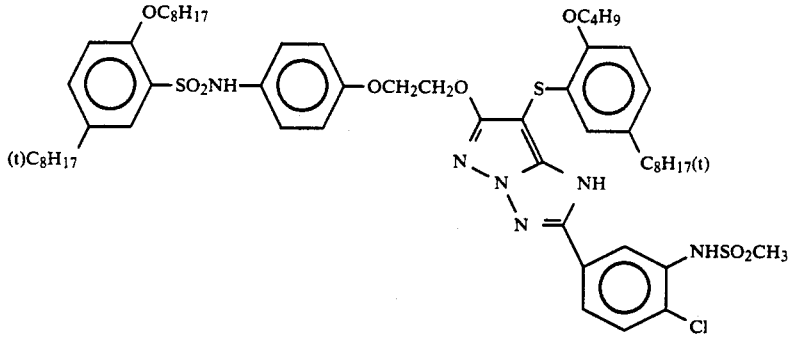 | |
| [A-4]-69 | | 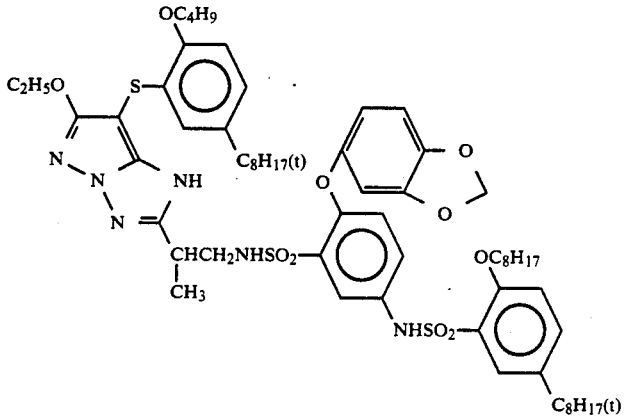 | |

-continued general formula [A-4]

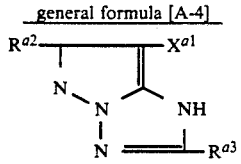

| Coupler | $R^{a2}$ | $R^{a3}$ | $X^{a1}$ |
|---|---|---|---|
| [A-5]-1 | 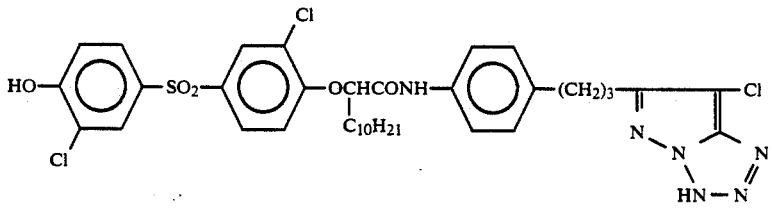 | | |
| [A-6]-1 | 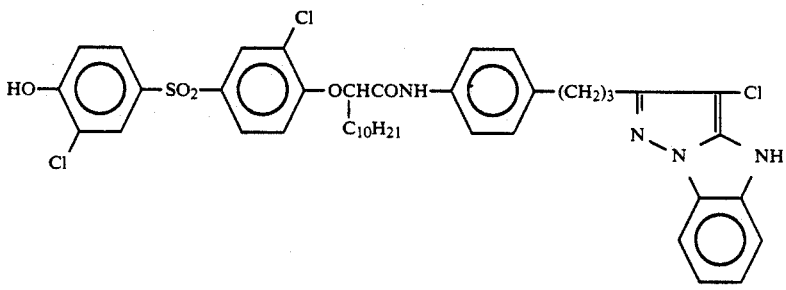 | | |
| [A-6]-2 | 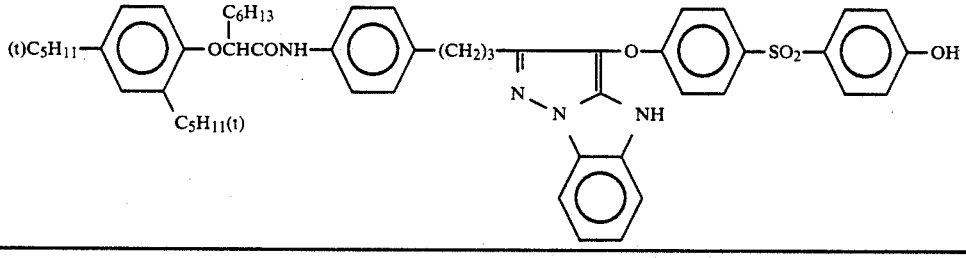 | | |

The weight ratio of the high-boiling organic solvent to the magenta coupler of the general formula (A) is not higher than 2.0, preferably not higher than 1.0, more preferably not higher than 0.5 and particularly preferably not higher than 0.2. When the amount of the high-boiling organic solvent for the dispersion is reduced, the sharpness of the image and desilverizability can be improved favorably. When a combination of two or more magenta couplers of the general formula (A) is used, the stability of the dispersion of the couplers in the photosensitive layer can be improved even if the amount of the high-boiling organic solvent is reduced.

The magenta coupler of the general formula (A) of the present invention is incorporated into a green-sensitive emulsion layer and/or a layer adjacent thereto. The total amount of the magenta coupler(s) is 0.01 to 1.0 g/m$^2$, preferably 0.05 to 0.8 g/m$^2$ and more preferably 0.1 to 0.5 g/m$^2$. The magenta coupler of the present invention can be incorporated into the photosensitive material by the same process as that for the incorporation of other couplers described below. When there are two or more layers sensitive to the same color but having different unequal sensitivity, the magenta coupler of the general formula (A) is incorporated into at least one layer to obtain the effect of the present invention. However, it is preferred to incorporate the coupler into all the layers to further increase the effect of the present invention.

Since the magenta coupler represented by the general formula (A) has only a low subabsorption in the blue light region, the amount of the yellow-colored magenta coupler in a green-sensitive layer can be reduced and the density of the blue-sensitive layer can be reduced without impairing the color reproduction. Although it is most preferred to add the yellow-colored magenta coupler into the green-sensitive layer so that the masking from the green-sensitive layer to the blue-sensitive layer will be proper, the masking may be over or under depending on the purpose.

The detailed description will be made on the yellow-colored magenta couplers preferably used in the present invention which are represented by the following general formula (I):

MCP-YD wherein MCP represents a magenta coupler residue, and YD represents a group which is bonded with a coupling group of MCP to cleave the compound into MCP and YD when the coupler is reacted with an oxidation product of the developing agent and which is an atomic group containing a yellow dye or a group bonded with MCP through an azo group to form a yellow azo dye together with MCP.

Detailed description will be made on the compounds represented by the general formula (I).

The magenta coupler residue represented by MCP may be any of 5-pyrazolone type, pyrazolotriazole type or pyrazoloimidazole type. Preferred MCP is represented by the following general formula (II), (III) or (IV):

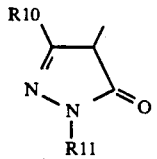

general formula (II)

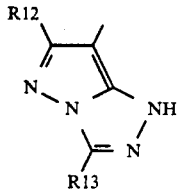

general formula (III)

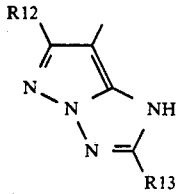

general formula (IV)

The free bond at the coupling position in each of the above formula represents the position of the coupling-off group.

When R10, R11, R12 or R13 in the above formulae has a nondiffusible group, the total number of carbon atoms thereof is controlled in the range of 8 to 40, preferably 10 to 30. In other cases, the total number of carbon atoms is preferably not more than 15. In bis-type, telomer-type or polymer-type couplers, any of these substituents represents a divalent group which connects recurring units or the like. In this case, the number of the carbon atoms is not particularly limited.

Description will be made on R10 through R13. R41 given below represents an aliphatic group, aromatic group or heterocyclic group, R42 represents an aromatic group or heterocyclic group, and R43, R44 and R45 each represent a hydrogen atom, aliphatic group, aromatic group or heterocyclic group.

R10 has the same meaning as that of R41 or it represents R41CON(R43) group, R41N(R43)- group, R41SO2N(R43)- group, R41S-group, R430- group or R45N(R43)CON(R44)- group. R11 has the same meaning as that of R41, R12 and R13 have the same meaning as that of R43 or it represents R41S- group, R43O-group, R41CON(R43)- group or R41SO2N(R43)-group..

The aliphatic groups described above include saturated or unsaturated, cyclic, straight chain or branched, and substituted or unsubstituted aliphatic hydrocarbon groups having 1–32 carbon atoms, preferably 1 to 22 carbon atoms. Typical examples of them include methyl, ethyl, propyl, isopropyl, butyl, (t)-butyl, (i)-butyl, (t)-amino, pentyl, hexyl, cyclohexyl, 2-ethylhexyl, octyl, 1,1,3,3-tetramethylbutyl, decyl, dodecyl, hexadecyl or octadecyl groups.

The aromatic groups are substituted or unsubstituted phenyl or substituted or unsubstituted naphthyl groups having 6 to 20 carbon atoms.

The heterocyclic groups are substituted or unsubstituted, three-membered to eight-membered heterocyclic groups having 1 to 20 carbon atoms, preferably 1 to 7 carbon atoms and having a hetero-atom selected from among nitrogen, oxygen and sulfur atoms. Typical examples of the heterocyclic groups include 2-pyridyl, 2,4-dioxo-1,3-imidazolidin-5-yl, 1,2,4-triazol 2-yl and 1-pyrazolyl groups.

When the aliphatic hydrocarbon group, aromatic group or heterocyclic group has a substituent, typical examples of the substituents include halogen atoms, R-47O- group, R46S- group, R47CON(R48)- group, R47N(R48)CO- group, R46SO2N(R47)- group, R47N(R48)SO2 group, R46SO2- group, R47OCO-group, R47N(R48)CON(R49)-group, R47CON(R48-)SO2- group, the same groups as those of R46, R46COO-group, R47OSO2- group, cyano group and nitro group. R46 herein represents an aliphatic group, aromatic group or heterocyclic group, R47, R48 and R49 each represent an aliphatic group, aromatic group, heterocyclic group or hydrogen atom. The aliphatic, aromatic and heterocyclic groups are the same as those listed above.

The description will be made on preferred ranges of R10 through R13.

R10 is preferably R41CONH- group or R41-N(R43)-group. R11 is preferably an aromatic group. R12 and R13 are each preferably an aliphatic group, aromatic group, R41O- group or R41S- group.

Typical examples of R10 through R13 will be given below.

Examples of R10 include 3- {2-(2,4-di-t-amylphenoxy)butanamido} benzamide group, 3- {4-(2,,4-di t amylphenoxy)butanamido} benzamide group, 2-chloro-5-tetradecanamidoanilino group, 3-(2,4-di-t-amylphenoxyacetamido)benzamide group, 2-chloro-5-dodecenylsuccinimidoanilino group, 2-chloro-5- {2-(3-t-butyl-4-hydroxyphenoxy) tetradecanamido} anilino group, 2,2-dimethylpropanamide group, 2-(3-pentadecylphenoxy)-butanamide group, pyrrolidino group and N,N-dibutylamino group.

Preferred examples of R-11 include 2,4,6-trichlorophenyl group, 2-chlorophenyl group, 2,5-dichlorophenyl group, 2,3-dichlorophenyl group, 2,6-dichloro-4-methoxyphenyl group, 4- {2-(2,4-di-t-amylphenoxy)butanamido} phenyl group and 2,6-dichloro-4-methanesulfonylphenyl group.

Examples of R12 include methyl group, ethyl group, isopropyl group, ethoxy group, butoxy group, pentyloxy group, hexyloxy group, methylthio group, ethylthio group, 3-phenylureido group, phenoxyethoxy group and 3-(2,4-di-t-amylphenoxy)propyl group.

Examples of R13 include 3-(2,4-di-t-amylphenoxy)-propyl group, 3-[4- {2-[4-(4-hydroxyphenylsulfonyl)-phenoxy]tetradecanamido} phenyl]propyl group, methylthio group, ethylthio group, methyl group, 1-methyl-2-(2-octyloxy-5-[2-octyloxy-5-(1,1,3,3-tetramethylbutyl) phenylsulfonamido]phenylsulfonamido]ethyl group, 3- {4-(4-dodecyloxyphenylsulfonamido)phenyl} propyl group, 1,1-dimethyl-2-(2-octyloxy-5-(1,1,3,3-tetramethylbutyl)phenylsulfonamido]ethyl group and dodecylthio group.

Now, the description will be made on the groups represented by YD in the general formula (I).

When the group represented by YD is an atomic group containing a yellow dye, the yellow dye is a well-known one. Examples of the yellow dyes include azo dyes, anthraquinone dyes and azomethine dyes. These dyes are described in, for example, J. Fabian, H. Hartmann 'Light Absorption of Organic Colorants', (Springer Verlag). However, when these dyes are used in the present invention, YD must flow out of the photographic layer after cleavage from MCP so that it is substantially removed as the yellow dye from the photographic layer. Therefore, they preferably has a carboxyl group or sulfo group as a water-soluble substituent.

When the group represented by YD is one which is bonded with MCP through an azo group to form a yellow azo dye together with MCP, this group is preferably an aromatic azo group or heterocyclic azo group.

The groups represented by YD are preferably those of the following general formula (V):

$$-\{L-(A)_l\}_m-N{=}N-B-(SOL)_n$$

wherein L represents a group of the following formula (v-a), (v-b) or (V-c):

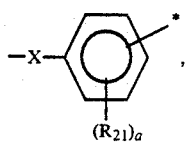
(V-a)

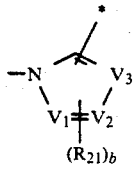
(V-b)

$$-X-R_{22}-^{*} \quad \text{(V-c)}$$

A represents a divalent atomic group having at least one double bond capable of resonating with N=N, l and m each represent 0 or 1 (with the proviso that when L represents $-X-R^{22}-^{*}$, l and m each represent 1), B represents an aromatic group or an atomic group other than aromatic group which has at least one double bond capable of resonating with N=N, SOL represents a carboxyl group or sulfo group (including its potassium, sodium or amine salt), and n represents 0 or an integer of 1 to 3 (with the proviso that when m is 1, n is not 0); and $R_{21}$ represents a possible substituent for the aromatic ring, $V_1$, $V_2$ and $V_3$ each represent a methine group or nitrogen atom, $R_{22}$ represents an alkylene group, symbol '*' represents a position at which it is bonded with $(A)_l-N{=}N-B-(SOL)_n$, X represents an oxygen atom or sulfur atom, a represents 0 or an integer of 1 to 5, and b represents 0 or an integer of 1 to 3, with the proviso that when a and b are each 2 or more, the plural $R_{21}$'s may be the same or different from one another.

Description will be made on the preferred ranges of the groups of the general formulae (V).

The groups represented by L are preferably those represented by (v-a) or (V-b). The groups represented by $R_{21}$ are those described above as the substituents for the aromatic group $R_{41}$.

The groups represented by A are preferably those bonded with N=N through an aromatic group and bonded with L through an amido bond, ether bond, thioeter bond, ester bond or alkylene bond contained in A.

The groups represented by B are preferably aromatic groups or unsaturated heterocyclic groups and they are the same as those described above for $R_{41}$.

Particularly preferred compounds in the present invention are those represented by the following general formula (VI):

general formula (VI):

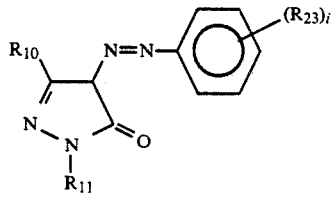

wherein $R_{10}$ and $R_{11}$ are as defined in the above generl formula (II); $R_{23}$ represents an alkoxyl group having preferably 1 to 6 carbon atoms (such as methoxyl, ethoxyl, propoxyl, isopropoxyl or butoxyl group), alkylthio group having preferably 1 to 6 carbon atoms (such as methylthio, ethylthio or hexylthio group), alkyl group having preferably 1 to 6 carbon atoms (such as methyl, ethyl, propyl, isopropyl or t-butyl group), acylamino group having preferably 2 to 6 carbon atoms (such as acetamide, butanamide, 2,2-dimethylpropanamide or hexanamide group), aryloxy group having preferably 6 to 10 carbon atoms (such as phenoxy group), arylthio group having preferably 6 to 10 carbon atoms or hydroxyl group; and i represents an integer of 1 to 5 and when i represents 2 or more, the plural $R_{23}$'s may be the same or different from one another.

The compounds usable in the present invention are those having a maximum absorption wave length of 400 to 490 nm, preferably 420 to 470 nm.

The compounds represented by the general formulae (I) and (VI) of the present invention can be synthesized by known processes such as those described in J. P. KOKAI Nos. 63-1104523, 61-189538, 59-214853, 52-42121, 49-131448, 62-133458 and 62-50830 and U.S. Pat. Nos. 4,277,559, 3,005,712 and 2,852,370 as well as processes analogous to them.

(Examples of compounds)

-continued
(1)
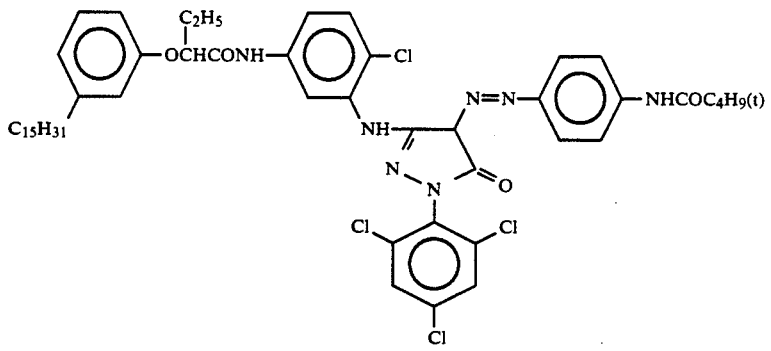
(2)
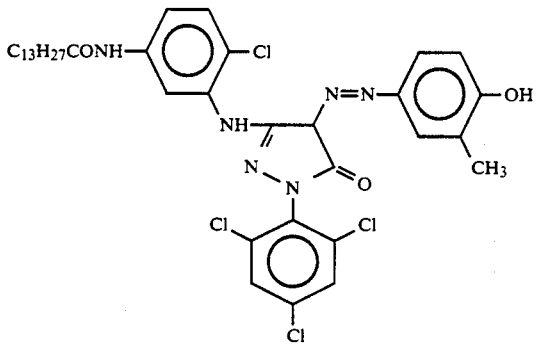
(3)
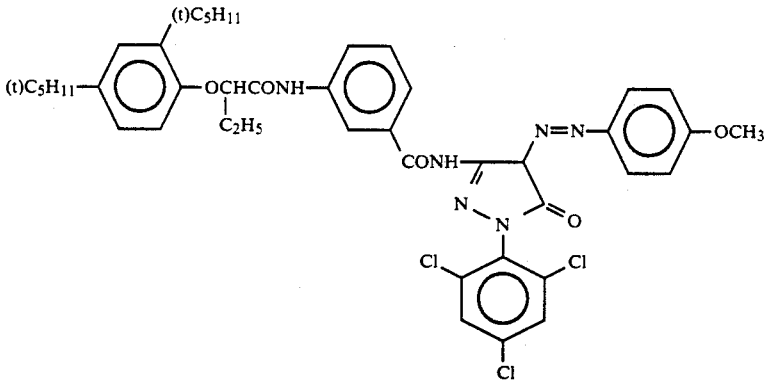
(4)
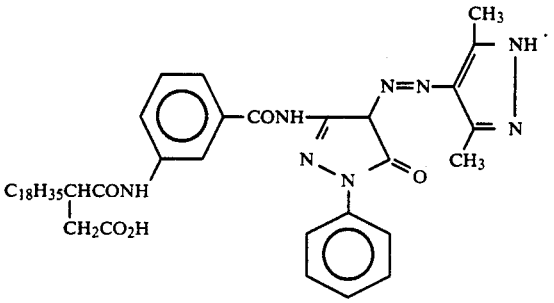

-continued
(5)
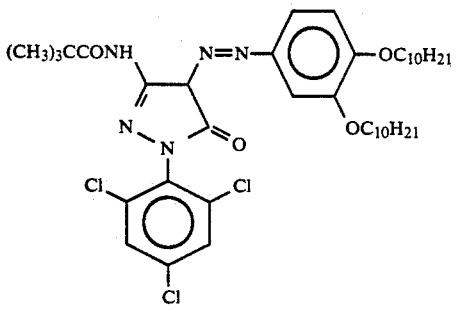
(6)
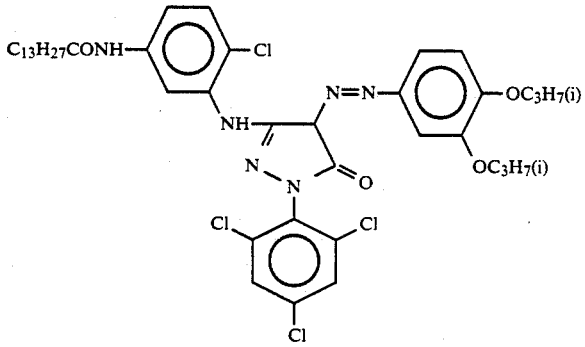
(7)
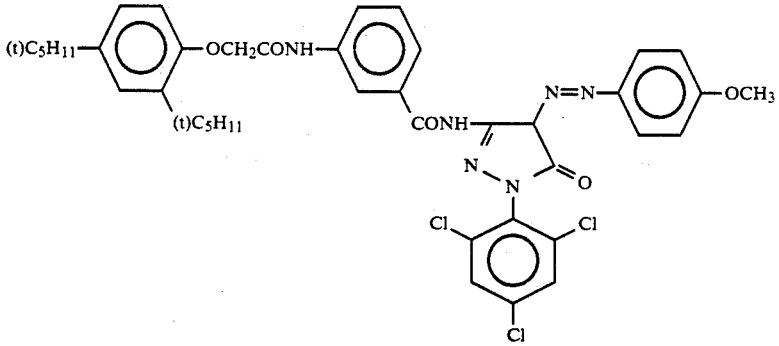
(8)
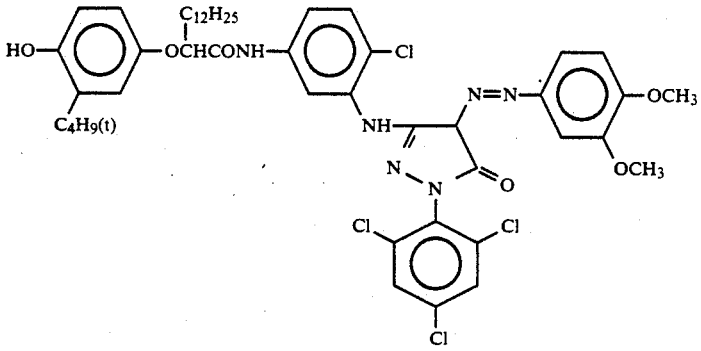

-continued
(9)
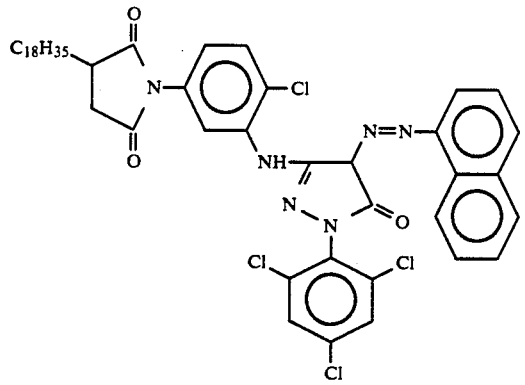
(10)
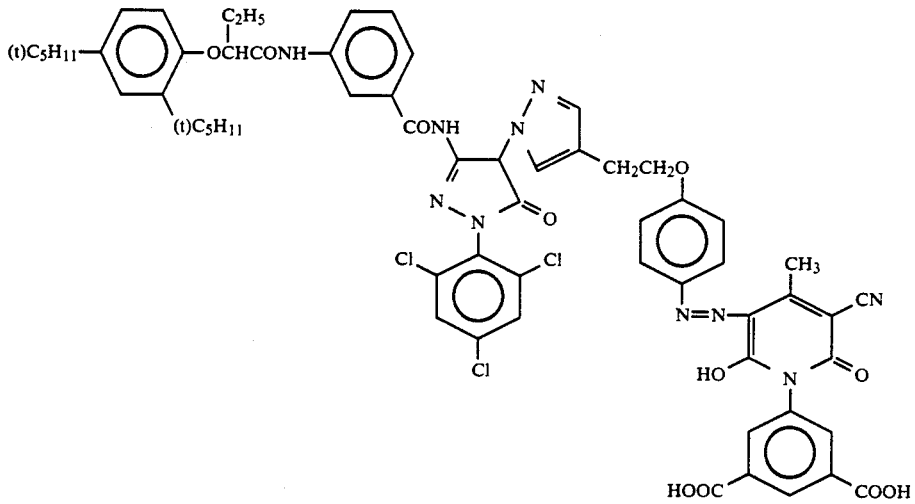
(11)
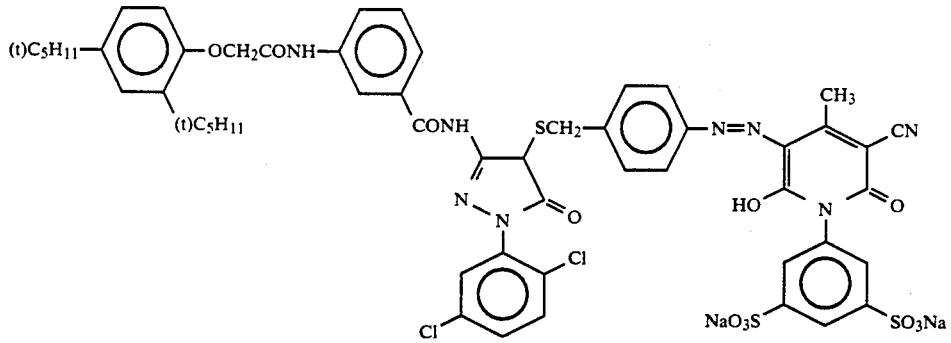
(12)
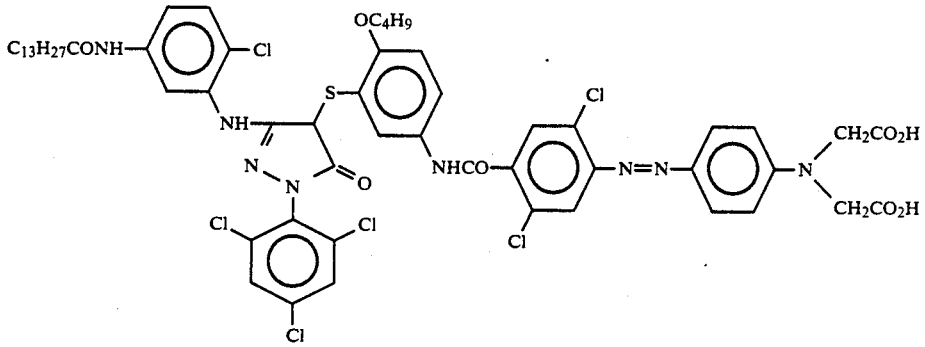

-continued
(13)
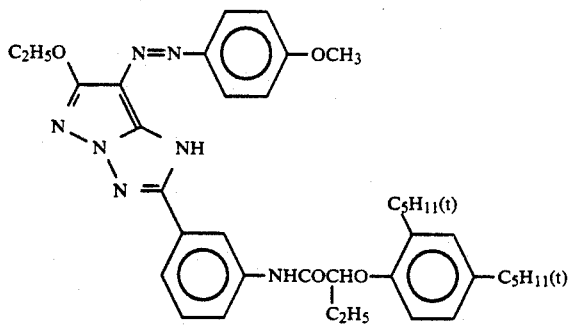
(14)
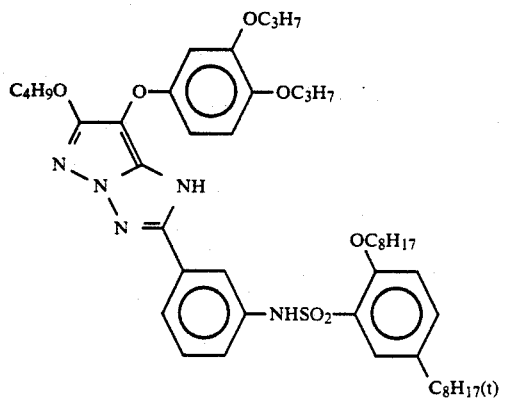
(15)
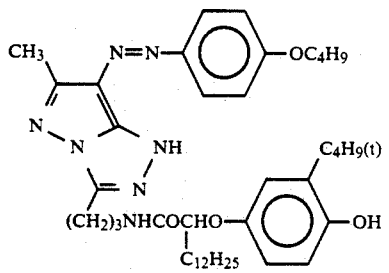
(16)
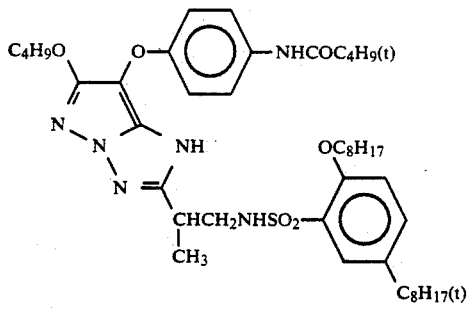
(17)
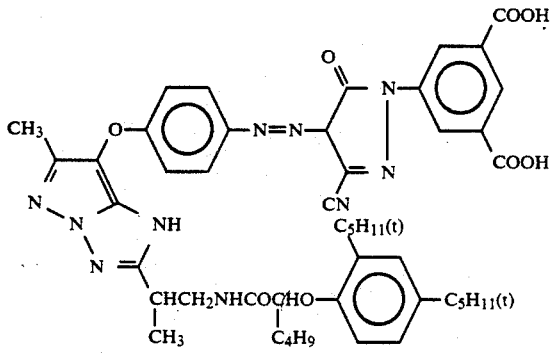

-continued (18)

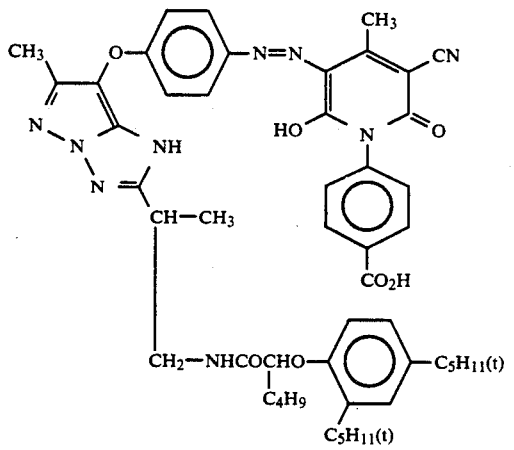

(19)

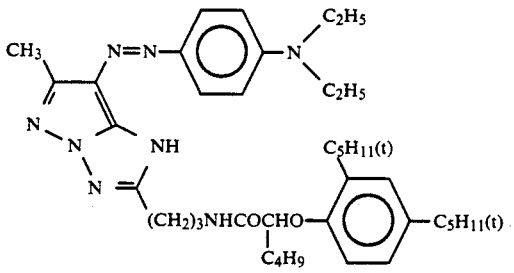

In a quite preferred embodiment of the present invention, a color negative film having a transparent magnetic recording layer of the present invention is applied to a pseudo telephoto zoom printing system proposed in U.S. Pat. Nos. 3,490,844, 4,583,831, 4,639,111 and 4,652,104, a pseudo telephoto zoom information in the photographing is input on the magnetic recording layer and enlarging the picture on the basis of the information to form a print of a varied magnification. In the pseudo telephoto zoom printing system, however, the prints are often formed from a color negative film having only a small effective negative area and, therefore, the sharpness of the color negative film is a quite important factor.

When the cyan coupler of the general formula [B] is used, the thickness of the red-sensitive layer can be reduced, since reduction in coloring property due to reduction in amount of the high-boiling organic solvent for dispersion is only slight. It is preferred, therefore, to incorporate the cyan coupler of the general formula [B] into the color negative film for a pseudo telephoto zoom print system, i.e., the color negative film having the transparent magnetic recording layer of the present invention.

Now, the detailed description will be made on cyan couplers of the following general formula [B]:

general formula [B]:

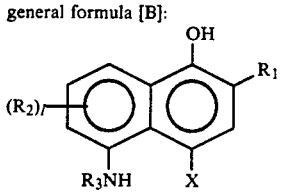

wherein $R_1$ represents $—CONR_4R_5$, $—SO_2NR_4R_5$, $—NHCOR_4$, $—NHCOOR_6$, $—NHSO_2R_6$, $—NHCONR_4R_5$ or $—NHSO_2NR_4R_5$, $R_2$ represents a possible substituent for the naphthalene ring, l represents an integer of 0 to 3, $R_3$ represents a substituent, and X represents a hydrogen atom or a group which can be split off by coupling reaction with an oxidation product of an aromatic primary amine developing agent; and $R_4$ and $R_5$ may be the same or different and each represent a hydrogen atom, alkyl group, aryl group or heterocyclic group, $R_5$ represents an alkyl group, aryl group or heterocyclic group, when l is 2 or more, $R_2$'s may be the same or different from one another or may be bonded together to form a ring, $R_2$ and $R_3$ or $R_3$ and X may be bonded together to form a ring, and $R_1$, $R_2$, $R_3$ or X may form a dimer or polymer by bonding through a divalent or a higher valent group.

The detailed description will be made on the substituents in the formula [B].

$R_1$ represents $—CONR_4R_5$, $—SO_2NR_4R_5$, $—NHCOR_4$, $—NHCOOR_6$, $—NHSO_2R_6$, $—NHCONR_4R_5$ or $—NHSO_2NR_4R_5$, $R_4$, $R_5$ and $R_6$ being each an alkyl group having a total carbon number of 1 to 30, an aryl group having a total carbon number of 6 to 30 or a heterocyclic group having a total carbon number of 2 to 30, or $R_4$ and $R_5$ may be a hydrogen atom.

$R_2$ represents a group (including an atom; the same shall apply hereinafter) which can be a substituent for the naphthalene ring. Typical examples of $R_2$ include halogen atoms (such as F, Cl, Br and I), or hydroxyl, carboxyl, amino group, sulfo, cyano, alkyl, aryl, heterocyclic, carbonamide, sulfonamide, carbamoyl, sulfamoyl, ureido, acyl, acyloxy, alkoxyl, aryloxy, alkylthio, arylthio, alkylsulfonyl, arylsulfonyl, sulfamoylamino, alkoxycarbonylamino, nitro and imide groups. When l is 2, $R_2$ is, for example, dioxymethylene or trimethylene group. $(R_2)_l$ has 0 to 30 carbon atoms.

$R_3$ represents a substituent which is preferably represented by the following formula [C-1]:

$$R_7(Y)_m \qquad \text{Formula [C-1]}$$

wherein Y represents <NH, <CO or $<SO_2$, m represents an integer of 0 or 1, $R_7$ represents a hydrogen atom, an alkyl group having 1 to 30 carbon atoms, aryl group having 6 to 30 carbon atoms, heterocyclic group having 2 to 30 carbon atoms, $—COR_8$, $—NR_8(R_9)$, $—CONR_8(R_9)$, $—OR_{10}$,

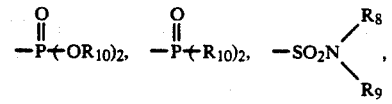

$—CO_2R_{10}$, $—CO—SR_{10}$, $—SO_2OR_{10}$ or $—SO_2R_{10}$; $R_8$, $R_9$ and $R_{10}$ being the same as the above-described $R_4$, $R_5$ and $R_6$, respectively.

$R_4$ and $R_5$ of $—N(R_4)R_5$ and $R_8$ and $R_9$ of $—N(R_8)R_9$ in $R_1$ or $R_7$ may be bonded together to form a nitrogen containing heterocyclic ring (such as pyrrolidine ring, piperidine ring or morpholine ring).

X represents a hydrogen atom or a group which can be split off by the coupling reaction with the oxidation product of the aromatic primary amine developing agent (hereinafter referred to as coupling-off group; it includes a coupling-off atom). Typical examples of the coupling-off groups include halogen atoms, $—OR_{11}$, $—SR_{11}$, $—OCOR_{12}$, $—NHCOR_{11}$, $—NHCOSR_{11}$, $—OCOOR_{11}$, $—OCONHR_{11}$, thiocyanato group, and heterocyclic groups having 1 to 30 carbon atoms which are bonded at a coupling-active position (such as succinimide group, phthalimide group, pyrazolyl group, hydantoinyl group and 2-benzotriazolyl group). $R_{11}$ has the same meaning as that of $R_6$.

The alkyl groups described above may be straight chain, branched or cyclic alkyl groups and they may have an unsaturated bond or a substituent (such as a halogen atom, hydroxyl group, aryl group, heterocyclic group, alkoxyl group, aryloxy group, alkylsulfonyl group, arylsulfonyl group, alkoxycarbonyl group, acyloxy group or acyl group). Typical examples of these alkyl groups include methyl, isopropyl, isobutyl, t-butyl, 2-ethylhexyl, cyclohexyl, n-dodecyl, n-hexadecyl, 2-methoxyethyl, benzyl, trifluoromethyl, 3-dodecyloxypropyl and 3-(2,4-di-t-pentylphenoxy)propyl groups.

The aryl groups may be in the form of a condensed ring (such as naphthyl group) or have a substituent (such as a halogen atom, alkyl group, aryl group, alkoxyl group, aryloxy group, cyano group, acyl group, alkoxycarbonyl group, carbonamide group, sulfonamide group, carbamoyl group, sulfamoyl group, alkylsulfonyl group or arylsulfonyl group). Typical examples of them include phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl and 4-t-butylphenyl groups.

The heterocyclic groups are 3- to 8-membered, monocyclic or condensed cyclic group having at least one hetero atom such as O, N, S, P, Se or Te in the ring and they may have a substituent (such as a halogen atom, carboxyl group, hydroxyl group, nitro group, alkyl group, aryl group, alkoxyl group, aryloxy group, alkoxycarbonyl group, aryloxycarbonyl group, amino group, carbamoyl group, sulfamoyl group, alkylsulfonyl group or arylsulfonyl group). Typical examples of them include 2-pyridyl, 4-pyridyl, 2-furyl, 4-thienyl, benzotriazol-1-yl, 5-phenyltetrazol-1-yl, 5-methylthio-1,3,4-thiadiazol-2-yl and 5-methyl-1,3,4-oxadiazol-2-yl.

The description will be made on preferred examples of the substituents in the present invention.

$R_1$ is preferably $—CONR_4R_4$ or $—SO_2NR_4R_5$. Examples of $R_1$ include carbamoyl, N-n-butylcarbamoyl, N-n-dodecylcarbamoyl, N (3 n-dodecyloxypropyl)carbamoyl, N-cyclohexylcarbamoyl, N-[3-(2,4-di-t-pentylphenoxy)propyl]carbamoyl, N-hexadecylcarbamoyl, N-[4-(2,3-di-t-pentylphenoxy)butyl]carbamoyl, N-(3-dodecyloxy-2-methylpropyl) carbamoyl, N-[3-(4-t-octylphenoxyl)propyl]carbamoyl, N-hexadecyl N-methylcarbamoyl, N-(3-dodecyloxypropyl)sulfamoyl and N [4-(2,4-di-t-pentylphenoxy)butyl]sulfamoyl groups. $R_1$ is particularly preferably $—CONR_4R_5$.

l is preferably 1 and is most preferably 0 (namely, the compound is preferably unsubstituted). $R_2$ is preferably a halogen atom, alkyl group (such as methyl, isopropyl, t-butyl or cyclopentyl group), carbonamide group (such as acetamide, pivalinamide, trifluoroacetamide or benzamide group), sulfonamide group (such as methanesulfonamide or toluenesulfonamide group) or cyano group.

$R_3$ is preferably that of the formula [C 1] wherein m represents 0 and $R_7$ preferably represents $—COR_8$ [such as formyl, acetyl, trifluoroacetyl, 2-ethylhexanoyl, pivaloyl, benzoyl, pentafluorobenzoyl or 4-(2,4-di-t-pentylphenoxy)butanoyl], $—COOR_{10}$ [such as methoxycarbonyl, ethoxycarbonyl, isobutoxycarbonyl, 2-ethylhexyloxycarbonyl, n-dodecyloxycarbonyl or 2-methoxyethoxycarbonyl] or $—SO_2R_{10}$ [such as methylsulfonyl, n-butylsulfonyl, n-hexadecylsulfonyl, phenylsulfonyl, p-tolylsulfonyl, p-chlorophenylsulfonyl or trifluoromethylsulfonyl]. $R_7$ is particularly preferably $—COOR_{10}$.

X is preferably a hydrogen atom, halogen atom, $—OR_{11}$ [such as an alkoxyl group, e.g. ethoxy, 2-hydroxyethoxy, 2-methoxyethoxy, 2 (2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-carboxytridecyloxy, 2-methanesulfonamidethoxy, 2-(carboxymethylthio)ethoxy or 2-(1-carboxytridecylthio)ethoxy group; or an aryloxy group, e.g. 4-cyanophenoxy, 4-carboxyphenoxy, 4-methoxyphenoxy, 4-t-octylphenoxy, 4-nitrophenoxy, 4-(3-carboxypropanamido)phenoxy or 4-acetamidophenoxy group] or $—SR_{11}$ [such as an alkylthio group, e.g. carboxymethylthio, 2-carboxymethylthio, 2-methoxyethylthio, ethoxycarbonylmethylthio, 2,3-dihydroxypropylthio or 2-(N,N-dimethylamino)ethylthio group; or an arylthio group such as 4-carboxyphenylthio, 4-methoxyphenylthio or 4-(3-carboxypropanamido) phenylthio group]. X is particularly preferably a hydrogen atom, chlorine atom, alkoxyl group or alkylthio group.

The molecules of the coupler of the general formula [B] may be bonded together through a divalent or polyvalent group at substituent $R_1$, $R_2$, $R_3$ or X to form a dimer or polymer. In such a case, the number of carbon atoms may be over the above-described range.

When the coupler of the general formula [B] forms the polymer, typical examples of the polymer include homopolymers or copolymers of an addition-polymerizable ethylenically unsaturated compounds (cyan coupling monomers) having a cyan dye-forming coupler residue. Preferred examples of them are those of the following formula [B-2]:

$$-(GI)_{gi}-(Hj)_{hj}- \qquad \text{Formula [B-2]}$$

wherein $G_i$ represents a recurring unit represented by the formula [B-3] which is derived from the coupling monomer, $H_j$ represents a recurring unit derived from a non-coupling monomer, i represents a positive integer, j represents 0 or a positive integer, gi and hi represent the relative amounts (by weight) of Gi and Hj, respectively, and when i or j is 2 or more, Gi or Hi contains two or more kinds of recurring units.

formula [B-3]:

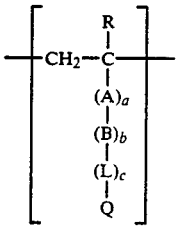

wherein R represents a hydrogen atom, alkyl group having 1 to 4 carbon atoms or chlorine atom, A represents —CONH—, —COO— or substituted or unsubstituted phenylene group, B represents a divalent group having a carbon atom at both ends such as a substituted or unsubstituted alkylene group, phenylene group or oxydialkylene group, L represents —CONH—, —NHCONH—, —NHCOO—, —NHCO—, —OCNH—, —NH—, —COO—, —OCO—, —CO—, —O—, $—SO_2—$, $—NHSO_2—$ or $—SO_2NH—$, a, b and c each represent an integer of 0 or 1, Q represents a cyan coupler residue formed by removing a hydrogen atom from $R_1$, $R_2$, $R_3$ or X of the compound of the general formula [B].

Examples of the non-coloring ethylenic monomers which do not couple with the oxidation product of the aromatic primary amine developing agent forming the recurring unit Hj include acrylic acid, α-chloroacrylic acid, α-alkylacrylic acids (such as methacrylic acid), amides and esters derived from the acrylic acids (such as acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (such as vinyl acetate, vinyl propionate and vinyl laurate), acrylonitrile, methacrylonitrile, aromatic vinyl compounds (such as styrene and derivatives thereof, e.g. vinyltoluene, divinylbenzene, vinylacetophenone and sulfostyrene), itaconic acid, citraconic acid, crotonic acid, vinylidene chloride, vinyl alkyl ethers (such as vinyl ethyl ether), maleic acid esters, N-vinyl-2-pyrrolidone, N-vinylpyridine and 2- and 4-vinylpyridine.

Among them, the acrylic esters, methacrylic esters and maleic esters are particularly preferred. The non-coloring ethylenic monomers can be used either singly or in combination of two or more of them. The combinations are: methyl acrylate/butyl acrylate, butyl acrylate/styrene, butyl methacrylate/methacrylic acid, and methyl acrylate/diacetone acrylamide.

It is well known in the field of polymer couplers that the ethylenically unsaturated monomers to be copolymerized with the vinyl monomers of the above formula [B-3] can be selected so that they exert good influences on the form (such as solid, liquid or micelle), physical properties and/or chemical properties (such as solubility in water or an organic solvent), compatibility with a binder (such as gelatin) of the photographic colloid composition, flexibility thereof, thermal stability, coupling reactivity with the oxidation product of the developing agent and non-diffusibility. These copolymers may be random copolymers or those having a specified sequence (such as block copolymers or alternating copolymers).

The number-average molecular weight of the cyan polymer couplers used in the present invention usually ranges from several thousands to several millions. Oligomer couplers having a number-average molecular weight of less than 5000 can also be used.

The cyan polymer couplers used in the present invention may be lipophilic polymers soluble in organic solvents (such as ethyl acetate, butyl acetate, ethanol, methylene chloride, cyclohexanone, dibutyl phthalate and tricresyl phosphate); hydrophilic polymers miscible in a hydrophilic colloid such as an aqueous gelatin solution; or polymers having a structure and properties capable of forming a micelle in the hydrophilic colloid.

To obtain a lipophilic polymer coupler soluble in the organic solvent, it is preferred to select a lipophilic, non-coloring ethylenic monomer (such as an acrylic ester, methacrylic ester, maleic ester or vinylbenzene) as the copolymerizable component.

A solution of a lipophilic polymer coupler obtained by polymerization of a vinyl monomer capable of forming a coupler unit of the above general formula [B-3] in an organic solvent can be prepared by emulsion dispersion in an aqueous gelatin solution to form a latex or it can be prepared directly by emulsion polymerization.

A process for the emulsion dispersion of the lipophilic polyer coupler in the aqueous gelatin solution to form a latex is described in U.S. Pat. No. 3,451,820. The emulsion polymerization is described in U.S. Pat. Nos. 4,080,211 and 3,370,952.

To prepare a neutral or alkaline, water-soluble hydrophilic polymer coupler, it is preferred to use, as a comonomer, a hydrophilic non-coloring ethylenic monomer such as N-(1,1-dimethyl-2 sulfonatoethyl)acrylamide, 3-sulfonatopropyl acrylate, sodium styrenesulfonate, potassium styrenesulfonate, acrylamide, methacrylamide, acrylic acid, methacrylic acid, N-vinylpyrrolidone or N-vinylpyridine.

The hydrophilic polymer coupler in the form of an aqueous solution thereof can be added to the coating solution. Further, it can be added in the form of a solution in a solvent mixture of water and an organic solvent miscible with water such as a lower alcohol, tetrahydrofuran, acetone, ethyl acetate, cyclohexanone, ethyl lactate, dimethylformamide or dimethylacetamide. In addition, it can be added in the form of a solution in an aqueous alkali solution or an organic solvent containing an aqueous alkali solution. A small amount of a surfactant can be incorporated thereinto.

Examples of the substituents of the cyan couplers of the formula [B] and the cyan couplers per se will be given below:

Examples of $R_1$ :

$-CONH(CH_2)_3O-A$ $-CONH(CH_2)_4O-A$ $-CONH(CH_2)_3OC_{12}H_{25}$-n $-CONH(CH_2)_3OC_{10}H_{21}$-n $-CONH(CH_2)_3OCH_2CH(C_2H_5)C_4H_9$-n $-CONHC_{16}H_{33}$-n $-CONHCH_2CH(CH_3)CH_2C_{12}H_{25}$-n $-CONH(CH_2CH_2O)_2C_{12}H_{25}$-n $-CONHCH_2CH_2OC_{12}H_{25}$-n

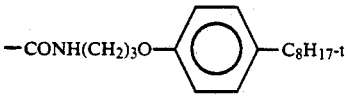

$-CONHCH_2CH(C_6H_{13})C_8H_{17}$-n

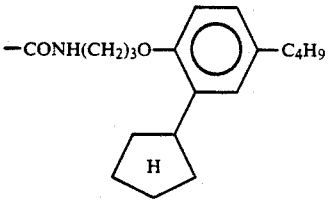

$-CONHC_4H_9$-n

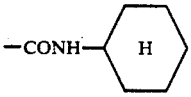

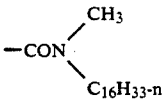

$-CONH(CH_2)_3OC_{14}H_{29}$-n $-CONH(CH_2)_3OC_{11}H_{23}$-n $-SO_2NH(CH_2)_3OC_{12}H_{25}$-n

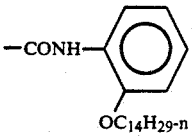

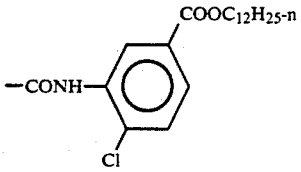

-continued

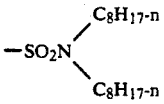

$-NHCO(CH_2)_3O-A$

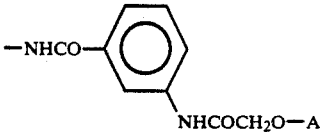

$-NHSO_2C_{16}H_{33}$-n

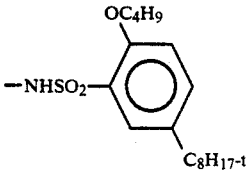

$-NHCOOC_{12}H_{25}$-n

Examples of $R_2$ :

$-F$ $-Cl$ $-CN$ $-CH_3$ $-CF_3$ $-C_4H_9$-t $-C_8H_{17}$-t $-NHCOCH_3$ $-NHSO_2CH_3$ $-NHCOOC_2H_5$

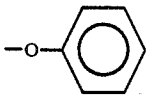

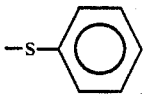

$-OC_8H_{17}$-n

Examples of $R_3NH-$:

$-NHCOCH_3$ $-NHCOCF_3$

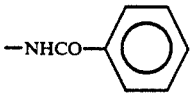

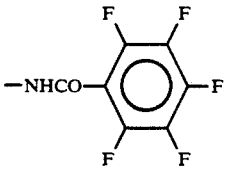

$-NHCOC_4H_9$-t $-NHCO(CH_2)_3O-A$

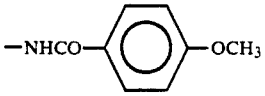

-continued
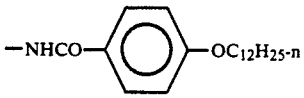
$-NHSO_2CH_3$
$-NHSO_2CF_3$
$-NHSO_2C_4H_{9}$-n
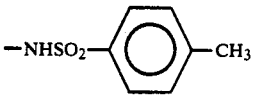
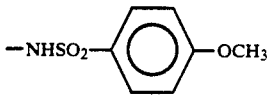
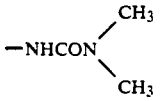
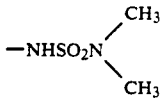
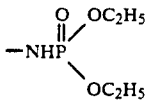
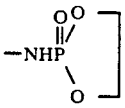
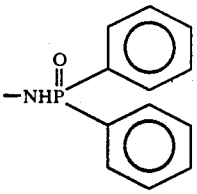
$-NHCOOCH_3$
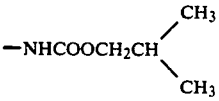
$-NHCOOC_4H_{9}$-n
$-NHCOOCH_2CH_2OCH_3$
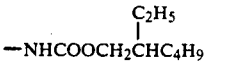
$-NHCOOC_{12}H_{25}$-n
$-NHCOOCH_2CH_2O-A$
-continued
$-NHCOCOCH_3$
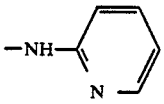
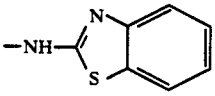
Examples of X:
$-OC_2H_5$
$-OCH_2CH_2OH$
$-OCH_2CH_2SO_2CH_3$
$-O(CH_2CH_2O)_2H$
$-OCH_2COOH$
$-O(CH_2)_3COOH$
$-OCH_2COOC_2H_5$
$-OCH_2CONHCH_2CH_2OCH_3$
$-OCH_2CH_2SCH_2COOH$
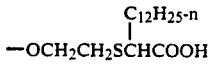
$-OCH_2CH_2OCH_3$
$-OCH_2CH_2NHSO_2CH_3$
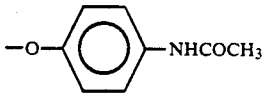
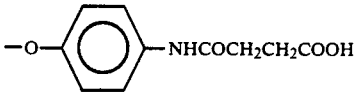
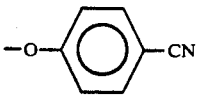
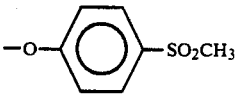
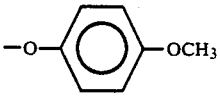
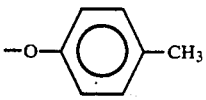
$-SCH_2COOH$
$-SCH_2CH_2COOH$ -continued

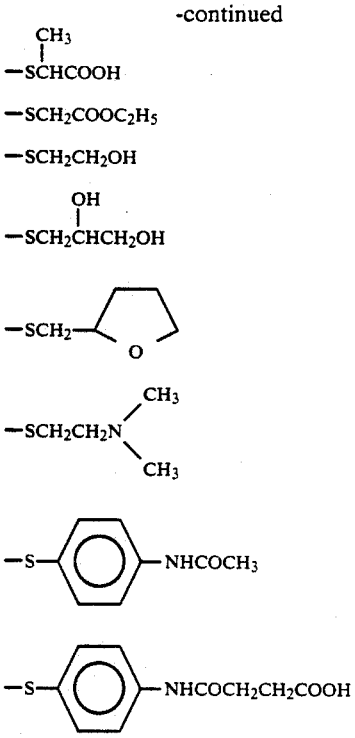

-continued

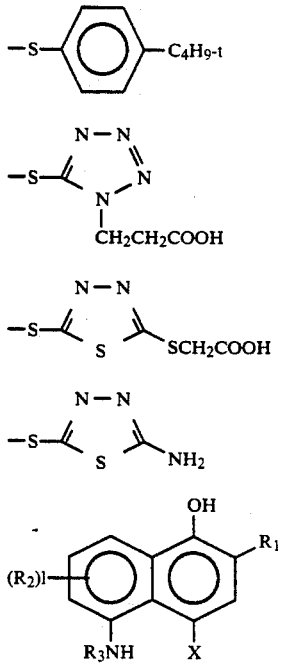

Couplers of the above formula wherein l is 0 (zero):

| No. | $R_1$ | $R_3$ | X |
|---|---|---|---|
| C-1 | $-CONH(CH_2)_3O-A$ | $CH_3CO-$ | H |
| C-2 | $-CONH(CH_2)_3O-A$ | $CF_3CO-$ | H |
| C-3 | $-CONH(CH_2)_3O-A$ | $CH_3SO_2-$ | H |
| C-4 | $-CONH(CH_2)_3O-A$ | $C_2H_5OCO-$ | H |
| C-5 | $-CONH(CH_2)_4O-A$ | $t\text{-}C_4H_9CO-$ | H |
| C-6 | $-CONH(CH_2)_3O-C_{12}H_{25}\text{-}n$ | $C_2H_5OCO-$ | H |
| C-7 | $-CONH(CH_2)_3O-C_{12}H_{25}\text{-}n$ | $i\text{-}C_4H_9OCO-$ | H |
| C-8 | $-CONH(CH_2)_3OC_{10}H_{21}\text{-}n$ | $i\text{-}C_4H_9OCO-$ | H |
| C-9 | $-CONH(CH_2)_3OC_{10}H_{21}\text{-}n$ | $n\text{-}C_4H_9CH(C_2H_5)CH_2OCO-$ | H |
| C-10 | $-CONH(CH_2)_3O-A$ | $i\text{-}C_4H_9OCO-$ | H |
| C-11 | $-CONH(CH_2)_3O-C_6H_4-C_8H_{17}\text{-}t$ | $i\text{-}C_4H_9OCO-$ | H |
| C-12 | $-CONHCH_2CH(CH_3)CH_2OC_{12}H_{25}\text{-}n$ | $i\text{-}C_4H_9OCO-$ | H |
| C-13 | $-CONH(CH_2)_3OCH_2CH(C_2H_5)C_4H_9$ | $n\text{-}C_8H_{17}OCO-$ | H |
| C-14 | $-CONH(CH_2)_3O-C_6H_4-C_8H_{17}\text{-}t$ | $n\text{-}C_4H_9SO_2-$ | H |
| C-15 | $-CONH(CH_2)_3OC_{12}H_{25}\text{-}n$ | $(C_2H_5O)_2P(=O)-$ | H |
| C-16 | $-CONH(CH_2)_3O-A$ | 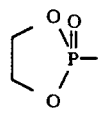 | H |

-continued

| No. | $R_1$ | $R_3$ | X |
|---|---|---|---|
| C-17 | $-CONHCH_2CH_2OC_{12}H_{25}$-n | i-$C_4H_9OCO-$ | H |
| C-18 | $-CON(CH_3)(C_{16}H_{33}$-n) | $C_2H_5OCO-$ | H |
| C-19 | $-CONHCH_2CH_2OCOC_{11}H_{23}$-n | i-$C_4H_9OCO-$ | H |
| C-20 | $-CONHC_{12}H_{25}$-n | n-$C_4H_9CH(CH_3)CH_2OCO-$ | H |
| C-21 | $-SO_2NH(CH_2)_3OC_{12}H_{25}$-n | i-$C_4H_9OCO-$ | H |
| C-22 | $-SO_2N(CH_3)(C_{18}H_{37}$-n) | $C_2H_5OCO-$ | H |
| C-23 | $-CONHCH_2CH(C_6H_{13}$-n$)C_8H_{17}$-n | i-$C_4H_9OCO-$ | H |
| C-24 | $-CONH(CH_3)_3OC_{12}H_{25}$-n | 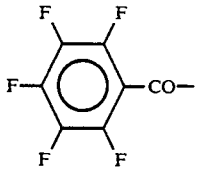 | H |
| C-25 | 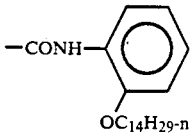 | $CH_3SO_2-$ | H |
| C-26 | 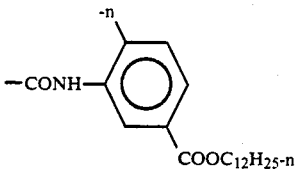 | 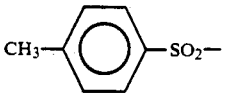 | H |
| C-27 | $-CONH(CH_2)_3OC_{12}H_{25}$-n | i-$C_4H_9OCO-$ | Cl |
| C-28 | $-CONH(CH_2)_3OC_{12}H_{25}$-n | n-$C_4H_9OCO-$ | Cl |
| C-29 | $-CONH(CH_2)_3OC_{14}H_{29}$-n | i-$C_4H_9CO-$ | Cl |
| C-30 | $-CONH(CH_2)_3OC_{12}H_{25}$-n | i-$C_4H_9OCO-$ | $-OCH_2CH_2OH$ |
| C-32 | $-CONH(CH_2)_3OC_{12}H_{25}$-n | i-$C_4H_9OCO-$ | $-O(CH_2CH_2O)_2H$ |
| C-33 | $-CONH(CH_2)_3OC_{12}H_{25}$-n | i-$C_4H_9OCO-$ | $-OCH_2CH_2OCH_3$ |
| C-34 | $-CONH(CH_2)_3OC_{12}H_{25}$-n | i-$C_4H_9OCO-$ | $-OCH_2CH_2SCH_2COO$ |
| C-35 | $-CONHC_4H_9$-n | i-$C_4H_9OCO-$ | $-OCH_2CH_2S(COOH)CH_{12}H_{25}$-n |
| C-36 | $-CONHCH_2CH(CH_3)CH_2OC_{12}H_{25}$-n | i-$C_4H_9OCO-$ | $-O(CH_2)_3COOH$ |
| C-37 | $-CONH(CH_2)_4O-A$ | i-$C_4H_9OCO-$ | 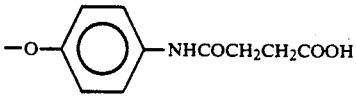 |
| C-38 | $-CONH(CH_2)_3O-A$ | i-$C_4H_9OCO-$ | 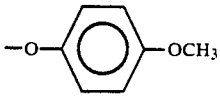 |

-continued

| No. | $R_1$ | $R_3$ | X |
|---|---|---|---|
| C-39 | 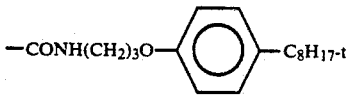 | i-$C_4H_9OCO$— | —$SCH_2COOH$ |
| C-40 | —$CONH(CH_2)_3OC_{12}H_{25}$-n | i-$C_4H_9OCO$— | —$SCH_2CH_2COOH$ |
| C-41 | —$CONH(CH_2)_3OC_{12}H_{25}$-n | i-$C_4H_9OCO$— | —$SCH_2CH_2OH$ |
| C-42 | —$CONH(CH_2)_4O$—A | $CH_3SO_2$— | 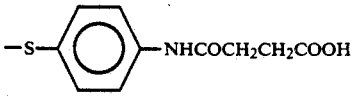 |
| C-43 | —$SO_2NH(CH_2)_3O$—A | n-$C_4H_9SO_2$— | —$OCH_2CH_2OH$ |
| C-44 | —$CONHCH_2CH(CH_3)CH_2OC_{12}H_{25}$-n | i-$C_4H_9OCO$— | —$OCH_2CH_2OH$ |
| C-45 | —$CONH(CH_2CH_2O)C_{12}H_{25}$-n | $(C_2H_5O)_2P(=O)$— | —$OCH_2CH_2OCH_3$ |
| C-46 | —$CONH(CH_2)_4O$—A | t-$C_4H_9CO$— | —$OCH_2COOC_2H_5$ |

Other couplers:

C-47

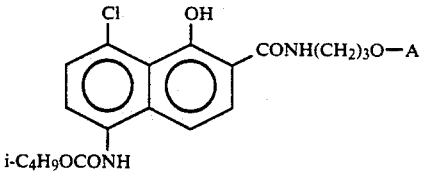

C-48

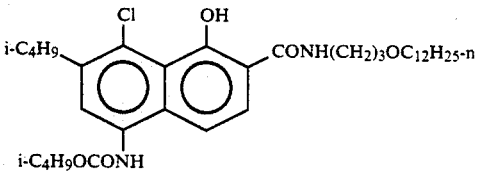

C-49

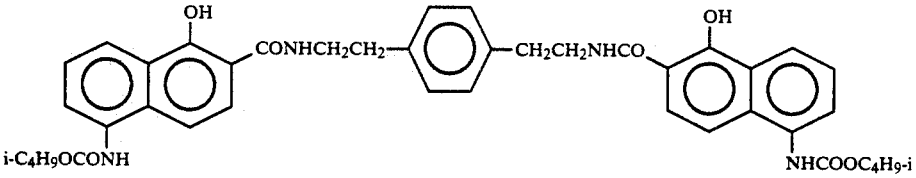

C-50:

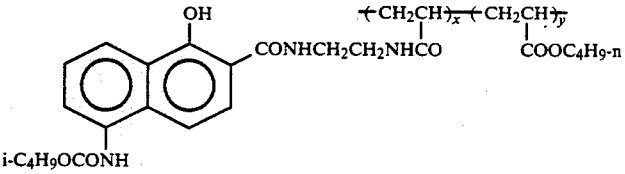

x:y = 60:40 (weight ratio)
number-average molecular weight: about 60,000

C-51:

-continued

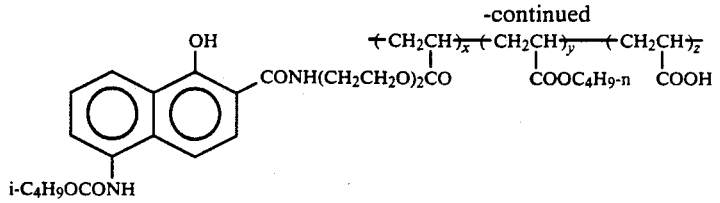

x:y:z = 50:40:10
number-average molecular weight: about 50,000

C-52:

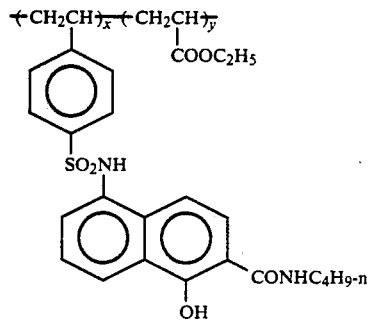

x:y = 70:30 (weight ratio)
number-average molecular weight: about 55,000 where A represents

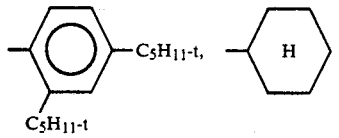

represents a cyclohexyl group,

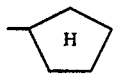

represents a cyclopentyl group, and —$C_8H_{17}$—t represents

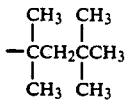

Other examples of the cyan couplers represented by the formula [B] and/or process for producing them are described in, for example, U.S. Pat. No. 4,690,889, J. P. KOKAI Nos. 60-237448, 61-153640, 61-145557, 63-208042 and 64-31159 and West German Patent No. 3823049A. The cyan coupler of the formula [B] is preferably used in combination with a small amount of a high boiling organic solvent for dispersion in order to further improve the sharpness and desilverizability as described in J. P. KOKAI No. 62-269958.

In particular, the weight ratio of the high-boiling organic solvent to the cyan coupler represented by the formula [B] is 0.3 or less, preferably 0.1 or less.

The total amount of the cyan coupler(s) of the formula [B] is at least 30 molar %, preferably at least 50 molar %, more preferably at least 70 molar % and particularly at least 90 molar % based on the total cyan couplers.

The cyan couplers of the formula [B] are preferably used in combination of two or more of them. When there are two or more layers sensitive to the same color but having different degrees of sensitivity, it is preferred to use a 2-equivalent cyan coupler for the layer of the highest sensitivity and a 4-equivalent cyan coupler for the layer of the lowest sensitivity. One of them or both of them are preferably incorporated into other layers sensitive to the same color.

Examples of the high-boiling organic solvents usable in combination with the couplers of the general formulae [A] and [B] include phosphoric esters (such as triphenyl phosphate, tricresyl phosphate, octyldiphenyl phosphate, tri-2-ethylhexyl phosphate, tri-n-hexyl phosphate, tri-isononyl phosphate, tricyclohexyl phosphate, tributoxyethyl phosphate and tri-2-chloroethyl phosphate), benzoic esters (such as 2-ethylhexyl benzoate and 2-ethylhexyl 2,4-dichlorobenzoate), fatty acid esters (such as di-2-ethylhexyl succinate, 2-hexyldecyl tetradecanoate and tributyl citrate), amides (such as N,N-diethyldodecanamide and N-tetradecylpyrrolidone), dialkylanilines (such as 2-butoxy-5-tert-octyl-N,N-dibutylaniline), chlorinated paraffins (such as paraffins having a chlorine content of 10 to 80%), phenols (such as 2,5-di-tert-amylphenol, 2,5-di-tert-hexyl-4-methoxyphenol and 2-ethylhexyl p-hydroxybenzoate), phthalic esters (such as dibutyl phthalate, dicyclohexyl phthalate, diheptyl phthalate, di-2-ethylhexyl phthalate and didodecyl phthalate). Among them, the phosphoric esters and phthalic esters are particularly preferred.

When the coupler of the general formula [B] is colored, the dye has usually a subabsorption in a blue light resion. It is preferred, therefore, to use it in combination with a yellow colored magenta coupler of the general formula [B] for compensation. The effect of the incorporation of the magenta coupler of the general formula [A] of the present invention becomes more remarkable when the yellow colored cyan coupler is incorporated into a color negative film having a transparent magnetic recording layer, since the light absorption in the blue light region is further increased thereby.

Thus by using the combination of the coupler of the general formula [A] with the coupler of the general formula [B] and yellow-colored coupler, a pseudo telephoto zoom print having excellent sharpness and color reproduction can be formed while prolongation of the printing time is inhibited.

The description will be made in detail on the yellow-colored cyan couplers.

The preferred yellow-colored cyan couplers are represented by the following general formulae (CI) to (CIV):

General formula (C I):

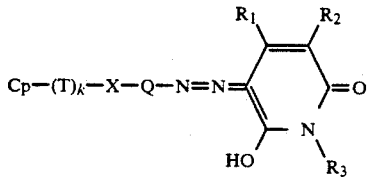

General formula (C II):

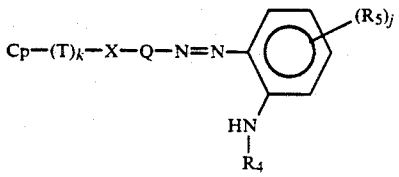

General formula (C III):

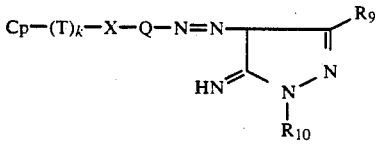

General formula (C IV):

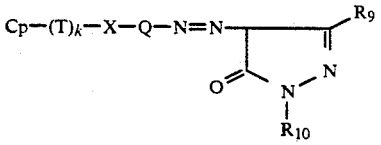

In the general formulae (CI) to (CIV), Cp represents a cyan coupler residue (T being bonded at the coupling position), T represents a timing group, k represents 0 or an integer of 1, X represents a divalent connecting group containing N, O or S, bonded with $(T)_k$ and connecting with Q, and Q represents an arylene group or divalent heterocyclic group.

In the general formula (CI), $R_1$ and $R_2$ each represent a hydrogen atom or a carboxyl, sulfo, cyano, alkyl, cycloalkyl, aryl, heterocyclic, carbamoyl, sulfamoyl, carbonamide, sulfonamide or alkylsulfonyl group, $R_3$ represents a hydrogen atom or an alkyl, cyaloalkyl, aryl or heterocyclic group, with the proviso that at least one of T, X, Q, $R_1$, $R_2$ and $R_3$ has a water-solubilizing group (such as hydroxyl, carboxyl, sulfo, amino, ammoniumyl, phosphono, phosphino or hydroxysulfonyloxy group).

It is well known that

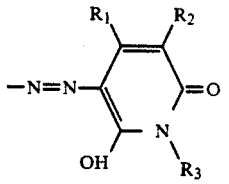

in the general formula (CI) can have the following tautomer structures, which are included by the structures defined in the general formula (CI) of the present invention:

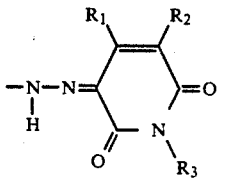

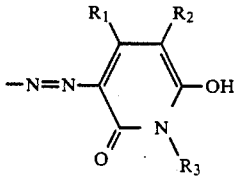

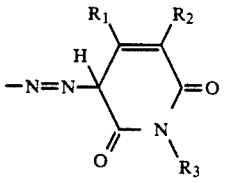

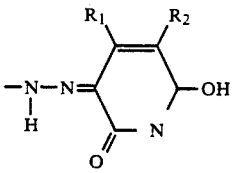

(wherein $R_3$ represents a hydrogen atom)

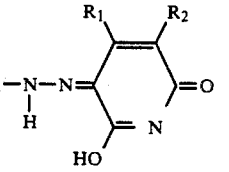

(wherein $R_3$ represents a hydrogen atom)

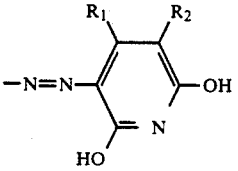

(wherein $R_3$ represents a hydrogen atom)

-continued

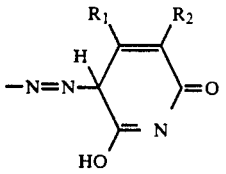

(wherein $R_3$ represents hydrogen atom)

In the general formula (CII), $R_4$ represents an acyl or sulfonyl group, $R_5$ represents a group which can be substituted and j represents an integer of 0 to 4, when j is an integer of 2 or more, $R_4$'s may be the same or different from one another, with the proviso that at least one of T, X, Q, $R_4$ and $R_5$ has a water-solubilizing group (such as hydroxyl, carboxyl, sulfo, phosphono, phosphino, hydroxysulfonyloxy, amino or ammoniumyl group).

In the general formulae (CIII) and (CIV), $R_9$ represents a hydrogen atom or a carboxyl, sulfo, cyano, alkyl, cycloalkyl, aryl, alkoxyl, cycloalkyloxy, aryloxy, heterocyclic, carbamoyl, sulfamoyl, carbonamide, sulfonamide or alkylsulfonyl group, and $R_{10}$ represents a hydrogen atom or an alkyl, cycloalkyl, aryl or heterocyclic group, with the proviso that at least one of T, X, Q, $R_9$ and $R_{10}$ has a water-solubilizing group (such as hydroxyl, carboxyl, sulfo, phosphono, phosphino, hydroxysulfonyloxy, amino or ammoniumyl group).

Groups

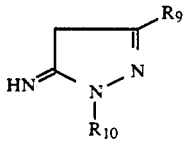

and

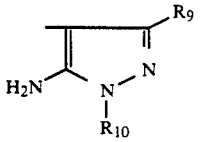

are tautomers.

Detailed description will be made on the compounds of the general formulae (CI) through (CIV).

The coupler residues represented by Cp include known cyan coupler residues (such as phenolic and naphtholic residues).

Preferred examples of Cp include coupler residues represented by the following general formulae (Cp-6), (Cp-7) and (Cp-8):

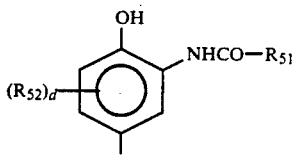

general formula (Cp-6)

-continued

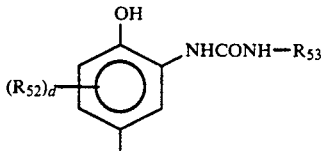

general formula (Cp-7)

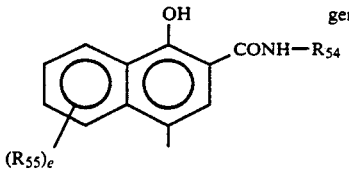

general formula (Cp-8)

The free bond at the coupling position in the above formula indicates the bonding position of the coupling-off group.

When $R_{51}$, $R_{52}$, $R_{53}$, $R_{54}$ or $R_{55}$ in the above formula has a nondiffusible group, the total carbon atom thereof is selected in the range of 8 to 40, preferably 10 to 30 and, in other cases, the number of the total carbons is preferably 15 or less. In the bis-, telomer- or polymer-type coupler, any of the above-described substituents is a divalent group to connect recurring units or the like. In this case, the number of the carbon atoms is not particularly limited.

In the following formulae, $R_{41}$ represents an aliphatic group, aromatic group or heterocyclic group, $R_{42}$ represents an aromatic group or heterocyclic group, $R_{43}$, $R_{44}$ and $R_{45}$ each represent a hydrogen atom or an aliphatic group, aromatic group or heterocyclic group.

The detailed description will be made on $R_{51}$, $R_{52}$, $R_{53}$, $R_{55}$, $R_{55}$, d and e.

$R_{51}$ has the same meaning as that of $R_{42}$. $R_{52}$ has the same meaning as that of $R_{41}$ or it represents $R_{41}CONR_{43}$—, $R_{41}OCONR_{43}$—, $R_{41}SO_2NR_{43}$—, $R_{43}NR_{44}CONR_{45}$—, $R_{41}O$— or $R_{41}S$—, a halogen atom or $R_{41}NR_{43}$—group. d represents 0 to 3. When plural d's are present, the substituents $R_{52}$'s may be either the same or different from each other. $R_{52}$'s may be each a divalent group to connect with each other to form a cyclic structure. Typical examples of the divalent groups for forming the cyclic structure include the following groups:

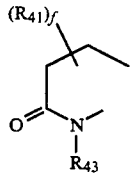

and

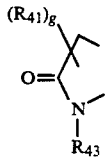

wherein f represents an integer of 0 to 4, g represents an integer of 0 to 2, $R_{53}$ and $R_{54}$ has the same meaning as that of $R_{41}$, and $R_{55}$ has the same meaning as that of $R_{41}$ or it represents $R_{41}OCONH$—, $R_{41}SO_2NH$—, $R_{43}NR_{44}CONR_{45}$—, $R_{43}NR_{44}SO_2NR_{45}$—, $R_{43}O$—or $R_{41}S$— group or a halogen atom or $R_{41}NR_{43}$— group. When two or more $R_{55}$'s are present, they may be either the same or different from each other.

The term 'aliphatic groups' described above indicates substituted or unsubstituted, saturated or unsaturated, cyclic, straight chain or branched, aliphatic hydrocarbon groups having 1 to 32 carbon atoms, preferably 1 to 22 carbon atoms. Typical examples of them include methyl, ethyl, propyl, isopropyl, butyl, t-butyl, i-butyl, t-amino, hexyl, cyclohexyl, 2-ethylhexyl, octyl, 1,1,3,3-tetramethylbutyl, decyl, dodecyl, hexadecyl and octadecyl groups.

Preferred examples of the aromatic groups include substituted or unsubstituted phenyl and substituted or unsubstituted naphthyl groups having 6 to 20 carbon atoms.

The heterocyclic groups are substituted or unsubstituted, three-membered to eight-membered heterocyclic groups having 1 to 20 carbon atoms, preferably 1 to 7 carbon atoms and a hetero atom selected from among nitrogen, oxygen and sulfur atoms. Typical examples of the heterocyclic groups include 2-pyridyl, 2-thienyl, 2-furyl, 1,3,4-thiadiazol-1-yl, 2,4-dioxo-1,3-imidazolidin-5-yl, 1,2,4-triazol-2-yl and 1-pyrazolyl groups.

When the aliphatic hydrocarbon groups, aromatic groups and heterocyclic groups have substituents, typical examples of the substituents include halogen atoms, and $R_{47}O$—, $R_{46}S$—, $R_{47}CONR_{48}$—, $R_{47}NR_{48}CO$—, $R_{46}OCONR_{47}$—, $R_{46}SO_2NR_{47}$—, $R_{47}NR_{48}SO_2$—, $R_{46}SO_2$—, $R_{47}OCO$— and $R_{47}NR_{48}CONR_{49}$— groups, groups which are the same as $R_{46}$,

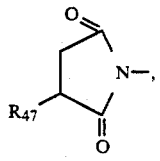

$R_{46}COO$— and $R_{47}OSO_2$— groups, and cyano and nitro groups. $R_{46}$ herein represents an aliphatic group, aromatic group or heterocyclic group, and $R_{47}$, $R_{48}$ and $R_{49}$ each represent an aliphatic group, aromatic group, heterocyclic group or hydrogen atom. The aliphatic group, aromatic group and heterocyclic group are as defined above.

In the general formula (Cp-6), $R_{51}$ is preferably an aliphatic group or aromatic group, $R_{52}$ is preferably a chlorine atom, aliphatic group or $R_{41}CONH$— group, d is preferably 1 or 2, and $R_{53}$ is preferably an aromatic group.

In the general formula (Cp-7), $R_{52}$ is preferably $R_{41}CONH$— group, d is preferably 1 and $R_{54}$, is preferably an aliphatic group or aromatic group.

In the general formula (Cp-8), e is preferably 0 or 1, $R_{55}$ is preferably $R_{41}OCONH$—, $R_{41}CONH$— or $R_{41}SO_2NH$— group which is preferably at 5-position of the naphthol ring.

The timing group represented by T is a group capable of split off from X after the bond of Cp was split off by the coupling reaction of the coupler with the oxidation product of the aromatic primary amine developing agent. The timing group T is used for the purposes of controlling the coupling reactivity, stabilizing the coupler and controlling release timing of X or below. The timing groups include the following known groups wherein the groups are bonded with Cp through symbol '*' and they are bonded with X through symbol '**'; or they are bonded with Cp through symbol '*' and with Q through symbol '**':

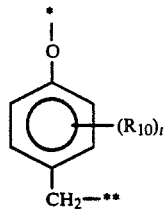

(T-1)

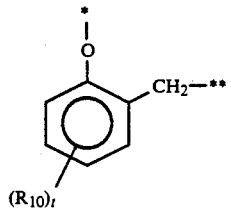

(T-2)

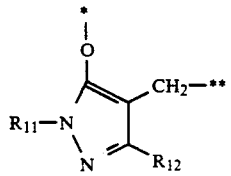

(T-3)

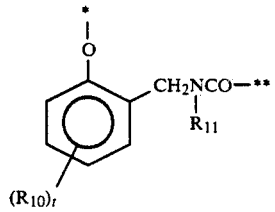

(T-4)

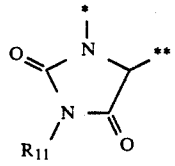

(T-5)

*—$OCH_2$—* (T-6)

*—OC(=O)—** (T-7)

In the above formulae, $R_{10}$ represents a possible substituent of the benzene ring, $R_{11}$ has the same meaning as that of $R_{41}$, $R_{12}$ represents a hydrogen atom or a substituent, and t represents an integer of 0 to 4. The substituents of $R_{10}$ and $R_{12}$ include $R_{41}$, halogen atoms, $R_{43}O$—, $R_{43}S$—, $R_{43}(R_{44})NCO$—, $R_{43}OOC$—, $R_{43}SO_2$— $R_{43}(R_{44})$ NSO—, $R_{43}CON(R_{43})$—, $R_{41}SO_2N(R_{43})$—, $R_{43}CO$—, $R_{41}COO$—, $R_{41}SO$—, nitro, $R_{43}(R_{44})NCON(R_{45})$—, cyano, $R_{41}OCON(R_{43})$—, $R_{43}OSO_2$—, $R_{43}(R_{44})N$—, $R_{43}(R_{44})NSO_2N(R_{45})$— or

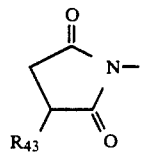

k is an integer of 0 or 1. Usually k is preferably 0, namely, Cp and X are preferably directly bonded with each other.

X is a divalent connecting bond connected with $(T)_k$ through N, O or S. X is preferably, —O—, —S—, —OCO—, OCOO—, OCOS—, —OCONH—, —$OSO_2$—, —$OSO_2NH$—, a heterocyclic group bonded with $(T)_k$ through N (such as that derived from pyrrolidine, piperidine, morpholine, piperazine, pyrrole, pyrazole, imidazole, 1,2,4-triazole, benzotriazole, succinimide, phthalimide, oxazolidine-2,4-dione, imidazolidine-2,4-dione, 1,2,4-triazolidine-3,5-dione) or a connecting group comprising a composite of such a group with an alkylene group (such as methylene, ethylene or propylene group), cycloalkylene group (such as 1,4-dyclohexylene group), arylene group (such as o-phenylene or p-phenylene group) or divalent heterocyclic group (such as that derived from pyridine or thiophene), —CO—, —$SO_2$—, —COO—, —CONH—, —$SO_2NH$—, —$SO_2O$—, —NHCO—, —$NHSO_2$—, —NHCONH—, —$NHSO_2NH$— or —NHCOO—. X is more preferably that represented by the general formula (II):

$$*—X_1—(L—X_2)_m—^{**} \qquad \text{Formula (II)}$$

In the general formula (II), * represents the position of bonding with (T). , ** represents the position of bonding with Q, $X_1$ represents —O— or —S—, L represents an alkylene group, $X_2$ represents a single bond, —O—, —S—, —CO—, —$SO_2$—, —OCO—, —COO—, —NHCO—, —CONH—, —$SO_2NH$—, —$NHSO_2$—, —$SO_2O$—, —OSO—, —OCOO—, —OCONH—, —NHCOO—, —NHCONH—, —$NHSO_2NH$—, —OCOS—, —SCOO—, —$OSO_2NH$— or —$NHSO_2O$— and m represents an integr of 0 to 3. The number of total carbon atoms of X (hereinafter referred to 'the number of carbon atoms') is preferably 0 to 12, more preferably 0 to 8. X is most preferably —$OCH_2CH_2O$—.

Q represents an arylene group or divalent heterocyclic group. When Q is an arylene group, it may be a condensed ring or have a substituent (such as a halogen atom, or hydroxyl, carboxyl, sulfo, nitro, cyano, amino, ammonium, phosphono, phosphino, alkyl, cycloalkyl, aryl, carbonamide, sulfonamide, alkoxyl, aryloxy, acyl, sulfonyl, carboxyl, carbamoyl or sulfamoyl group). The number of carbon atoms is preferably 6 to 15, more preferably 6 to 10. When Q is a divalent heterocyclic group, it is a 3- to 8-membered, preferably 5- to 7-membered, monocyclic or condensed heterocyclic group having at least one hetero atom selected from among N, O, S, P, Se and Te in the ring (such as a group derived from pyridine, thiophene, furan, pyrrole, pyrazole, imidazole, thiazole, oxazole, benzothiazole, benzoxazole, benzofuran, benzothiophene, 1,3,4-thiadiazole, indole or quinoline). It may have a substituent (such as a substituent described above for Q as the arylene group). The number of carbon atoms is preferably 2 to 15, more preferably 2 to 10. The most preferred Q is

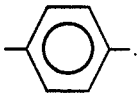

Therefore, the most preferred —$(T)_k$—X—Q— is

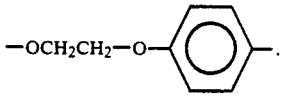

When $R_1$, $R_2$ or $R_3$ is an alkyl group, this alkyl group may be either a straight chain or branched group and it may have an unsaturated bond. Further, it may have a substituent (such as a halogen atom or hydroxyl, carboxyl, sulfo, phosphono, phosphino, cyano, alkoxyl, aryl, alkoxycarbonyl, amino, ammoniumyl, acyl, carbonamide, sulfonamide, carbamoyl, sulfamoyl or sulfonyl group).

When $R_1$, $R_2$ or $R_3$ is a cycloalkyl group, this cycloalkyl group is a 3- to 8-membered cycloalkyl group which may have a crosslinking group, an unsaturated bond or a substituent (the same as the substituent of the alkyl group described above with reference to a case wherein $R_1$, $R_2$ or $R_3$ is the alkyl group).

When $R_1$, $R_2$ or $R_3$ is an aryl group, this aryl group may be a condensed ring or have a substituent (such as the substituent of the alkyl group described above with reference to a case wherein $R_1$, $R_2$ or $R_3$ is the alkyl group, or an alkyl or cycloalkyl group).

When $R_1$, $R_2$ or $R_3$ is a heterocyclic group, this heterocyclic group has a three-membered to eight-membered (preferably five-membered to seven-membered) monocyclic or condensed ring having at least one hetero atom selected from among N, S, O, P, Se and Te in the ring (such as imidazolyl, thienyl, pyrazolyl, pyridyl or quinolinyl) and it may have a substituent (such as the substituent of the aryl group described above with reference to a case wherein $R_1$, $R_2$ or $R_3$ is the aryl group).

The carboxyl, sulfo, phosphino and phosphono groups herein may include carboxylate, sulfonate, phosphinate and phosphonate groups, respectively and the counter ions in such a case include $Li^+$, $Na^+$, $K^+$ and ammonium.

$R_1$ is preferably a hydrogen atom, carboxyl group, an alkyl group having 1 to 10 carbon atoms (such as methyl, t-butyl, carbomethyl, 2-sulfomethyl, carboxymethyl, 2-carboxymethyl, 2-hydroxymethyl, benzyl, ethyl or isopropyl group) or an aryl group having 6 to 12 carbon atoms (such as phenyl, 4-methoxyphenyl or 4-sulfophenyl group). $R_1$ is particularly preferably a hydrogen atom, methyl group or carboxyl group.

$R_2$ is preferably a cyano group, carboxyl group, a carbamoyl group having 1 to 10 carbon atoms, a sulfamoyl group having 0 to 10 carbon atoms, sulfo group, an alkyl group having 1 to 10 carbon atoms (such as methyl or sulfomethyl group), a sulfonyl group having 1 to 10 carbon atoms (such as methylsulfonyl or phenylsulfonyl group), a carbonamide group having 1 to 10 carbon atoms (such as acetamide or benzamide group), a sulfonamide group having 1 to 10 carbon atoms (such as methanesulfonamide or toluenesulfonamide group). $R_2$ is particularly preferably a cyano group, carbamoyl group or carboxyl group.

$R_3$ is preferably a hydrogen atom, an alkyl group having 1 to 12 carbon atoms (such as methyl, sulfomethyl, carboxymethyl, 2-sulfomethyl, 2-carboxymethyl, ethyl, n-butyl, benzyl or 4-sulfobenzyl group) or an aryl group having 6 to 15 carbon atoms (such as phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl or 2,5-disulfophenyl group). $R_3$ is more preferably alkyl group having 1 to 7 carbon atoms or an aryl group having 6 to 10 carbon atoms.

$R_4$ is an acyl group of the following general formula (III) or a sulfonyl group of the following general formula (IV):

$R_{11}CO$— General Formula (III)

$R_{11}SO_2$—. General Formula (IV)

When $R_{11}$ is an alkyl group, this alkyl group may be either a straight or branched and saturated or unsaturated alkyl group which may have a substituent (such as a halogen atom, or hydroxyl, carboxyl, sulfo, phosphono, phosphino, cyano, alkoxyl, aryl, alkoxycarbonyl, amino, ammoniumyl, acyl, carbonamide, sulfonamide, carbamoyl, sulfamoyl or sulfonyl group).

When $R_{11}$ is a cycloalkyl group, this cycloalkyl group has a 3-membered to 8-membered ring which may have a crosslinking group, unsaturated bond and/or substituent (such as the substituent of the alkyl group described above with reference to a case wherein $R_{11}$ is the alkyl group).

When $R_{11}$ is an aryl group, this aryl group may have a condensed ring and a substituent (such as the substituent of the alkyl group described above with reference to a case wherein $R_{11}$ is the alkyl group, or an alkyl or cycloalkyl group).

When $R_{11}$ is a heterocyclic group, this heterocyclic group has a three-membered to eight-membered (preferably five-membered to seven-membered) monocyclic or condensed ring having at least one hetero atom selected from among N, S, O, P, Se and Te in the ring (such as imidazolyl, thienyl, pyrazolyl, pyridyl or quinolinyl) and it may have a substituent (such as the substituent of the aryl group described above with reference to a case wherein $R_{11}$ is the aryl group).

The carboxyl, sulfo, phosphino and phosphono groups herein may include carboxylate, sulfonate, phosphinate and phosphonate groups, respectively and the counter ions in such a case include $Li^+$, $Na^+$, $K^+$, ammonium or the like.

$R_{11}$ is preferably an alkyl group having 1 to 10 carbon atoms (such as methyl, carboxymethyl, sulfoethyl or cyano ethyl group), a cycloalkyl group having 5 to 8 carbon atoms (such as cyclohexyl or 2-carboxycyclohexyl group) or an aryl group having 6 to 10 carbon atoms (such as phenyl, 1-naphthyl or 4-sulfophenyl group). $R_{11}$ is particularly preferably an alkyl group having 1 to 3 carbon atoms or an aryl group having 6 carbon atoms.

$R_5$ is a group which can be substituted or preferably an electron-donating group. $R_5$ is particularly preferably —$NR_{12}R_{13}$ or —$OR_{14}$. The position of substitution is preferably 4-position. $R_{12}$, $R_{13}$ and $R_{14}$ each represent a hydrogen atom, alkyl group, cycloalkyl group, aryl group or heterocyclic group. $R_{12}$ and $R_{13}$, may be bonded together to form a ring. The nitrogen-containing heterocycle to be formed is preferably an alicyclic ring.

j represents an integer of 0 to 4, preferably 1 or 2 and particularly preferably 1.

When $R_9$ or $R_{10}$ is an alkyl group, this alkyl group may be either straight chain o branched, and saturated or unsaturated alkyl group which may have a substituent (such as a halogen atom or a hydroxyl, carboxyl, sulfo, phosphono, phosphino, cyano, alkoxyl, aryl, alkoxycarbonyl, amino, ammoniumyl, acyl, carbonamide, sulfonamide, carbamoyl, sulfamoyl or sulfonyl group).

When $R_9$ or $R_{10}$ is a cycloalkyl group, this cycloalkyl group is a 3- to 8-membered cycloalkyl group which may have a crosslinking group, an unsaturated bond or a substituent (the same as the substituent of the alkyl group described above with reference to a case wherein $R_9$ or $R_{10}$ is the alkyl group).

When $R_9$ or $R_{10}$ is an aryl group, this aryl group may be a condensed ring or have a substituent (such as the substituent of the alkyl group described above with reference to a case wherein $R_9$ or $R_{10}$ is the alkyl group, or an alkyl or cycloalkyl group).

When $R_9$ or $R_{10}$ is a heterocyclic group, this heterocyclic group has a three-membered to eight-membered (preferably five-membered to seven-membered) monocyclic or condensed ring having at least one hetero atom selected from among N, S, O, P, Se and Te in the ring (such as imidazolyl, thienyl, pyrazolyl, pyridyl or quinolinyl) and it may have a substituent (such as the substituent of the aryl group described above with reference to a case wherein $R_9$ or $R_{10}$ is the aryl group).

The carboxyl, sulfo, phosphino and phosphono groups herein may include carboxylate, sulfonate, phosphinate and phosphonate groups, respectively, and the counter ions in such a case include $Li^+$, $Na^+$, $K^+$ and ammonium.

$R_9$ is preferably a cyano group, carboxyl group, carbamoyl having 1 to 10 carbon atoms, alkoxycarbonyl group having 2 to 10 carbon atoms, aryloxycarbonyl group having 7 to 11 carbon atoms, sulfamoyl group having 0 to 10 carbon atoms, sulfo group, alkyl group having 1 to 10 carbon atoms (such as methyl, carboxymethyl or sulfomethyl group), sulfonyl group having 1 to 10 carbon atoms (such as methylsulfonyl or phenylsulfonyl group), carboxamide group having 1 to 10 carbon atoms (such as acetamide or benzamide group), sulfonamide group having 1 to 10 carbon atoms (such as methanesulfonamide or toluenesulfonamide group), alkyloxy group (such as methoxy or ethoxy group) or aryloxy group (such as phenoxy group). Particularly preferred are cyano, carbamoyl, alkoxycarbamoyl and carboxyl groups.

$R_{10}$ is preferably a hydrogen atom, alkyl group having 1 to 12 carbon atoms (such as methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl or 4-sulfobenzyl group) or aryl group having 6 to 15 carbon atoms (such as phenyl, 4-carboxyphenyl, 3-carboxyphenyl, 2,4-dicarboxyphenyl, 4-sulfophenyl, 3-sulfophenyl, 2,5-disulfophenyl or 2,4-disulfophenyl group). $R_{10}$ is more preferably an alkyl group having 1 to 7 carbon atoms or aryl group having 6 to 10 carbon atoms.

Examples of Cp, X, Q,

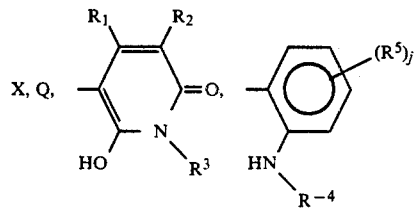

and

-continued
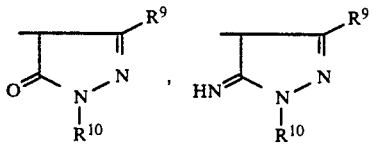
of the general formulae (CI) to (CIV) will be given below.
Examples of Cp:
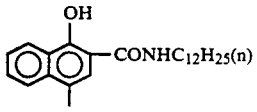
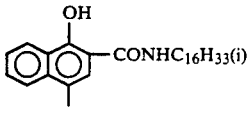
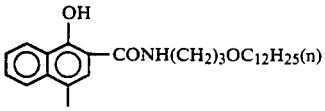
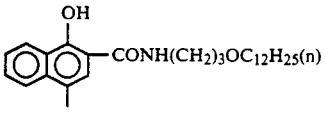
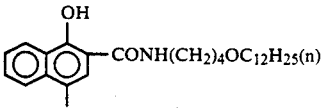
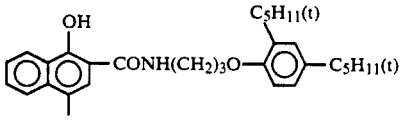
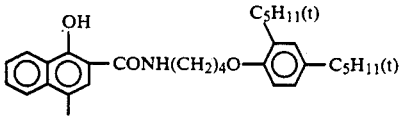
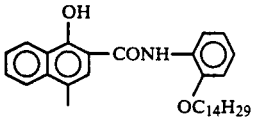
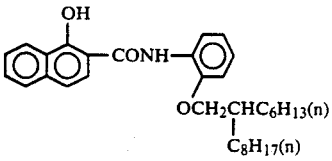
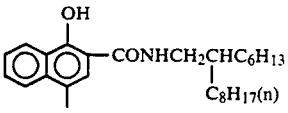
-continued
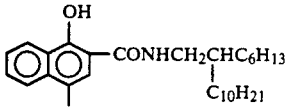
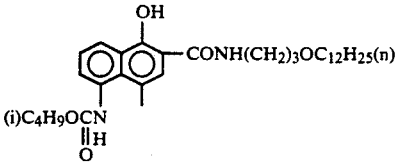
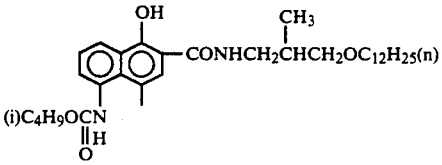
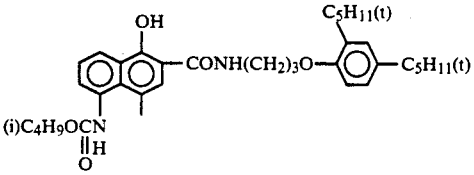
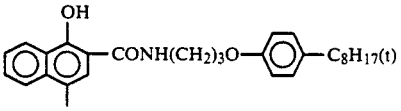
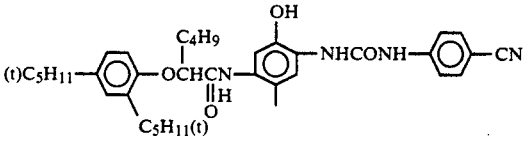
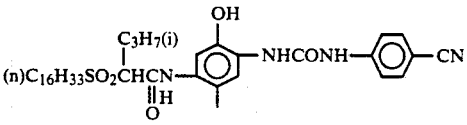
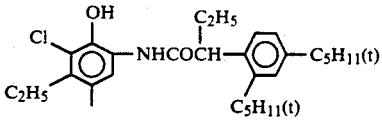
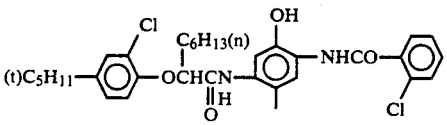
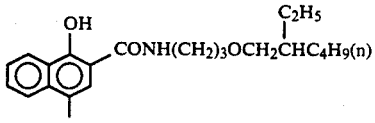

-continued
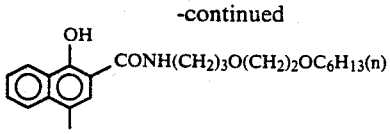
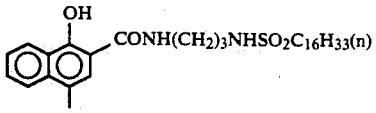
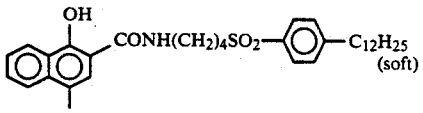
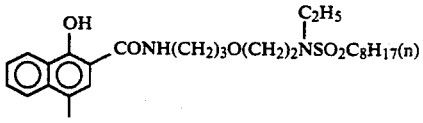
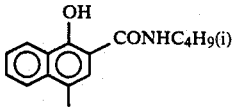
Examples of X:
—O—, —S—, —$OCH_2$—, —$OCH_2CH_2$—, —O-$CHO_2CH_2O$—, —$OCH_2CH_2CH_2O$—, —O($CH_2CH_2O$)$_2$—, —$OCH_2CH_2S$—, —$OCH_2CH_2NHCO$—, —$OCH_2CH_2NHSO_2$—, —$OCH_2CH_2SO_2$—, —$OCH_2CH_2OCO$—, —$OCH_2CH_2CO$—, —$SCH_2CONH$—, —$SCH_2COO$—,
—OCH(CH3)CONH—,
—$OCH_2CH_2OSO_2$—, —OCO—,
—$OCH_2CH(CO_2H)$—, —$OCH_2CH(CO_2H)CH_2$—,
—$OCH_2CH(CO_2H)O$—, —$OCH(CO_2H)CH_2O$—,
—$OCH_2CH(CO_2H)S$—, —$OCH_2CH(SO_3Na)O$—,
Examples of Q
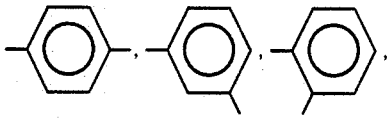
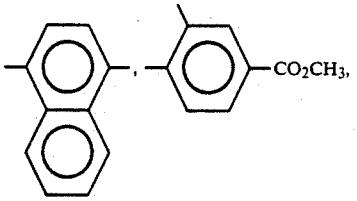
-continued
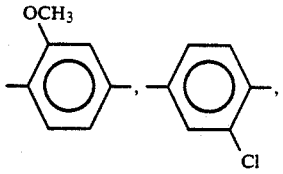
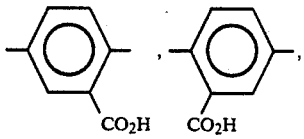
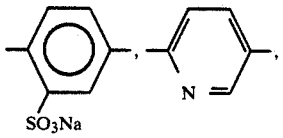
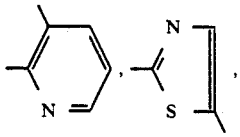
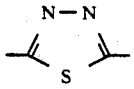
Examples of
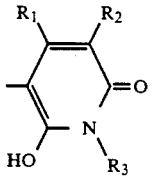
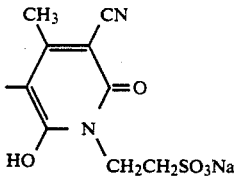
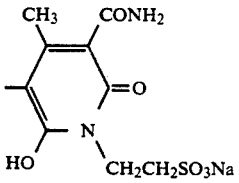
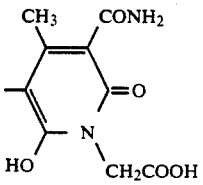

-continued
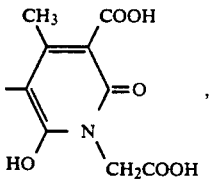
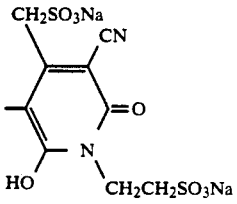
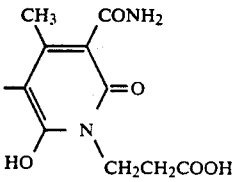
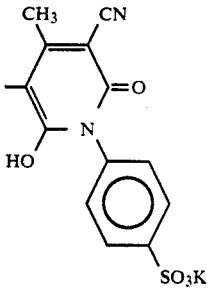
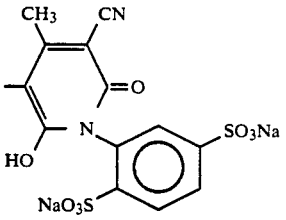
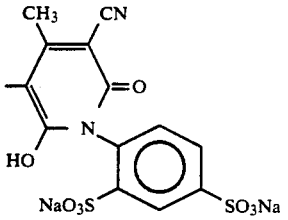
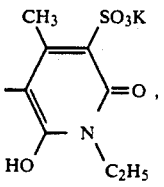
-continued
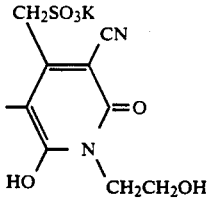
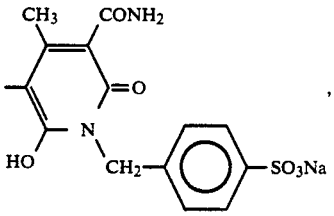
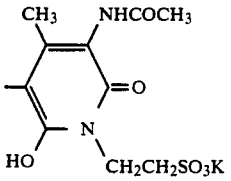
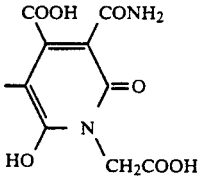
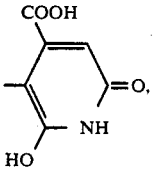
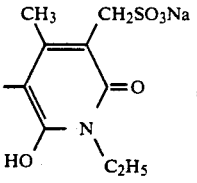
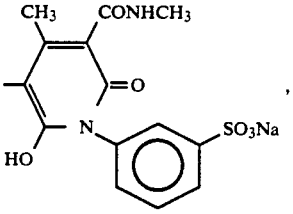
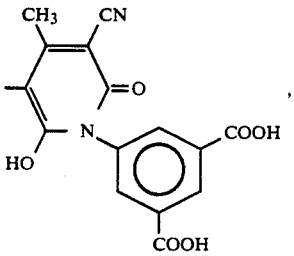

-continued
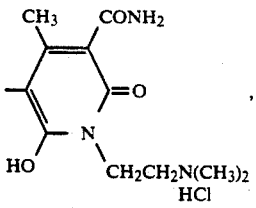
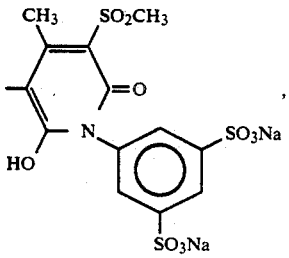
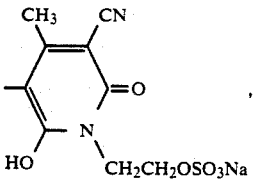
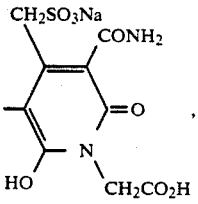
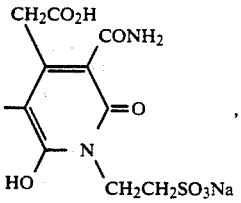
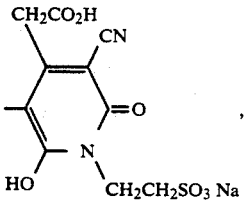
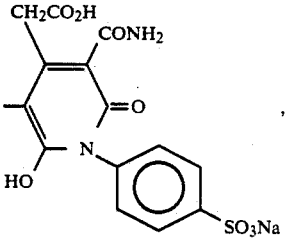
-continued
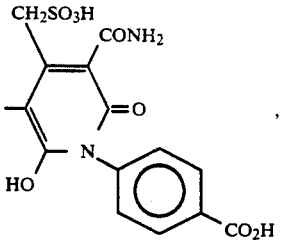
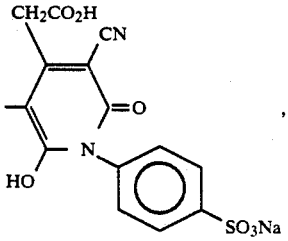
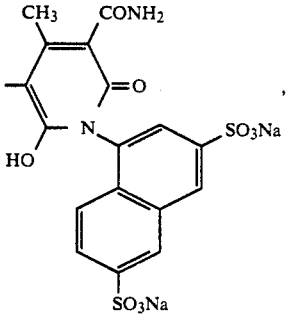
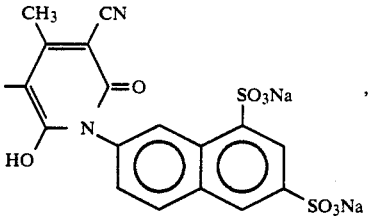
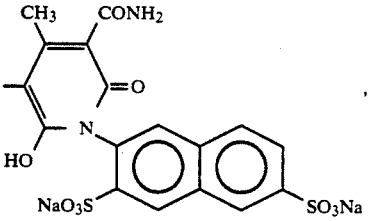
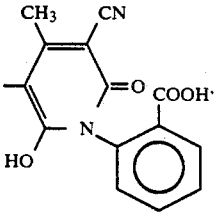

-continued
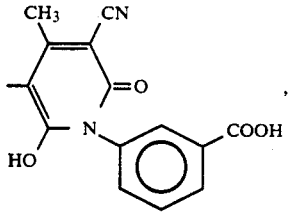
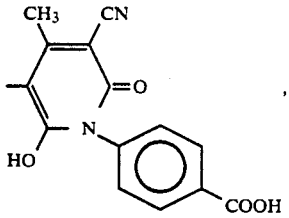
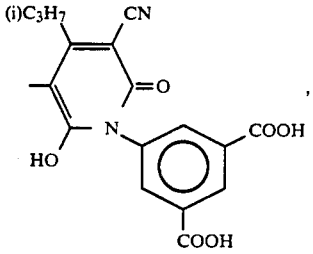
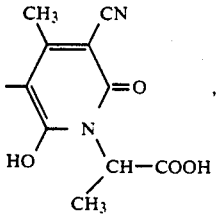
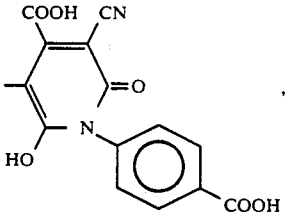
Examples of
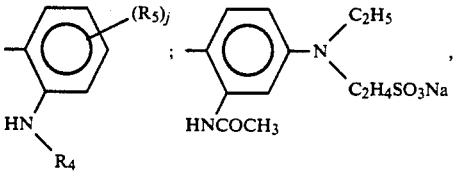
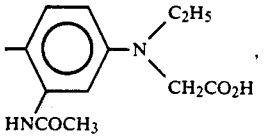
-continued
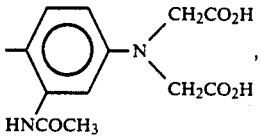
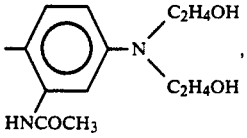
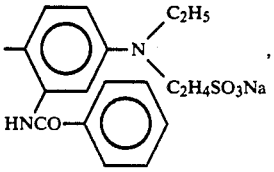
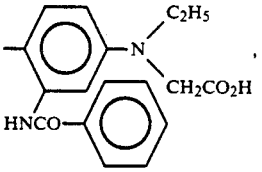
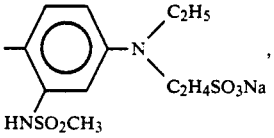
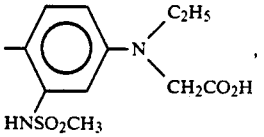
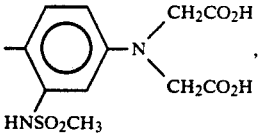
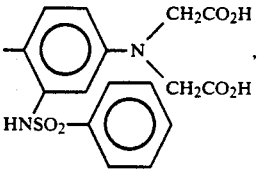
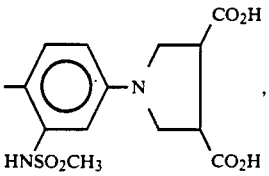

-continued
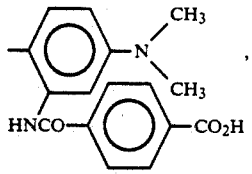
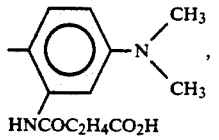
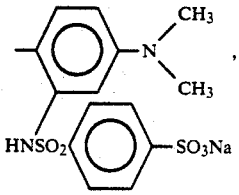
Examples of
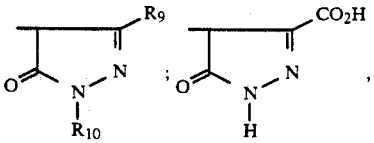
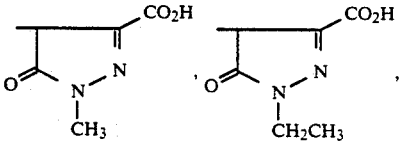
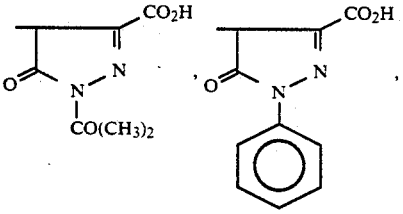
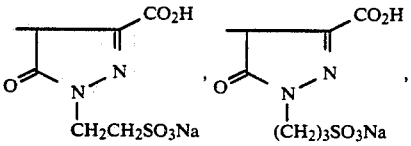
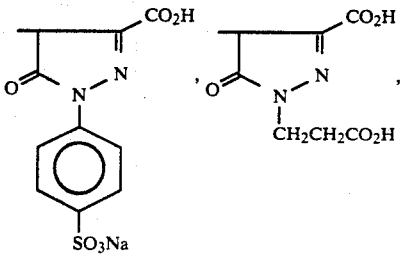
-continued
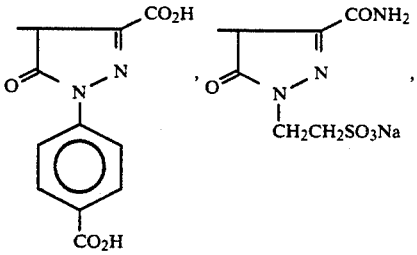
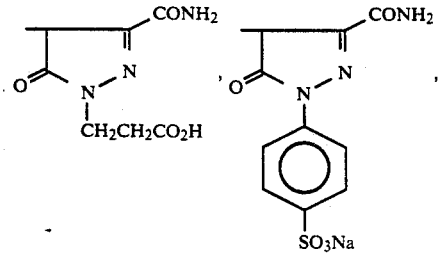
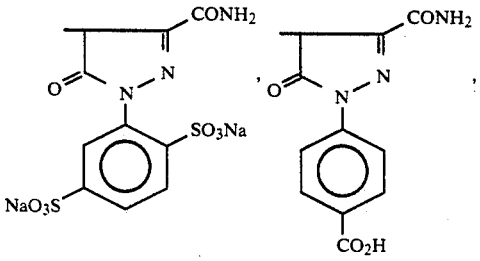
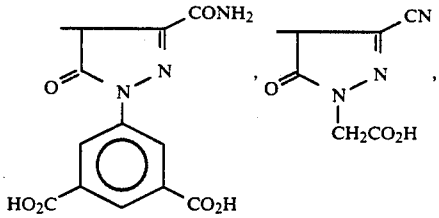
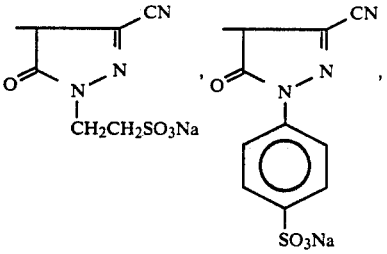
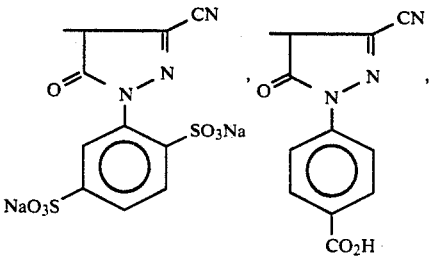

-continued
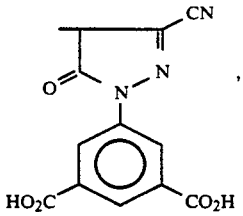
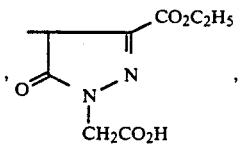
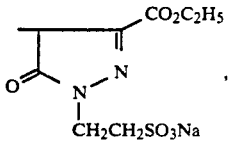
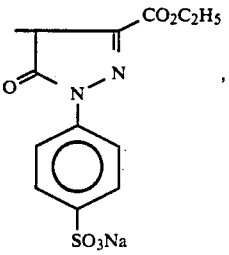
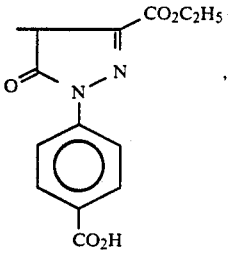
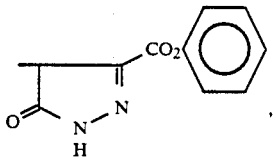
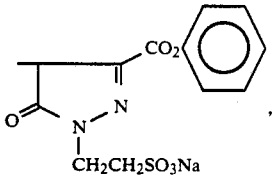
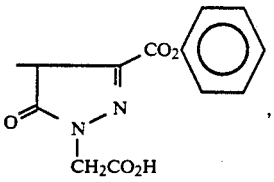
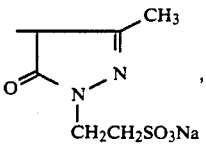
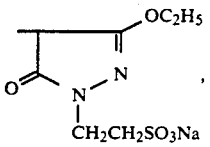
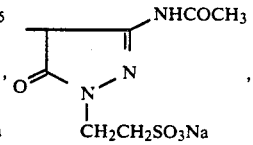
-continued
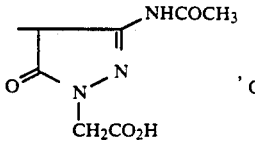
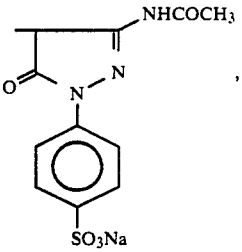
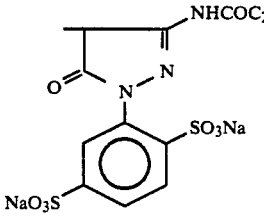
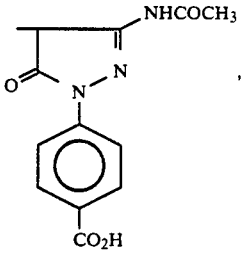
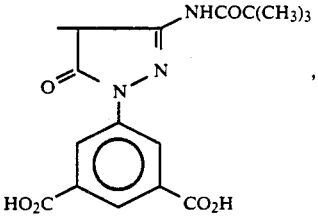
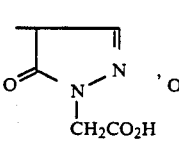
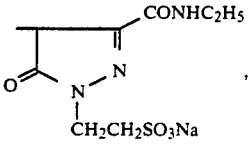
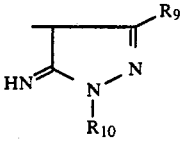
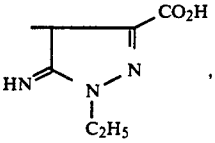
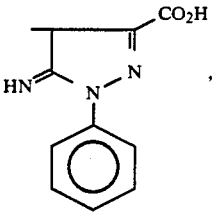
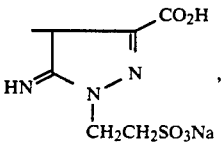

-continued
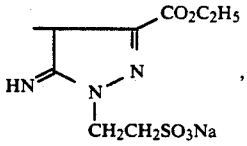
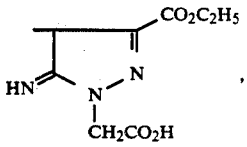
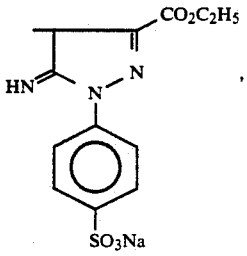
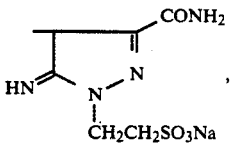
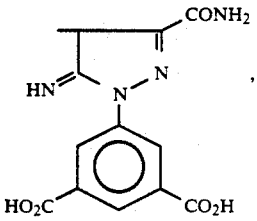
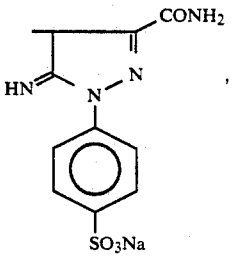
-continued
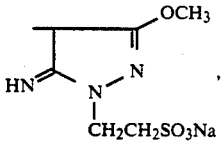
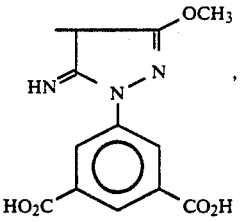
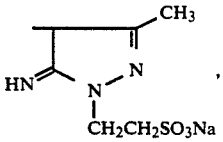
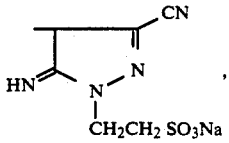
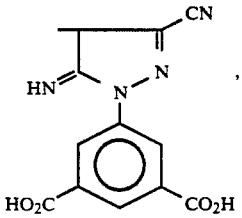
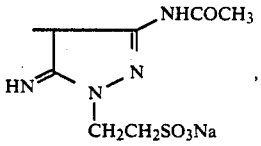
Examples of the yellow-colored cyan couplers of the present invention will given below, which by no means limit the invention.
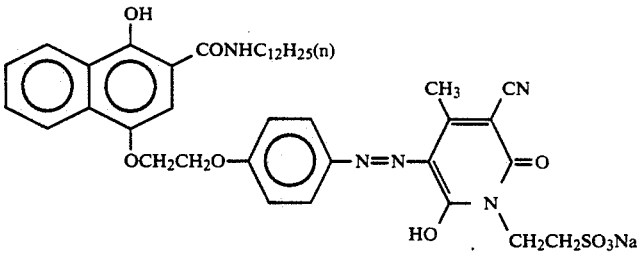
(YC-1)
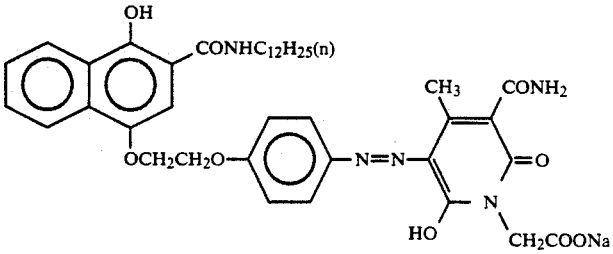
(YC-2)

-continued
(YC-3)
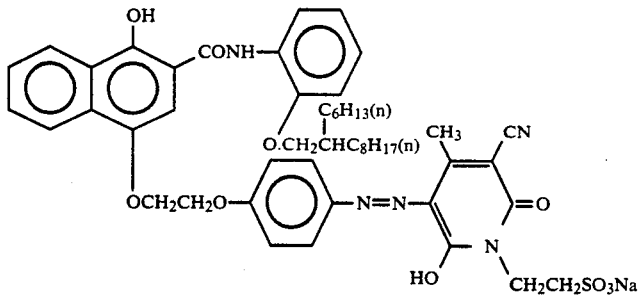
(YC-4)
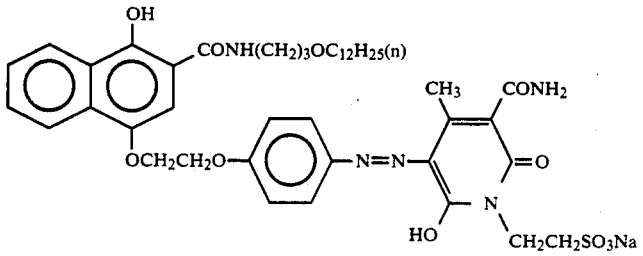
(YC-5)
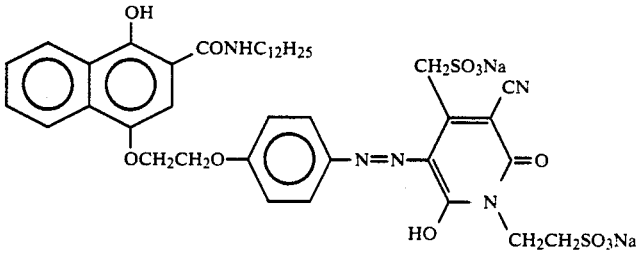
(YC-6)
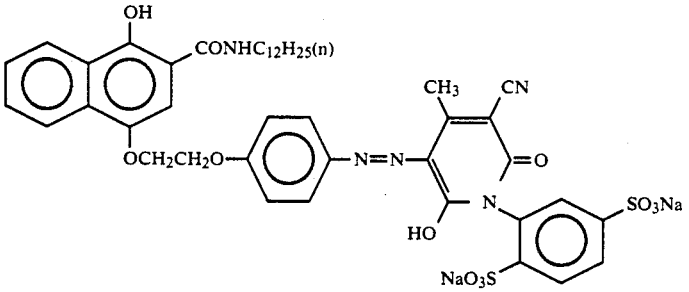
(YC-7)
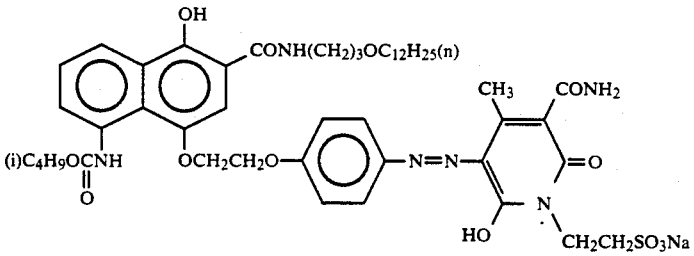
(YC-8)
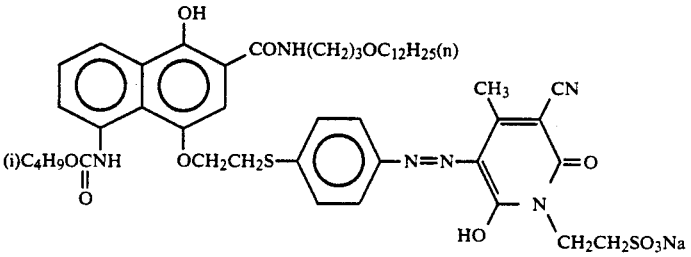

-continued
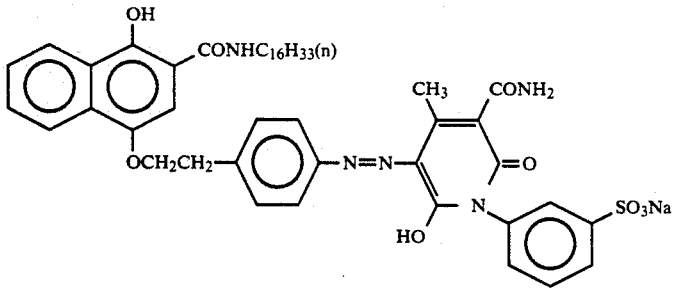
(YC-9)
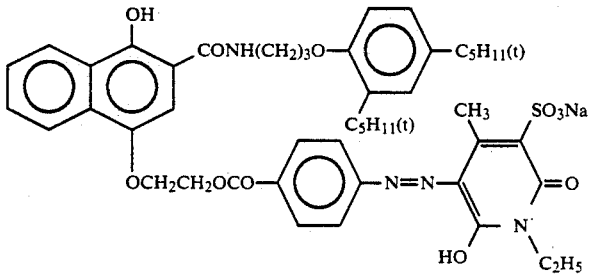
(YC-10)
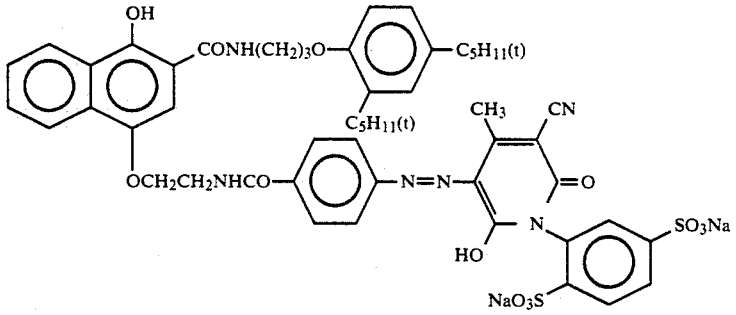
(YC-11)
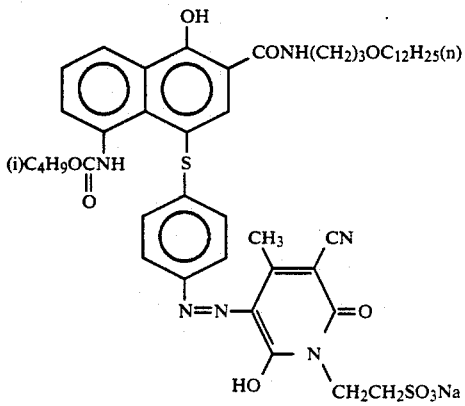
(YC-12)

-continued
(YC-13)
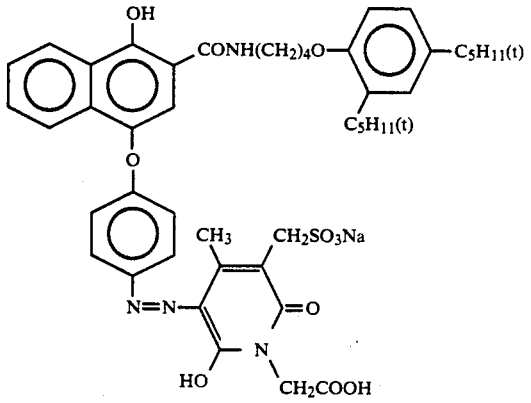
(YC-14)
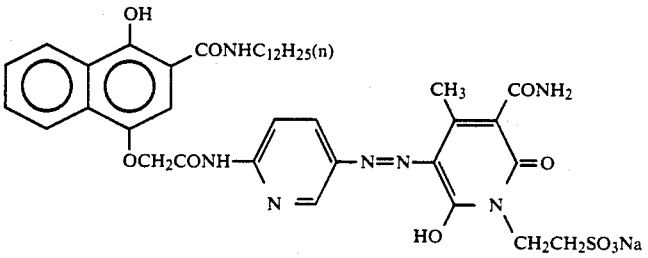
(YC-15)
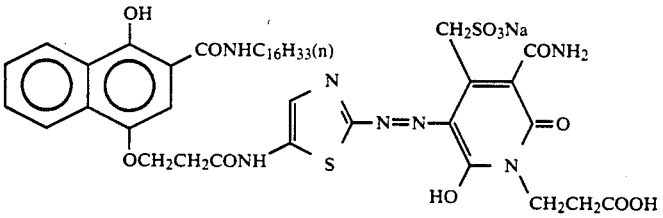
(YC-16)
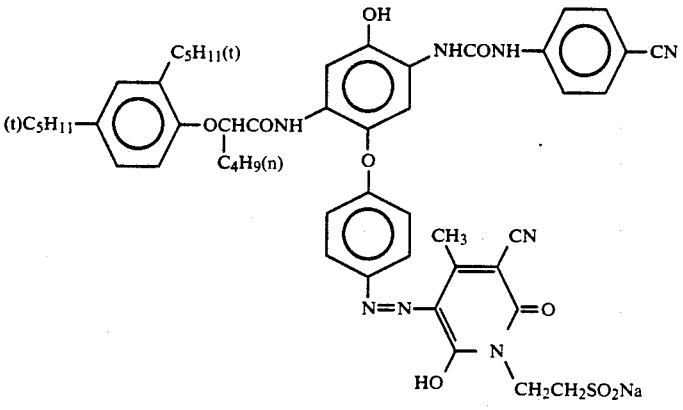

-continued
(YC-17)
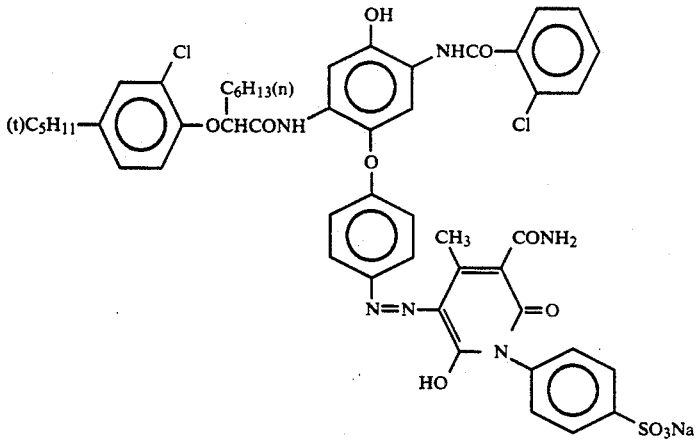
(YC-18)
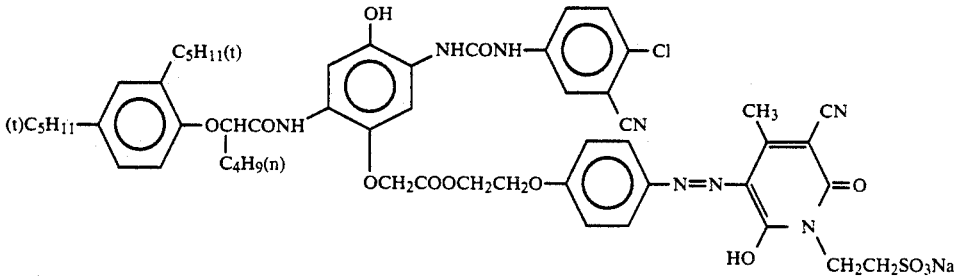
(YC-19)
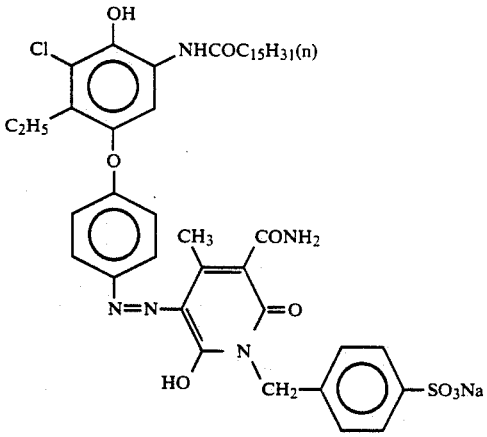
(YC-20)
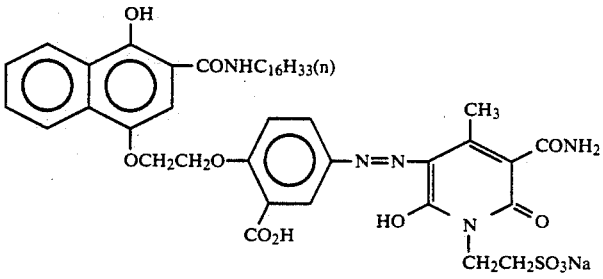

-continued
(YC-21)
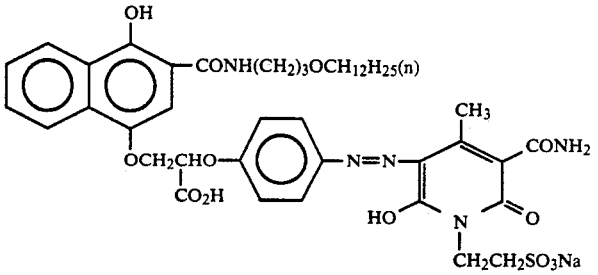
(YC-22)
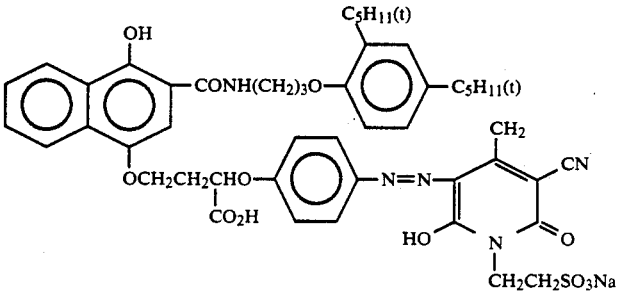
(YC-23)
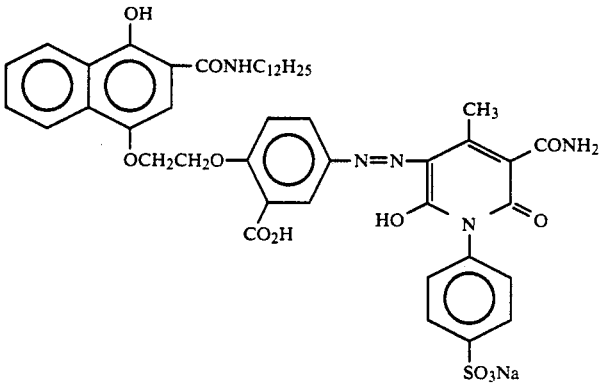
(YC-24)
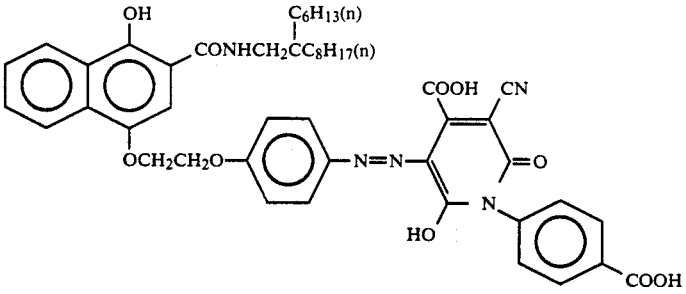
(YC-25)
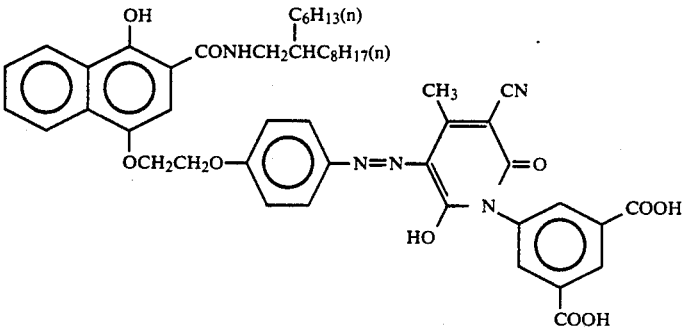

-continued
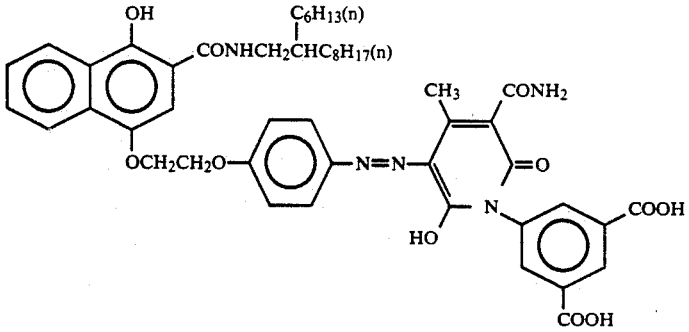
(YC-26)
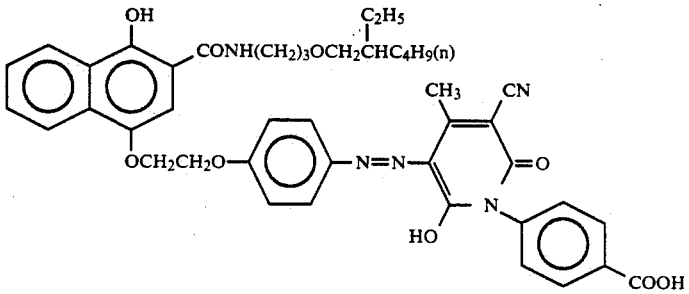
(YC-27)
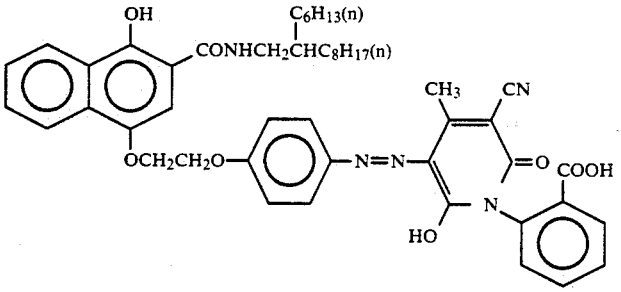
(YC-28)
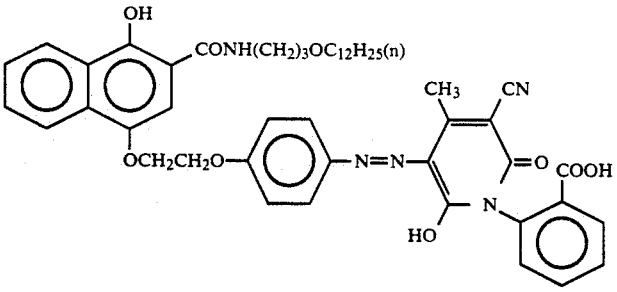
(YC-29)
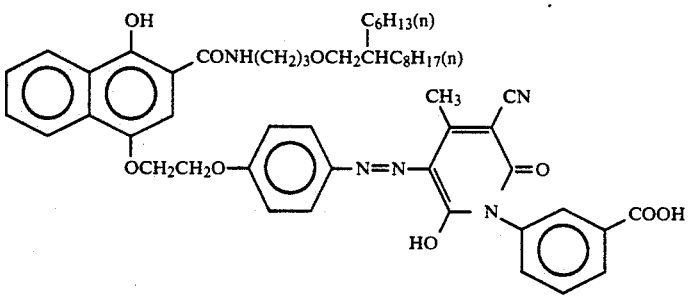
(YC-30)

-continued
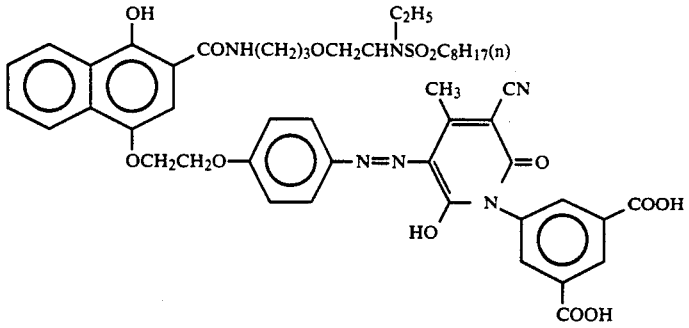
(YC-31)
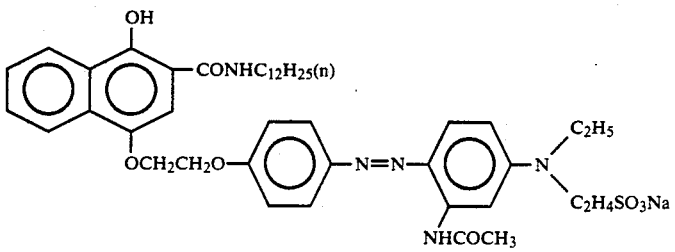
(YC-32)
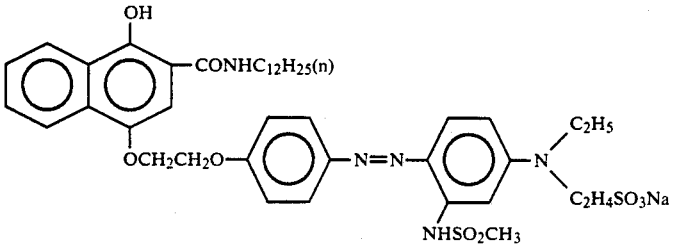
(YC-33)
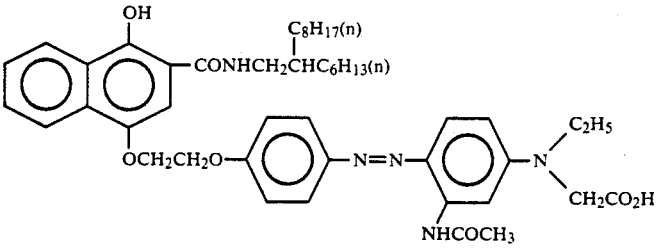
(YC-34)
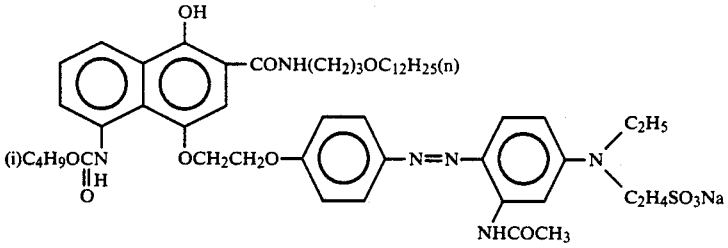
(YC-35)
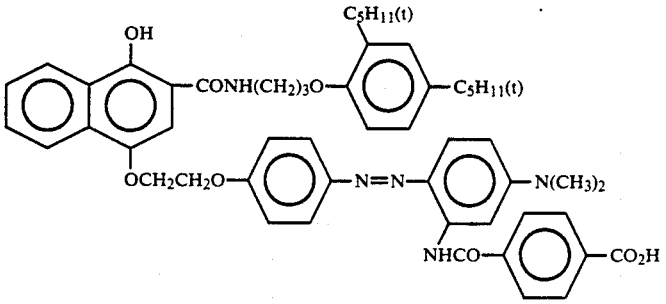
(YC-36)

-continued
(YC-37)
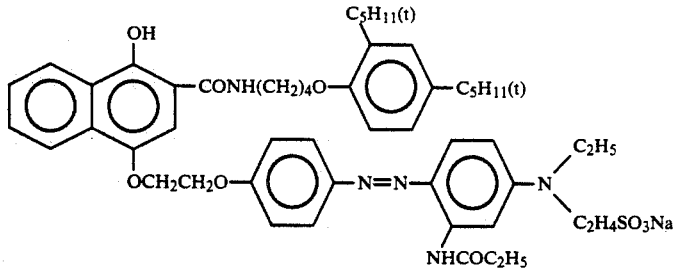
(YC-38)
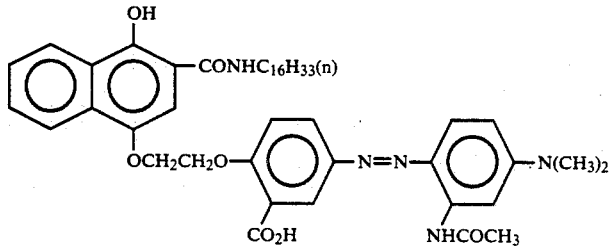
(YC-39)
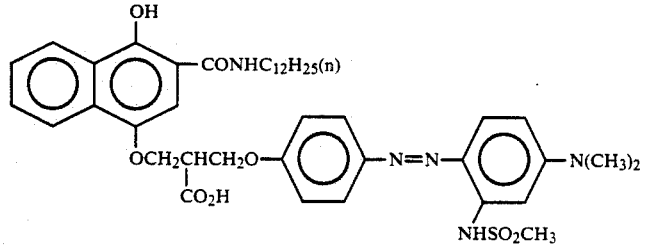
(YC-40)
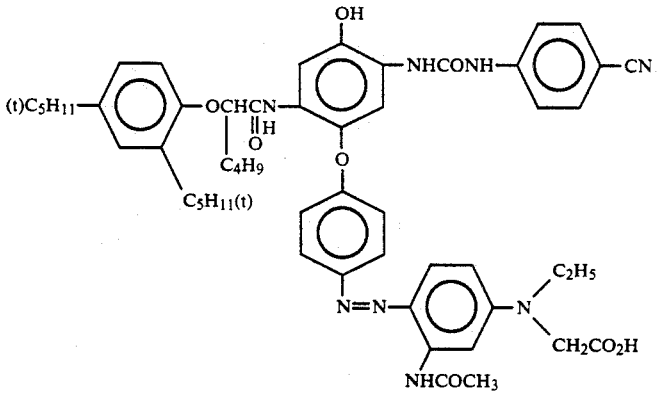
(YC-41)
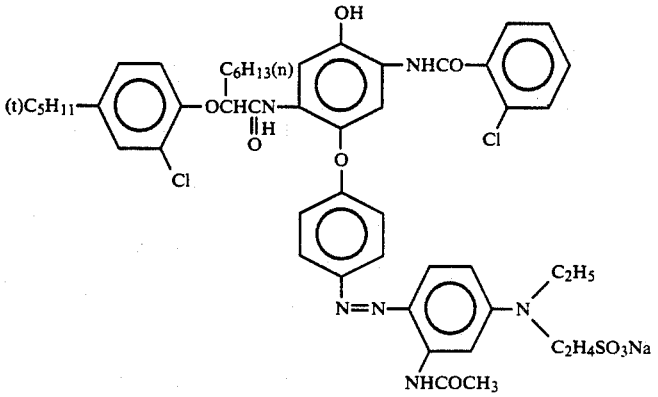

-continued
(YC-42)
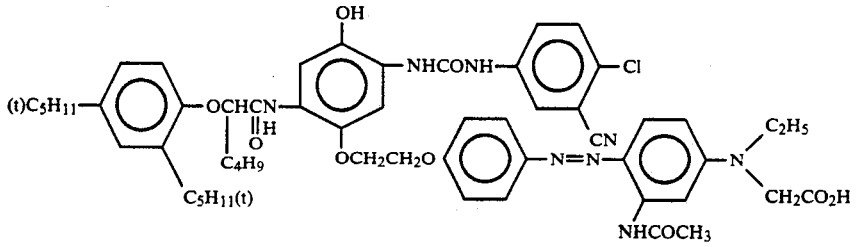
(YC-43)
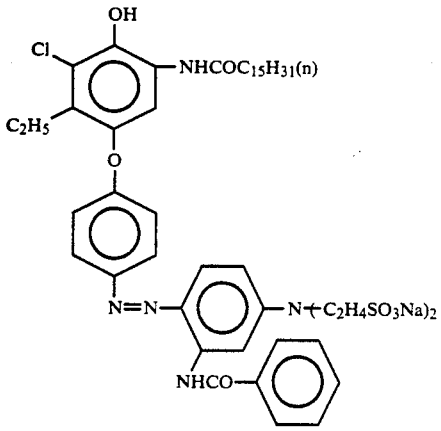
(YC-44)
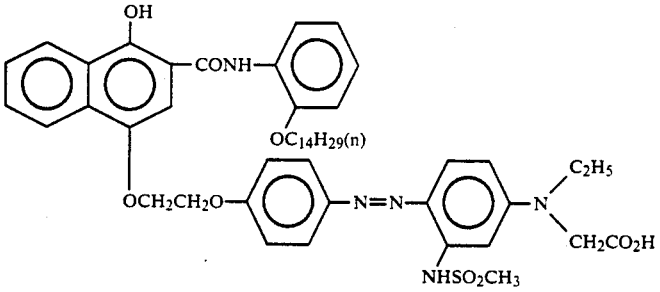
(YC-45)
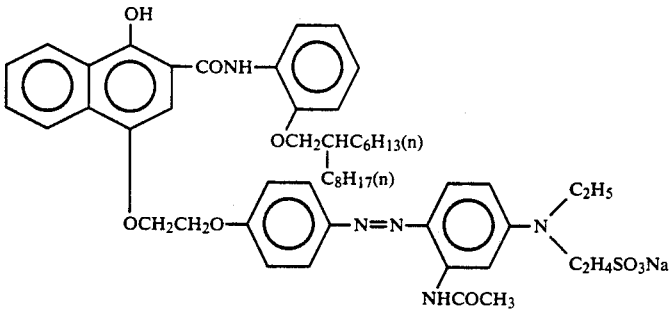
(YC-46)
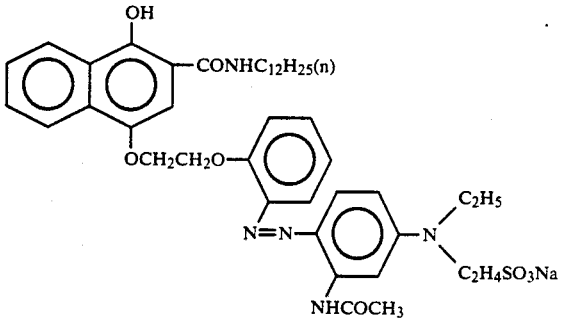

-continued
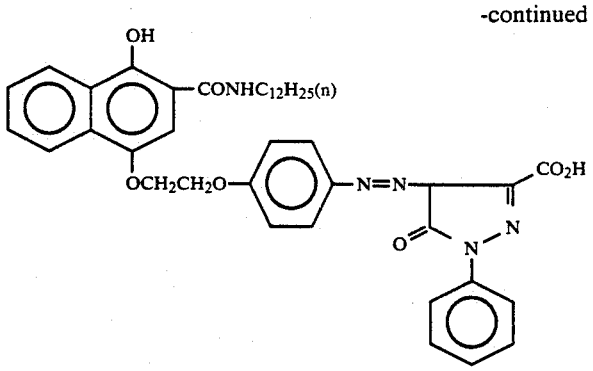
(YC-47)
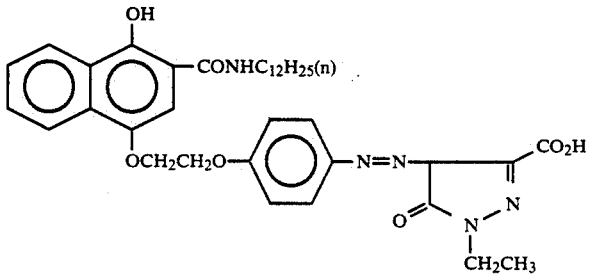
(YC-48)
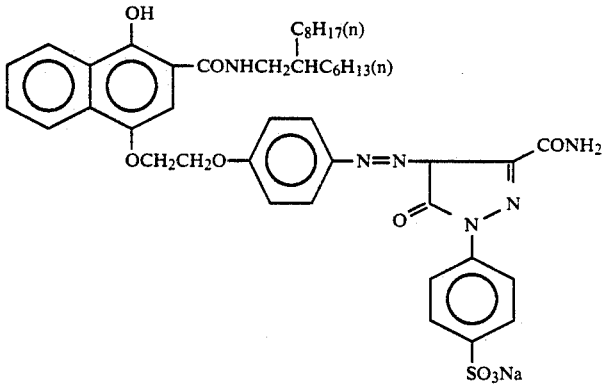
(YC-49)
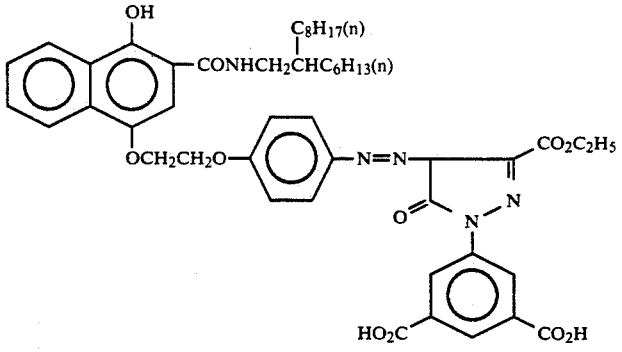
(YC-50)
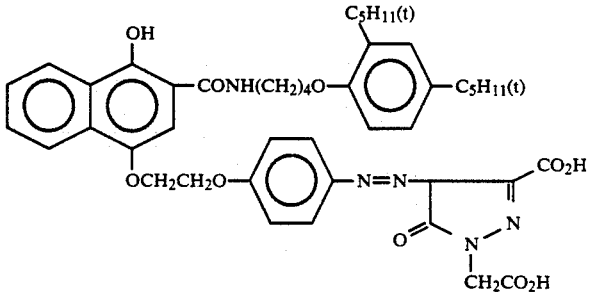
(YC-51)

-continued (YC-52)

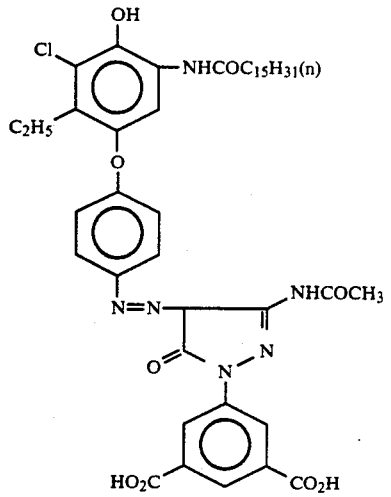

(YC-53)

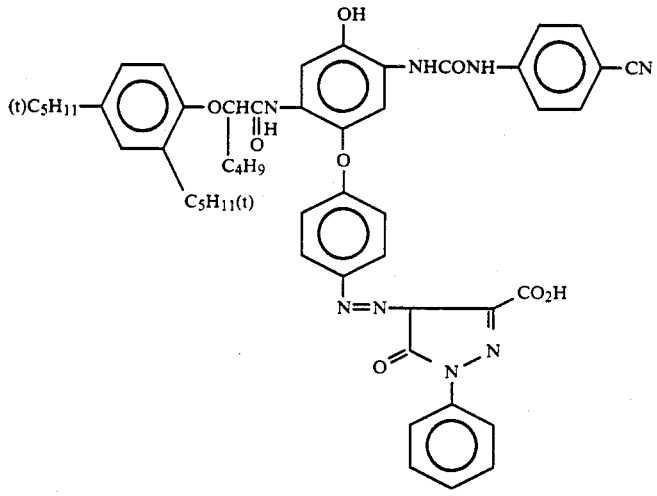

(YC-54)

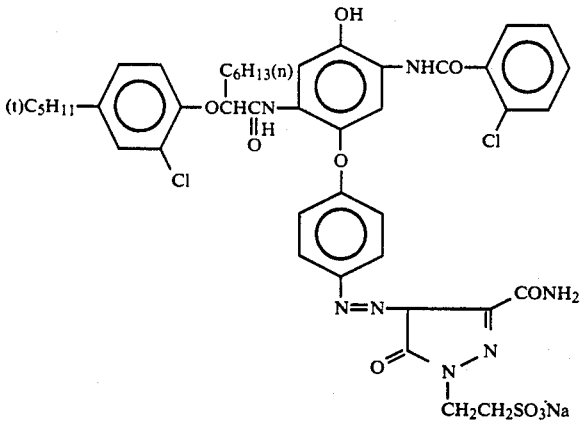

In the present invention, the yellow-colored cyan couplers of the general formulae (CI) and (CII) are preferably used. Those of the general formula (CI) are particularly preferably used.

The yellow-colored cyan coupler of the present invention is preferably added to a photosensitive silver halide emulsion layer or a layer adjacent thereto, particularly to a red-sensitive emulsion layer, of a photosensitive material. The total amount of this coupler added to the photosensitive material is 0.005 to 0.30 g/m$^2$, preferably 0.02 to 0.20 g/m$^2$, and more preferably 0.03 to 0.15 g/m$^2$ The yellow-colored cyan coupler of the present invention can be incorporated into the photosensitive material in the same manner as that of ordinary couplers as will be described below.

At least one layer among a blue-sensitive layer, a green-sensitive layer and a red-sensitive layer comprising a silver halide emulsion is formed on the support to form the photosensitive material of the present invention. The number or the order of the arrangement of the silver halide emulsion layer(s) and the photoinsensitive layer(s) is not particularly limited. A typical example of the silver halide photosensitive material comprises at least one photosensitive layer (comprising two or more silver halide emulsion layer having substantially the same color sensitivity but different degree of sensitivity) formed on the support. The photosensitive layer is a unit photosensitive layer sensitive to any of blue, green and red light. In the multi-layered silver halide color photosensitive materials, the arrangement of the unit photosensitive layers is: a red-sensitive layer, a green-sensitive layer and a blue-sensitive layer in this order from the support. However, the order may be reversed or a sensitive layer may be interposed between two layers sensitive to another color depending on the purpose.

A photoinsensitive layer such as an intermediate layer can be provided between the silver halide photosensitive layers or as the top layer or the bottom layer.

The intermediate layer may contain a coupler or DIR compound as described in J. P. KOKAI Nos. 61-43748, 59-113438, 59-113440, 61-20037 and 61-20038, or an ordinary color-mixing inhibitor.

The two or more silver halide emulsion layers constituting the unit photosensitive layer have preferably a structure consisting of two layers, i.e. a high sensitivity emulsion layer and a low sensitivity emulsion layer, as described in West German Patent No. 1,121,470 or British Patent No. 923,045. Usually the arrangement of the layers is such that the sensitivity thereof decreases gradually toward the support. A photoinsensitive layer may be provided between the silver halide emulsion layers. An emulsion layer having a low sensitivity may be formed away from the support and an emulsion layer having a high sensitivity may be formed close to the support as described in J. P. KOKAI Nos. 57-112751, 62-200350, 62-206541 and 62-206543.

An example of the arrangement is a structure of a blue-sensitive layer having a low sensitivity (BL)/blue-sensitive layer having a high sensitivity (BH)/green-sensitive layer having a high sensitivity (GH)/green-sensitive layer having a low sensitivity (GL)/red-sensitive layer having a high sensitivity (RH)/red-sensitive layer having a low sensitivity (RL); BH/BL/GL/GH/RH/RL; or BH/BL/GH/GL/RL/R H toward the support.

As described in J. P. KOKOKU No. 55-34932, the arrangement may be a blue-sensitive layer /GH/RH/GL/RL toward the support. Another arrangement is a blue-sensitive layer/GL/RL/GH/RH toward the support as described in J. P. KOKAI Nos. 56-25738 and 62-63936.

Another arrangement is that of three layers having sensitivities granually lowered toward the support, i.e. a top layer (a silver halide emulsion layer having the highest sensitivity), middle layer (a silver halide emulsion layer having a lower sensitivity) and bottom layer (a silver halide emulsion layer having a sensitivity lower than that of the middle layer) as described in J. P. KOKOKU No. 49-15495. Even in such an arrangement, sensitive layers having the same color sensitivity may comprise further an emulsion layer having a medium sensitivity/emulsion layer having a high sensitivity/emulsion layer having a low sensitivity in the order toward the support as described in J. P. KOKAI No. 59-202464.

In another example, the arrangement is: high-sensitivity emulsion layer/low sensitivity emulsion layer/-medium sensitivity emulsion layer or low sensitivity emulsion layer/medium sensitivity emulsion layer/high sensitivity emulsion layer.

When the photosensitive material has four or more layers, the arrangement of them may be varied as described above.

Thus the layer construction and the arrangement can be selected suitably for the use of the photosensitive material.

Preferred silver halides contained in the photographic emulsion layers of the photosensitive material used in the present invention include silver bromoiodide, silver chloroiodide and silver chlorobromoiodide, which contain about 30 molar % or less of silver iodide. Particularly preferred is silver bromoiodide or silver chlorobromoiodide containing about 2 to 10 molar % of silver iodide.

The silver halide grains in the photographic emulsion may be in a regular crystal form such as a cubic, octahedral or tetradecahedral form; an irregular crystal form such as spherical or plate form; or a complex crystal form thereof. They include also those having a crystal fault such as a twin plate.

The silver halide grain diameter may range from about 0.2 μm or less to as large as that the projection area diameter thereof is about 10 μm. The emulsion may be either a polydisperse emulsion or monodisperse emulsion.

The silver halide photographic emulsion usable in the present invention can be prepared by processes described in, for example, 'Research Disclosure (RD)' No. 17643 (December, 1978), pages 22 to 23, '1. Emulsion Preparation and types'; RD No. 18716 (November, 1979), p. 648; RD No. 307105 (November, 1989), pages 863 to 865; P. Glafkides, 'Chemic et Phisique Photographique', Paul Montel, 1967; G. F. Duffin, 'Photographic Emulsion Chemistry' (Focal Press, 1966); and V. L. Zelikman et al., 'Making and Coating Photographic Emulsion', (Focal Press, 1964).

Monodisperse emulsions described in U.S. Pat. Nos. 3,574,628 and 3,655,394 and British Patent No. 1,413,748 are also preferred.

Tabular grains having an aspect ratio of 3 or higher are also usable. The tabular grains can be easily prepared by processes described in, for example, Gutoff, 'Photographic Science and Engineering', Vol. 14, pages 248 to 257 (1970); U.S. Pat. Nos. 4,434,226, 4,414,310, 4,433,048 and 4,439,520 and British Patent No. 2,112,157.

The crystal structure of the grains in the above emulsion may be uniform; the grains may comprise an inside portion and an outside portion which are composed of silver halides different from each other; or the structure may be a laminated one. Different silver halide grains can be bonded together by an epitaxial bond or they can be bonded with a compound other than silver halides such as silver rhodanate or lead oxide. A mixture of grains having various crystal forms can also be used.

The emulsion may be of a surface-latent image type for forming a latent image mainly on the surface thereof, of an internal latent image type for forming a latent image in the grains or of such a type that a latent image is formed both on the surface and in the grains. The emulsion must be a negative one. In the internal latent image type emulsions, a core/shell type internal latent image type emulsion described in J. P. KOKAI No. 63-264740 may also be used. Processes for producing the core/shell type internal latent image type emulsion are described in J. P KOKAI No. 59-133542. The thickness of the shells in the emulsion which varies depending on the developing process is preferably 3 to 40 nm, particularly preferably 5 to 20 nm.

The silver halide emulsion to be used in the present invention is usually physically and chemically ripened and spectrally sensitized. The additives to be used in these steps are shown in Research Disclosure Nos. 17643, 18716 and 307105. The portions in which the additives are mentioned in these three Research Disclosure's are summarized in the following table.

A mixture of two or more photosensitive silver halide emulsions different from one another in at least one of grain size, grain size distribution, halogen components, shape of the grains and sensitivity can be used for forming a layer.

Silver halide grains having the fogged surface described in U.S. Pat. No. 4,082,553, silver halide grains having fogged core and colloidal silver described in U.S. Pat. No. 4,626,498 and J. P. KOKAI No. 59-214852 can be preferably used for forming the photosensitive silver halide emulsion layer and/or substantially photo-insensitive, hydrophilic colloid layer. The term 'silver halide grains having fogged core or surface' indicates silver halide grains which can be subjected to uniform (non-imagewise) development irrespective of exposed or non-exposed parts of the photosensitive material. Processes for producing the silver halide grains having the fogged core or surface are described in U.S. Pat. No. 4,626,498 and J. P. KOKAI No. 59-214852.

The silver halide for forming the core of the core/shell type silver halide grains having the fogged core may have the same or different halogen composition. The silver halides having the fogged core or surface include silver chloride, silver chlorobromide, silver bromoiodide and silver chlorobromoiodide. Although the size of the fogged silver halide grains is not particularly limited, the average grain size thereof is preferably 0.01 to 0.75 μm, particularly 0.05 to 0.6 μm. The shape of the grains is not particularly limited. The grains may be regular or in the form of a dispersed emulsion. The dispersion is preferably of monodisperse system wherein at least 95% (by weight or by number of the grains) of the silver halide grains have a grain diameter within the average grain diameter ±40%.

Fine grains of a photo-insensitive silver halide are preferably used in the present invention. The term 'fine grains of photo-insensitive silver halide' indicates fine silver halide grains which are not sensitized in the image-forming exposure for forming a dye image and which are substantially not developed in the developing process. They are preferably previously not fogged.

The fine silver halide grains have a silver bromide content of 0 to 100 molar %. If necessary, they may contain silver chloride and/or silver iodide. They preferably contain 0.5 to 10 molar % of silver iodide.

The fine silver halide grains have an average grain diameter (average diameter of a projected area) of preferably 0.01 to 0.5 μm, more preferably 0.02 to 0.2 μm.

The fine silver halide grains can be prepared by the same processes as those for the production of ordinary photosensitive silver halides. In this case, it is unnecessary to optically sensitize or spectrally sensitize the surface of the silver halide grains. It is preferred, however, to incorporate a known stabilizer such as a triazol, azaindene, benzothiazolium or mercapto compound or a zinc compound thereinto prior to the incorporation thereof into a coating solution. Colloidal silica can be preferably incorporated into the fine silver halide grain-containing layer.

Known photographic additives are also mentioned in the three Research Disclosures and the corresponding portions are also shown in the following table.

| Additive | RD 17643 [Dec., 1978] | RD 18716 [Nov., 1979] | RD 307105 [Nov., 1989] |
|---|---|---|---|
| 1. Chemical sensitizer | p. 23 | p. 648, right column | p. 866 |
| 2. Sensitivity improver | | p. 648, right column | |
| 3. Spectral sensitizer | pp. 23 to 24 | p. 648, right column to p. 649, right column | pp. 866 to 868 |
| Supersensitizer | | p. 649, right column | |
| 4. Brightening agent | p. 24 | p. 647, right column | p. 868 |
| 5. Antifoggant and stabilizer | pp. 24 to 25 | p. 649, right column | pp. 868 to 870 |
| 6. Light absorber, filter dye and U.V. absorber | pp. 25 to 26 | p. 649, right column to p. 650, left column | p. 873 |
| 7. Antistaining agent | p. 25, right column | p. 650, left and right columns | p. 872 |
| 8. Dye image stabilizer | p. 25 | p. 650, left column | " |
| 9. Hardener | pg. 26 | p. 651, left column | pp. 874 and 875 |
| 10. Binder | p. 26 | p. 651, left column | pp. 873 to 874 |
| 11 Plasticizer and lubricant | p. 27 p. 27 | p. 650, right column | p. 876 |
| 12. Coating aid and surfactant | pp. 26 and 27 | p. 650, right column | pp. 875 to 876 |
| 13. Antistatic agent | p. 27 | p. 650, right column | pp. 876 to 877 |
| 14. Matting agent | | | pp. 878 to 879 |

The stability of the processing solutions can be improved.

The silver halide photosensitive material of the present invention is usable also as a thermal development-type photosensitive material described in, for example, U.S. Pat. Nos. 4,500,626, 60-133449, 59-218443 and 61-238056 and European Patent No. 210,660A2.

The detailed description will be made on a transparent support preferably used in the present invention and the prime layer.

The transparent support is preferably flexible. It is, for example, a film made of a cellulose ester (particularly cellulose triacetate, cellulose diacetate, cellulose propionate, cellulose acetate propionate or cellulose acetate butyrate), a polyamide described in U.S. Pat. Nos. 2,856,385 and 2,848,439 or British Patent No. 542,509, a polycarbonate described in Belgian Patent Nos. 593,040 to 593,047, British Patent No. 853,587, U.S. Pat. No. 3,023,101, West German Patent Nos. 1,060,710 and 1,062,544 or French Patent No. 1,259,156, a polyester described in J. P. KOKOKU No. 48-40414 and British Patent No. 789,317 (particularly polyethylene terephthalate, poly-1,4-cyclohexanedimethylene terephthalate, polyethylene-1,2-diphenoxy-4,4'-dicarboxylate, polybutylene terephthalate or polyethylene naphthalate), a polystyrene described in British Patent No. 991,702, a polypropylene described in British Patent Nos. 964,780 and 921,635, a polyethylene described in French Patent No. 1,264,407, or a polymethylpentene, polysulfine, polyethersulfone, polyarylate, aromatic polyetherimide, aromatic polyamide, aromatic polyamidimide, as well as a polyphenylene oxide described in British Patent No. 1,250,206, or a semisynthetic or synthetic polymer such as polyphenylene sulfide.

A plasticizer can be incorporated into the support in order to impart flexibility thereto. Particularly, the cellulose films usually contain a plasticizer such as triphenyl phosphate, biphenyldiphenyl phosphate or dimethylethyl phosphate.

The thickness of the support varies depending on kind of the polymer and the use thereof. The supports include a thin film having a thickness of about 20 μm to a sheet having that of about 1 mm. The thickness of the support is usually in the range of 50 to 300 μm.

The strength of the support varies depending on the use thereof. The supports having a break strength of at least 4 kg/mm$^2$, initial modulus of elasticity of at least 150 kg/mm$^2$ and Young's modulus in flexure of at least 150 kg/mm$^2$ are usable.

The molecular weight of the polymer to be used as the material for the support is at least 10,000, usually 20,000 to 800,000.

The support may contain a dye for neutralizing the color of the base, inhibiting light-piping or inhibiting halation.

Prime-coating

When such a polymer is used as the material for the support, the resulting support has the hydrophobic surface and, therefore, it is difficult to firmly adhere a photographic layer (such as a photosensitive silver halide emulsion layer, intermediate layer or filter layer) mainly comprising a protecting colloid which mainly comprises gelatin to the support. The following techniques are tried for overcoming this defect:

(1) a technique wherein the surface is activated by a chemical treatment, mechanical treatment, corona discharge treatment, flame treatment, ultraviolet ray treatment, high frequency treatment, glow discharge treatment, active plasma treatment, laser treatment, acid mixture treatment or oxidation process with ozone, and then a photographic emulsion is directly applied thereto to attain a firm adhesion, and (2) a process wherein a prime layer is formed after the surface treatment as described above is once conducted or without this treatment and then a Photographic emulsion layer is formed thereon by coating.

(Refer to, for example, U.S. Pat. Nos. 2,698,241, 2,764,520, 2,864,755, 3,462,335, 3,475,193, 3,143,421, 3,501,301, 3,460,944 and 3,674,531, British Patent Nos. 788,365, 804,005 and 891,469, and J. P. KOKOKU Nos. 48-43122 and 51-446).

The mechanism of the surface treatment is supposedly as follows: some polar groups are formed on the hydrophobic support surface or the crosslinking density on the surface is increased so that the affinity of thereof with polar groups of a component contained in the prime-coating solution is increased or the fastness of the adhesion surface is increased.

Various structures of the prime-coating layers have been proposed. They are classified into those prepared by so-called interlayer method wherein the first layer capable of firmly adhering to the support (hereinafter referred to as 'the first prime layer') is formed and then the second layer (hydrophilic resin layer) capable of firmly adhering to a photographic layer (hereinafter referred to as 'the second prime layer') is formed thereon; and those prepared by single-layer method wherein only one resin layer having both hydrophobic and hydrophilic groups is formed by coating.

In the surface treatments (1), the corona discharge treatment is the most popular. It can be conducted by any of known processes (for example processes described in J. P. KOKOKU Nos 48-5043 and 47-51905, J. P. KOKAI Nos. 47-28067, 49-83767, 51-41770 and 51-131576).

The frequency ranges from 50 Hz to 5,000 KHz, preferably 5 KHz to several hundred KHz.

When the frequency is too low, the stable discharge is impossible and pin holes are formed in the treated film unfavorably. When the frequency is too high, on the contrary, a special device for impedance matching is necessitated to increase the cost unfavorably. As for the processing strength, 0.001 KVA min/m$^2$ to 5 KvA min/m$^2$, preferably 0.01 KVA min/m$^2$ to 1 KVA min/m$^2$ is employed for improving the leakage of ordinary plastic films such as polyester and polyolefins. The gap clearance between the electrode and the dielectric material roll is 0.5 to 2.5 mm, preferably 1.0 to 2.0 mm.

The glow discharge treatment which is the most effective surface treatment in most cases can be conducted by any of known processes (such as processes described in J. P. KOKOKU Nos. 35-7578, 36-10336, 45-22004, 45-22005, 45-24040 and 46-43480, U.S. Pat. Nos. 3,057,792, 3,057,795, 3,179,482, 3,288,638, 3,309,299, 3,424,735, 3,462,335, 3,475,307 and 3,761,299, British Patent No. 997,093 and J. P. KOKAI No. 53-129262).

As for the glow discharge conditions, the voltage is usually 0.005 to 20 Torr, preferably 0.02 to 2 Torr. When the voltage is too low, the surface treatment effect is insufficient and when it is too high, an excessive current occurs to cause dangerous sparking and also to break the treated film.

The discharge is caused by applying a high voltage to at least a pair of metal plates or metal rods placed apart from each other in a vacuum tank. The voltage varies depending on the composition of the atmospheric gas and pressure. In the above-described range, the voltage is usually 500 to 5,000 V to cause a stable stationary glow discharge. The voltage range particularly suitable for improving the adhesion is 2,000 to 4,000 v. The discharge frequency ranges from direct current to several thousand MHz, preferably 50 Hz to 20 MHz.

The discharge strength for obtaining the desired adhesion ranges from 0.01 KVA min/m$^2$ to 5 KVA min/m$^2$ preferably from 0.15 KVA min/m$^2$ to 1 KVA min/m$^2$.

Investigations were made on the prime-coating process (2). The starting material for the first prime layer in the interlayer process is a monomer selected from among, for example, vinyl chloride, vinylidene chloride, butadiene, methacrylic acid, acrylic acid, itaconic acid and maleic anhydride. Investigations were made on the copolymers and various other polymers such as polyethylenimine, epoxy resin, grafted gelatin and nitrocellulose in the first prime layer, and also on gelatin in the second prime layer.

In the single layer process, an excellent adhesion is often obtained, taking advantage of interfacial mixing of the support and the prime layer-forming polymer. This process is employed when a support made of a cellulose derivative is used.

When the support is made of such a cellulose derivative, the effect of the surface treatment is only slight; In this case, gelatin is dispersed in an organic solvent comprising a mixture of methylene chloride, ketone and an alcohol and the obtained dispersion is applied to the support to form a prime layer, taking advantage of the interfacial mixing caused by swelling of the support and diffusion of the gelatin.

Examples of the gelatin hardeners include chromium salts (such as chromium alum), aldehydes (such as formaldehyde and glutaraldehyde), isocyanates, active halogen compounds (such as 2,4-dichloro-6-hydroxy-S-triazine) and epichlorohydrin resin. The prime layer-forming solution can contain various additives, if necessary, such as a surfactant, antistatic agent, halation inhibitor, coloring dye, pigment, coating assistant and antifoggant. When the prime layer-forming solution of the present invention is used, an etching agent such as resorcinol, chloral hydrate or chlorophenol can be incorporated thereinto.

The prime layer of the present invention can contain fine particles of an inorganic substance such as $SiO_2$ or $TiO_2$ or fine particles (1 to 10 μm) of a polymethyl methacrylate copolymer as a matting agent.

Coating method

The prime layer-forming solution of the present invention can be applied by a well known method such as dip coating method, air knife coating method, curtain coating method, roller coating method, wire bar coating method, gravure coating method or extrusion coating method wherein a hopper described in U.S Pat. No. 2,681,294 is used. If necessary, two or more layers can be formed at once by a coating method described in U.S. Pat. Nos. 2,761,791, 3,508,947, 2,941,898 and 3,526,528, or Yuji Harasaki, 'Coating Kogaku (Coating Engineering)', p. 253 (published by Asakura Shoten in 1973).

A preferred embodiment of the photosensitive material of the present invention is a rolled film in such that the input of the signals on the transparent magnetic recording layer of the film is easy in carrying the film in a camera or printer. In the rolled film, the area of an image-exposed frame is preferably 350 to 1200 $mm^2$ and at least 15% of the area is occupied by a magnetic information-recordable space.

In particular, the number of perforations is controlled so that a scene has not more than 135 formats. It is particularly preferred that a frame has 4 or less perforations.

It is also possible to optically input informations in a magnetic information recording space with an illuminant such as LED. It is also preferred to input both magnetic information and optical information in the space. The magnetic recording format is preferably according to a system described in International Publication No. 90-04205.

When the photosensitive material of the present invention is used in the form of a roll, it is preferably put in a cartridge. The most ordinary cartridge is a 135 format patrone used at present. Further cartridges proposed in the following specifications are also usable: Japanese Utility Model Unexamined Published Application (hereinafter referred to as 'J. UM. KOKAI') No. 58-67329, J. P. KOKAI Nos. 58-181035 and 58-182634, J.UM KOKAI No. 58-195236, U.S. Patent No. 4,221,479, Japanese Patent Application Nos. 63-57785, 63-183344, 63-325638, 1-21862, 1-25362, 1-30246, 1-20222, 1-21863, 1-37181, 1-33108, 1-85198, 1-172595, 1-172594 and 1-172593, and U.S. Pat. Nos. 4,846,418, 4,848,693 and 4,832,275.

A cartridge having an attitude control means in a camera is particularly preferred (refer to Japanese Patent Application No. 1-214895).

The following Examples will further illustrate the present invention, which by no means limit the invention.

EXAMPLE 1

Production of base

A cellulose triacetate doping solution was spread to form a film base having a thickness of 122 μm (Base I). Cellulose triacetate doping solution in which $\gamma$-$Fe_2O_3$ (specific surface area: 25 $m^2/g$; a product of Pfizer Co., U.S.A.) was dispersed therein and the cellulose triacetate doping solution was spread together to form a film base having a transparent magnetic recording layer having a thickness of 2 μm and the total thickness of 122 μm. The amount of $\gamma$-$Fe_2O_3$ applied was 0.14 $m^2/g$ (Base II). A backing layer having a composition given below was formed on each of the bases to form a base for photosensitive material. In Base II, the backing layer was formed on the magnetic recording layer.

Difference in density between Base II and Base I is shown in Table 2.

TABLE 2

| | |
|---|---|
| $\Delta D_B$ | 0.13 |
| $\Delta D_C$ | 0.06 |
| $\Delta D_R$ | 0.03 |

[determined with X-RITE 310 (a product of X-RITE Co.)]

It is apparent that the increase of the absorption in blue light region of Base II was the most remarkable.

Base II had a coercive force of 490 Oe and the squareness ratio of 0.73. It was thus confirmed that a signal input system described in International Publication No. 90-04205 was possible.

Structure of backing layers

| | |
|---|---|
| The first layer: | |
| Ethylene glycol | 0.8 |
| B-6 | 0.33 |
| The second layer: | |
| Cellulose diacetate | 0.32 |
| Aerosil | 0.02 |

(The amounts are given by $g/m^2$.)

Preparation of photosensitive material

Layers having the following compositions were formed on the primed cellulose triacetate film (Base I) to form Sample 101 which was a multi-layered color photosensitive material.

Compositions of the photosensitive layers

The numerals for the components for each show the amount of the coating ($g/m^2$). The amounts of the silver halides are given in terms of silver applied. The amount of the sensitizing dye is shown in terms of themolar number thereof per mol of the silver halide contained in the same layer.

| (Sample 101) | |
|---|---|
| The first layer (antihalation layer): | |
| Black colloidal silver | silver 0.18 |
| Gelatin | 1.40 |
| The second layer (intermediate layer): | |
| 2,5-di-t-pentadecylhydroquinone | 0.18 |
| EX-1 | 0.070 |
| EX-3 | 0.050 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| The third layer (the first red-sensitive emulsion layer) | |
| Emulsion A | silver 0.25 |
| Emulsion B | silver 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.34 |
| EX-10 | 0.020 |
| Gelatin | 0.87 |
| The fourth layer (the second red-sensitive emulsion layer) | |
| Emulsion G | silver 1.00 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.40 |
| EX-3 | 0.050 |
| EX-14 | 0.025 |
| EX-10 | 0.008 |
| Gelatin | 1.30 |
| The fifth layer (the third red-sensitive emulsion layer) | |
| Emulsion D | silver 1.60 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-2 | 0.097 |
| EX-3 | 0.010 |
| EX-14 | 0.005 |
| EX-4 | 0.080 |
| HBS-1 | 0.22 |
| HBS-2 | 0.10 |
| Gelatin | 1.63 |
| The sixth layer (intermediate layer) | |
| EX-5 | 0.040 |
| HBS-1 | 0.020 |
| Gelatin | 0.80 |
| The seventh layer (the first green-sensitive emulsion layer) | |
| Emulsion A | silver 0.15 |
| Emulsion B | silver 0.15 |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| EX-1 | 0.041 |
| EX-6 | 0.26 |
| EX-7 | 0.060 |
| EX-8 | 0.025 |
| HBS-1 | 0.18 |
| HBS-3 | 0.010 |
| Gelatin | 1.51 |
| The eighth layer (the second green-sensitive emulsion layer) | |
| Emulsion C | silver 0.45 |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |

-continued

| (Sample 101) | |
|---|---|
| EX-6 | 0.094 |
| EX-7 | 0.031 |
| EX-8 | 0.018 |
| HBS-1 | 0.07 |
| HBS-3 | $8.0 \times 10^{-3}$ |
| Gelatin | 0.69 |
| The ninth layer (the third green-sensitive emulsion layer) | |
| Emulsion E | silver 1.20 |
| Sensitizing Dye IV | $3.5 \times 10^{-5}$ |
| Sensitizing Dye V | $8.0 \times 10^{-5}$ |
| Sensitizing Dye VI | $3.0 \times 10^{-4}$ |
| EX-1 | 0.035 |
| EX-11 | 0.10 |
| EX-13 | 0.015 |
| HBS-1 | 0.31 |
| HBS-2 | 0.10 |
| Gelatin | 2.51 |
| The tenth layer (yellow filter layer) | |
| yellow colloidal silver | silver 0.050 |
| EX-5 | 0.080 |
| HBS-1 | 0.030 |
| Gelatin | 0.95 |
| The eleventh layer (the first blue-sensitive emulsion layer) | |
| Emulsion A | silver 0.080 |
| Emulsion B | silver 0.070 |
| Emulsion F | silver 0.070 |
| Sensitizing Dye VII | $3.5 \times 10^{-4}$ |
| EX-8 | 0.042 |
| EX-9 | 0.72 |
| HBS-1 | 0.28 |
| Gelatin | 1.10 |
| The twelfth layer (the second blue-sensitive emulsion layer) | |
| Emulsion G | silver 0.45 |
| Sensitizing Dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| The thirteenth layer (the third blue-sensitive emulsion layer) | |
| Emulsion H | silver 0.77 |
| Sensitizing Dye VII | $2.2 \times 10^{-4}$ |
| EX-9 | 0.20 |
| HBS-1 | 0.070 |
| Gelatin | 0.69 |
| The fourteenth layer (the first protecting layer) | |
| Emulsion I | silver 0.20 |
| U-4 | 0.11 |
| U-5 | 0.17 |
| HBS-1 | $5.0 \times 10^{-2}$ |
| Gelatin | 1.00 |
| The fifteenth layer (the second protecting layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, W-1, W-2, W-3, B-4, B-5, F-1, F-2, F-3, F-4, F-5, F-6, F-7, F-8, F-9, F-10, F-11, F-12 and F-13 as well as an iron salt, lead salt, gold salt, platinum salt and iridium salt were incorporated into all the layers in order to improve the storability, processability, pressure resistance, mildew resistance, antimicrobial properties, antistatic properties and spreadability.

| Emulsion | Average AgI content (%) | Average grain diameter (μm) | Coefficient of variation of grain diameter (%) | Diameter/thickness ratio | Silver amount ratio (AgI content %) |
|---|---|---|---|---|---|
| A | 4.0 | 0.45 | 27 | 1 | Core/shell = 1/3(13/1), |

-continued

| | | | | | |
|---|---|---|---|---|---|
| B | 8.9 | 0.70 | 14 | 1 | double structure grains Core/shell = 3/7(25/2), |
| C | 10 | 0.75 | 30 | 2 | double structure grains Core/shell = 1/2(24/3), |
| D | 16 | 1.05 | 35 | 2 | double structure grains Core/shell = 4/6(40/0), |
| E | 10 | 1.05 | 35 | 3 | double structure grains Core/shell = 1/2(24/3), |
| F | 4.0 | 0.25 | 28 | 1 | double structure grains Core/shell = 1/3(13/1), |
| G | 14.0 | 0.75 | 25 | 2 | double structure grains Core/shell = 1/2(42/0), |
| H | 14.5 | 1.30 | 25 | 3 | double structure grains Core/shell = 37/63(34/3) |
| I | 1 | 0.07 | 15 | 1 | double structure grains Homogeneous grains |

EX-1

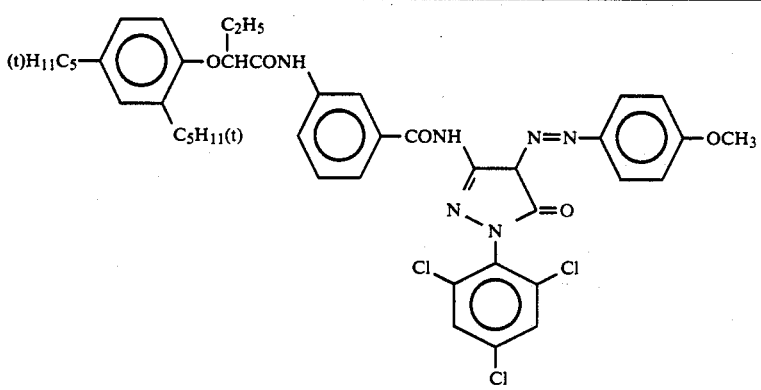

EX-2

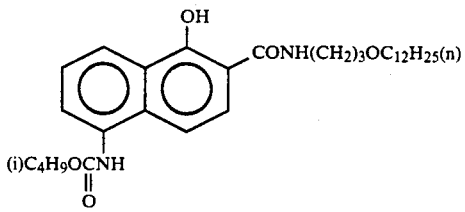

EX-3

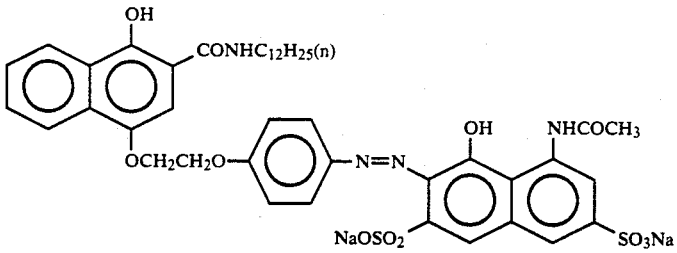

EX-4

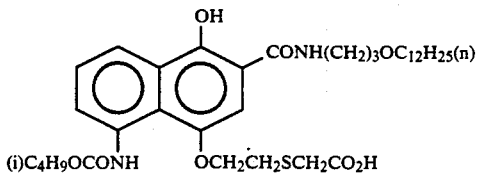

EX-5

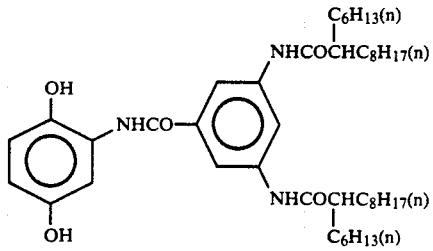

-continued
EX-6
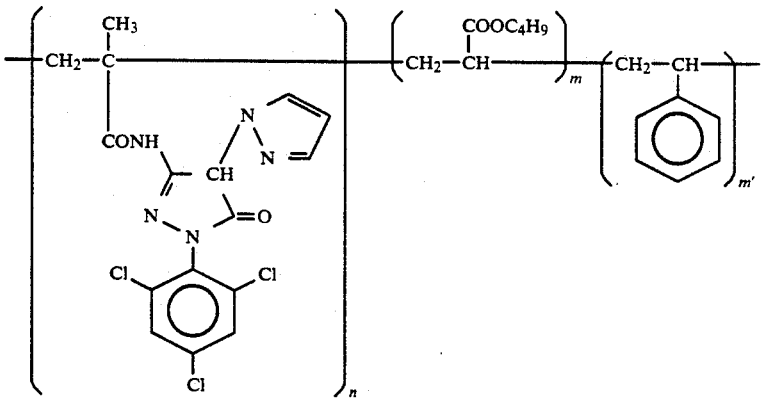
n = 50 m = 25 m' = 25
mol. wt. about 20,000
EX-7
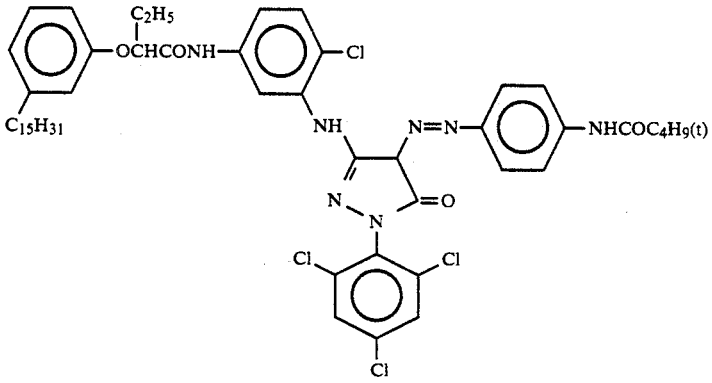
EX-8
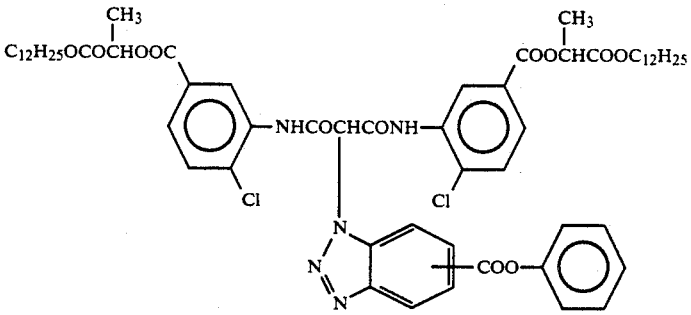
EX-9
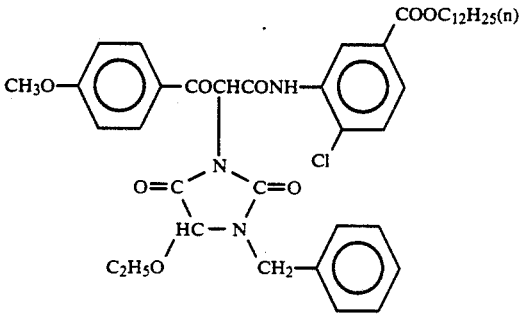

-continued
EX-10
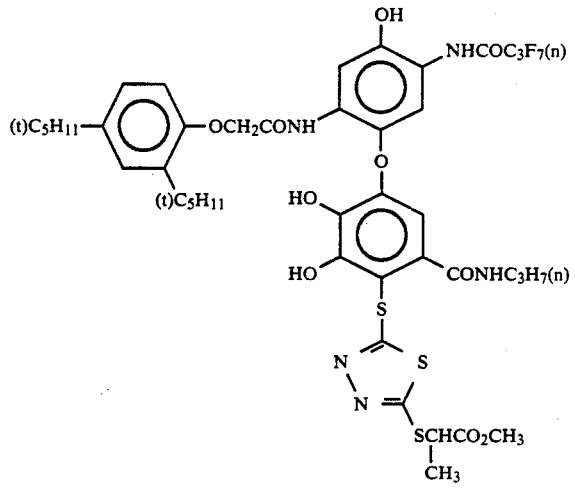
EX-11
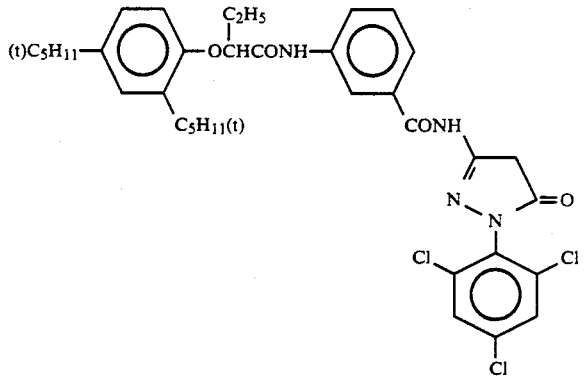
EX-12
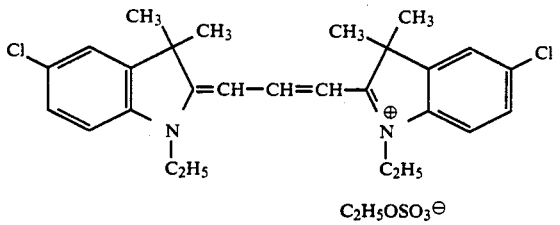
EX-13
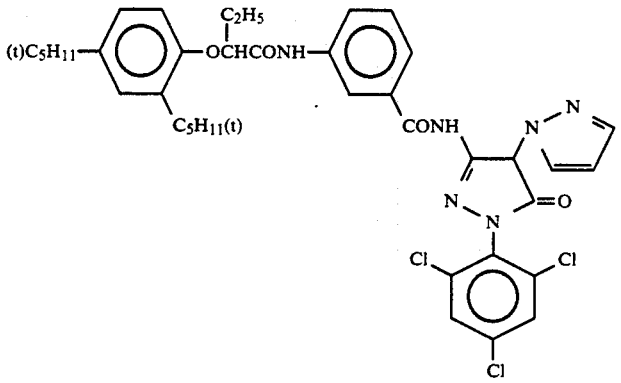

-continued
EX-14
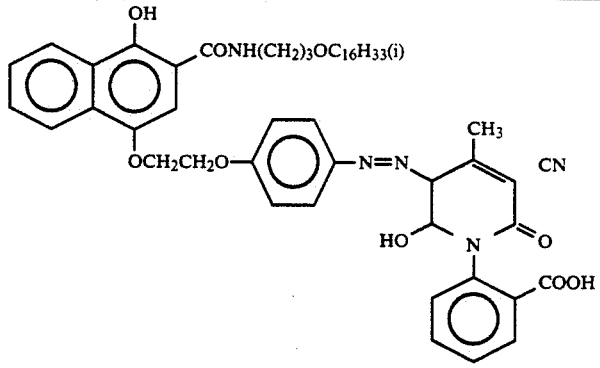
EX-15
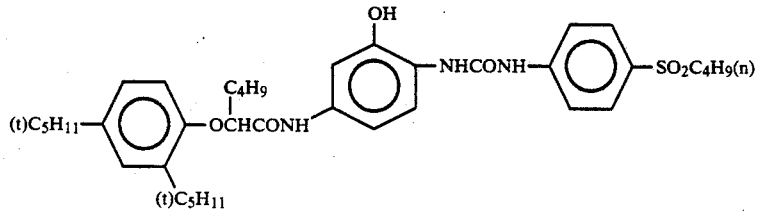
U-1
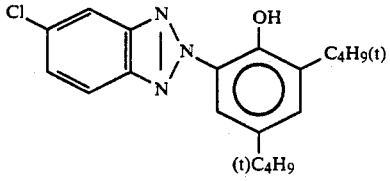
U-2
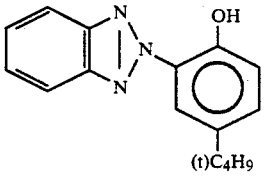
U-3
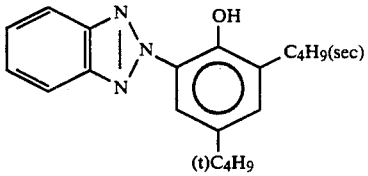
U-4
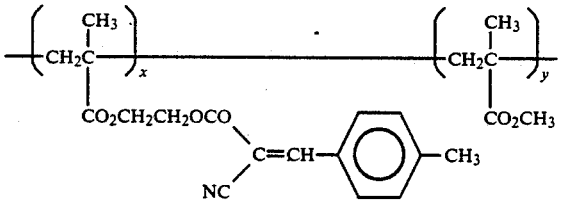
x:y = 70:30 (wt %)
U-5
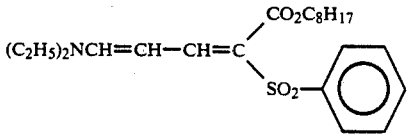
UBS-1 Tricresyl phosphate
UBS-2 Di-n-butyl phthalate -continued
UBS-3
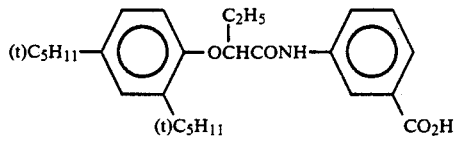
Sensitizing dye I
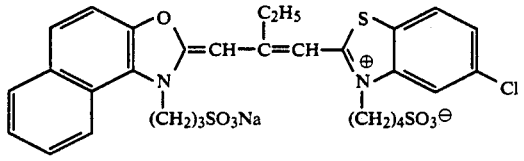
Sensitizing dye II
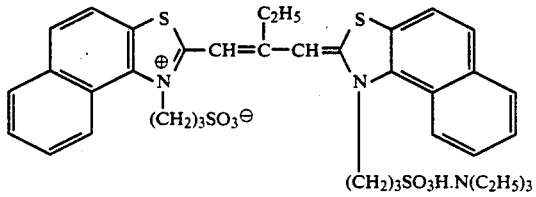
Sensitizing dye III
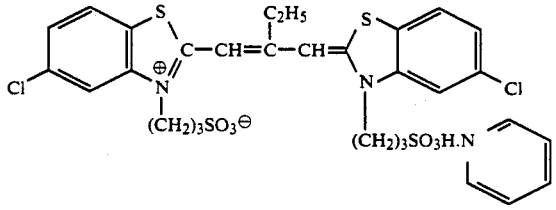
Sensitizing dye IV
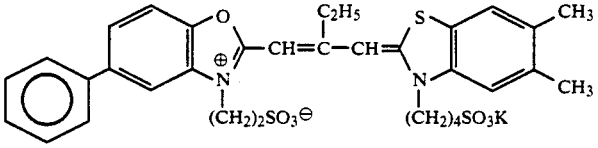
Sensitizing dye V
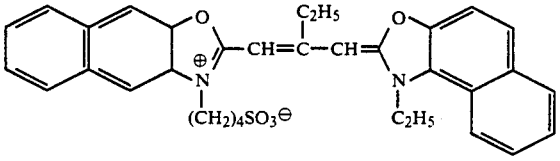
Sensitizing dye VI
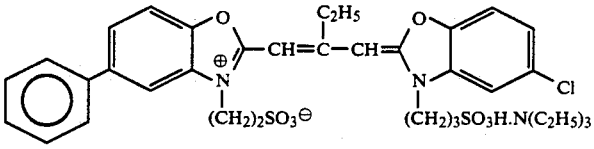
Sensitizing dye VII
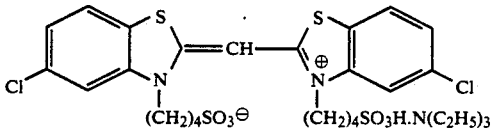
S-1
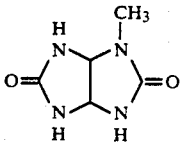

-continued
H-1
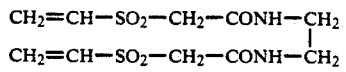
B-1
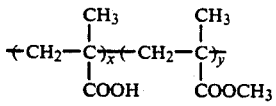
x/y = 10/90
B-2
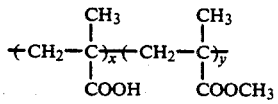
x/y = 40/60
B-3
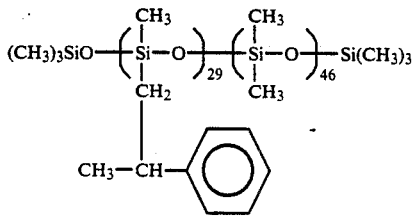
B-4
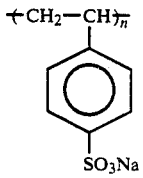
B-5
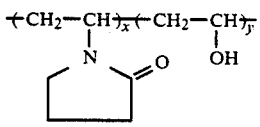
x/y = 70/30
B-6
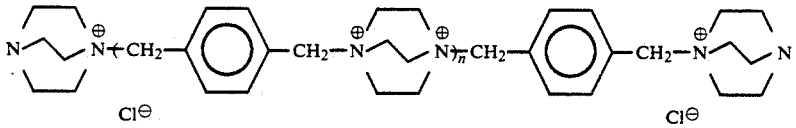
n = 50 ± 5
W-1
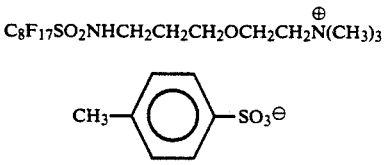
W-2
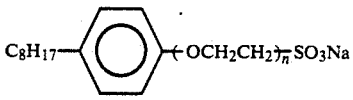
n = 2~4
W-3
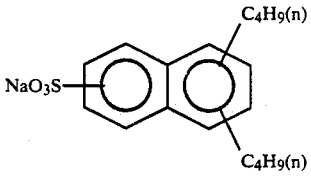

-continued
F-1
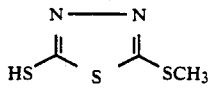
F-2
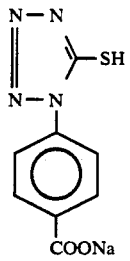
F-3
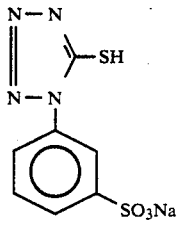
F-4
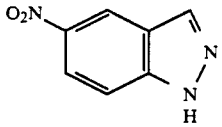
F-5
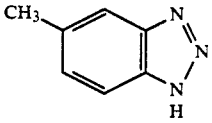
F-6
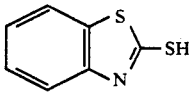
F-7
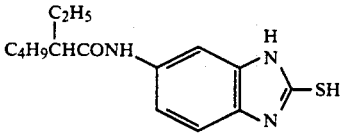
F-8
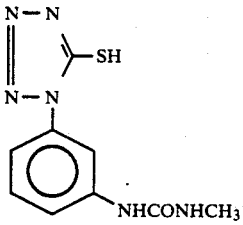
F-9
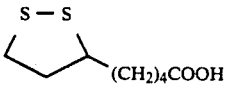
F-10
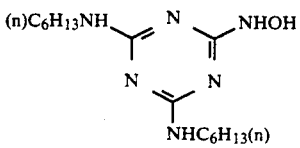

-continued

F-11

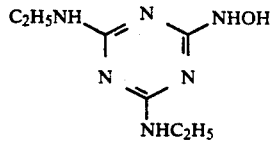

F-12

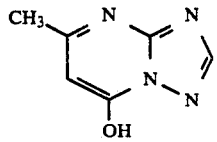

F-13

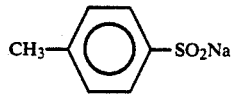

SAMPLES 102 TO 106

Samples 102 to 106 were prepared in the same manner as that of Sample 101 except that changes shown in Table 3 were made:

TABLE 3

| Layer | | 101 (Comp.) | 102 (Comp.) | 103 (Pres. inv.) | 104 (Pres. inv.) | 105 (Pres. inv.) | 106 (Ref.) |
|---|---|---|---|---|---|---|---|
| 3 | Main coupler | EX-2 | " | " | " | EX-15 | " |
| | Amount of HBS-1 | — | — | — | — | 0.68 | — |
| | Amount of gelatin | 0.87 | " | " | " | 3.51 | 0.87 |
| 4 | Main coupler | EX-2 | " | " | " | EX-15 | " |
| | Amount of HBS-1 | — | — | — | — | 0.80 | — |
| | Amount of gelatin | 1.30 | " | " | " | 4.00 | 1.30 |
| 7 | Main coupler | EX-6 | " | [A-4]-46 | " | " | " |
| | Amount of EX-1 | 0.041 | " | 0.018 | " | " | " |
| | Amount of EX-7 | 0.060 | " | 0.027 | " | " | " |
| | Amount of HBS-1 | 0.18 | " | " | 0.02 | " | " |
| | Amount of HBS-3 | 0.01 | " | " | — | — | — |
| | Amount of gelatin | 1.51 | " | " | 0.51 | " | " |
| 8 | Main coupler | EX-6 | " | [A-4]-46 | " | " | " |
| | Amount of EX-7 | 0.031 | " | 0.014 | " | " | " |
| | Amount of HBS-1 | 0.07 | " | " | 0.01 | " | " |
| | Amount of HBS-3 | — | — | — | — | — | — |
| | Amount of gelatin | 0.69 | " | " | 0.35 | " | " |
| 9 | Main coupler | EX-11<br>EX-13 | " | [A-4]-46 | " | " | " |
| | Amount of EX-1 | 0.035 | " | 0.016 | " | " | " |
| | Amount of HBS-1 | 0.31 | " | " | 0.11 | " | " |
| | Amount of HBS-2 | 0.10 | " | " | 0.03 | " | " |
| | Amount of gelatin | 2.51 | " | " | 0.91 | " | " |
| | Base | I | II | II | II | II | II |

The amounts of the main couplers were controlled so that the molar numbers of them would be equal.

Processing of samples

Samples 101 to 105 were cut into films of 24 exposures (135 format).

Determination of Fog Density and MTF Value

Samples 101 to 106 were exposed for sensitometry and then subjected to the following color development (38° C.). Further, they were exposed through a pattern for MTF determination and then subjected to the color development in the same manner as above.

| | |
|---|---|
| Color development | 3 min 15 sec |
| Bleaching | 6 min 30 sec |

-continued

| | |
|---|---|
| Washing with water | 2 min 10 sec |
| Fixing | 4 min 20 sec |
| Washing with water | 3 min 15 sec |
| Stabilization | 1 min 05 sec |

The composition of the processing solutions used in the steps were as follows:

| (Color developer) | | (unit: g) |
|---|---|---|
| Diethylenetriaminepentaacetic acid | | 1.0 |
| 1-Hydroxyethylidene-1,1-diphosphonic acid | | 2.0 |
| Sodium sulfite | | 4.0 |
| Potassium carbonate | | 30.0 |
| Potassium bromide | | 1.4 |
| Potassium iodide | | 1.3 mg |
| Hydroxylamine sulfate | | 2.4 |
| 4-(N-Ethyl-N-β-hydroxyethylamino)-2-methylaniline sulfate | | 4.5 |
| Water | ad | 1.0 l |
| pH | | 10.0 |
| (Bleaching solution) | | (unit: g) |

-continued

| | | |
|---|---|---|
| Ferric ammonium ethylenediaminetetraacetate | | 100.0 |
| Disodium ethylenediaminetetraacetate | | 10.0 |
| Ammonium bromide | | 150.0 |
| Ammonium nitrate | | 10.0 |
| Water | ad | 1.0 l |
| pH | | 6.0 |
| (Fixing solution) | | (unit: g) |
| Disodium ethylenediaminetetraacetate | | 1.0 |
| Sodium sulfite | | 4.0 |
| Aqueous ammonium thiosulfate solution (70%) | | 175.0 ml |
| Sodium bisulfite | | 4.6 |
| Water | ad | 1.0 l |
| pH | | 6.6 |
| (Stabilizing solution) | | |
| Formalin (40%) | | 2.0 ml |
| Polyoxyethylene p-monononylphenyl ether (average degree of polymerization: 10) | | 0.3 g |
| Water | ad | 1.0 l |

The fog densities of the blue-sensitive layers and relative MTF values (per mm,; 25 cycles) of the green-sensitive layers and red-sensitive layers are shown in Table 4.

TABLE 4

| | | Fog density | MTF value* | |
|---|---|---|---|---|
| | | (Blue-sensitive layer) | (geen-sensitive layer) | Red-sensitive layer) |
| 101 | (Comparative) | 0.95 | 1.0 | 1.0 |
| 102 | " | 1.10 | 1.0 | 1.0 |
| 103 | (Present invention) | 0.88 | 0.99 | 1.0 |
| 104 | (Present invention) | 0.87 | 1.05 | 1.02 |
| 105 | (Present invention) | 0.89 | 1.05 | 0.89 |
| 106 | (Reference) | 0.88 | — | — |

[*relative values based on MTF of Sample 101 (1.0)]

There was recognized an improvement of MTF of the green-sensitive layers of Samples 104 and 105 produced in the same manner as that of Sample 101 except that the main coupler in the green-sensitive layer was changed from EX-6 to [A-4]-46 and the amounts of HBS-1 and HBS-3 were reduced.

When the main coupler of the red-sensitive layer was changed from EX-2 to EX-15, the gradation thereof become softer.

106

When HBS-1 was added to recover the original gradation, MTF value Of the red-sensitive layer was reduced (104 vs. 105).

Determination of printing time

Each of Samples 101 to 105 (135 format) was placed in a camera and a picture of a given scene was taken. After the developing process was conducted in the same manner as described above, a color print was prepared with a printer of additive color system. The printing time of the blue-sensitive layer is shown in Table 5.

TABLE 5

| | Printing time (relative)* |
|---|---|
| 101 (Comparative) | 1.00 |
| 102 " | 1.40 |
| 103 (Present invention) | 0.93 |
| 104 " | 0.93 |
| 105 " | 0.93 |

[*relative values based on the printing time of 101 (1.0)]

Prolongation of the printing time by the transparent magnetic recording layer was recognized (101 vs. 102).

When Ex-6 was replaced with [A-4]-46 and the amount of EX-1 and EX-7 was reduced, the printing time could be remarkably reduced and prolongation of the printing time due to the transparent magnetic base could be inhibited (102 vs. 103 to 105; 101 vs. 103 to 105).

No deterioration of the color reproducibility by reduction in amount of EX-1 and EX-7 was recognized (102 vs. 103 and 104).

In Samples 103 to 105, the object of the present invention could be attained. Sample 104 had the highest sharpness and was most preferred.

EXAMPLE 2

Processing of samples

Films for photographing tests were prepared in the same manner as that of Example 1 except that the number of perforations was changed to 1 per frame and that a cartridge shown in FIG. 1 was used.

Tests

There was used a camera modified so that signals of pseudo telephoto zoom could be inputted by attaching a magnetic head and the cartridge of FIG. 1 could be placed therein. A pseudo telephoto zoom print of a magnification of ×2 was prepared according to the signals inputted in the photographing.

The print time and sharpness of the print are shown in Table 6.

TABLE 6

| | Printing time | Sharpness of print* |
|---|---|---|
| 101 (Comparative) | — | — |
| 102 " | 1.00 | 2 |
| 103 (Present invention) | 0.66 | 2 |
| 104 " | 0.66 | 1 |
| 105 " | 0.66 | 3 |

(The sharpnesses of the prints 102 to 105 were ranked.)

The printing time and sharpness of Sample 101 could not be determined, since no pseudo telephoto zoom signal was inputted.

The printing time of Samples 103 to 105 of the present invention was short, so that these Samples were preferable.

It was found that Sample 104 of the present invention had an excellent sharpness and it was quite suitable for the pseudo telephoto zoom system.

EXAMPLE 3

It was found that samples not containing EX-1, EX-3 or EX-12 in the second layer could further shorten the printing time.

EXAMPLE 4

SHG-100, REALA SHG 200 and SHG 1600 (products of Fuji Photo Film Co., Ltd.) were used except that [A-4]-46 coupler was used instead of a coupler or couplers contained in the green-sensitive layer and an amount of a high-boiling organic solvent for dispersion was reduced. There samples exhibited excellent results as in Example 1.

EXAMPLE 5

The same procedure as above was repeated except that [A-4]-46 was replaced with [A-4]-15 or [A-4]-67 to obtain excellent results as in Example 1.

EXAMPLE 6

The cartridge processed in Example 2 was placed in a moisture-proof paper tube. Each of openings at the both ends of the paper tubes was fitted with a moisture-proof cap. The periphery of each end of the tubes was fused together with the inner surface of the periphery of the cap by heating to obtain a package.

EXAMPLE 7

The cartridge obtained in Example 2 was packed in a packing material which was the same as that used for "Utsurundesu" (trade name of Fuji Photo Film Co., Ltd.).

What is claimed is:

1. A silver halide color photosensitive material which comprises at least one red-sensitive silver halide emulsion layer containing a cyan coupler, at least one green-sensitive silver halide emulsion layer containing a magenta coupler and at least one blue-sensitive silver halide emulsion layer containing a yellow coupler formed on a transparent support, wherein the support contains $4\times10^{-4}$ to 3 g, per $m^2$ of the support, of a fine ferromagnetic powder and the green-sensitive emulsion layer contains a magenta coupler of the following general formula [A]:

general formula [A]:

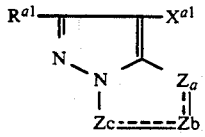

wherein $R^{a1}$ represents a hydrogen atom or a substituent, $X^{a1}$ represents a hydrogen atom or a group which can be split off by coupling reaction with an oxidation product of an aromatic primary amine developing agent, Za, Zb and Zc each represent a methine, substituted methine, =N— or —NH—, one of Za-Zb bond and Zb-Zc bond is a double bond and the other is a single bond; when Zb-Zc is a carbon-to-carbon double bond, it may be a part of the aromatic ring; the coupler may form a dimer or polymer through $R^{a1}$ or $X^{a1}$; and when Za, Zb or Zc is the substituted methine, the coupler may form a dimer or polymer through the substituted methine.

2. A silver halide photosensitive material of claim 1 wherein a magnetic recording layer containing a fine ferromagnetic powder is formed on the back surface of the transparent support.

3. A silver halide photosensitive material of claim 2 wherein a magnetic recording layer has a thickness of 0.1 to 10 μm.

4. A silver halide photosensitive material of claim 1 wherein the magenta coupler is selected form the group consisting of couplers represented by the formulae [A-1] to [A-6]

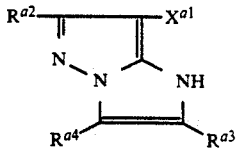

[A-1]

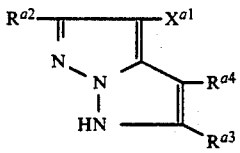

[A-2]

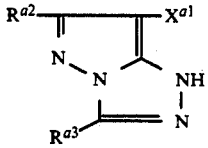

[A-3]

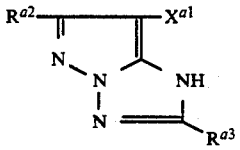

[A-4]

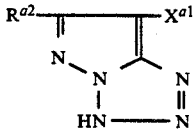

[A-5]

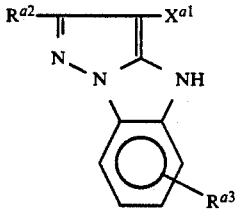

[A-6]

wherein $R^{a2}$ to $R^{a4}$ each represent a hydrogen or halogen atom, or an alkyl, aryl, heterocyclic, cyano, alkoxyl, aryloxy, heterocyclic oxy, acyloxy, carbamoyloxy, silyloxy, sulfonyloxy, acylamino, anilino, ureido, imide, sulfamoylamino, alkylthio, arylthio, heterocyclic thio, alkoxycarbonylamino, aryloxycarbonylamino, sulfonamide, carbamoyl, acyl, sulfamoyl, sulfonyl, sulfinyl, alkoxycarbamoyl or aryloxycarbonyl group, and $X^{a1}$ represents a hydrogen or halogen atom, a carboxyl group or a coupling-off group linked with a carbon at coupling position through an oxygen, nitrogen or sulfur atom

5. A silver halide photosensitive material of claim 4 wherein the magenta coupler is selected from the group consisting of couplers represented by the formulae [A-3] and [A-4].

6. A silver halide photosensitive material of claim 1 wherein the magenta coupler is selected from the group consisting of couplers represented by the formulae [M].

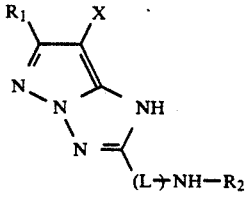

wherein $R_1$ represents an alkyl group, alkoxyl group or aryloxy group, $R_2$ represents an acyl group or sulfonyl group, —(—L—)— represents an alkylene group of the formula:

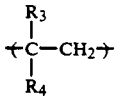

or phenylene group and when it is an alkylene group, the carbon atom bonded with $R_3$ and $R_4$ is bonded with the mother nucleus of the coupler and $R_3$ and $R_4$ each represent a hydrogen atom, alkyl group or aryl group with the proviso that both $R_3$ and $R_4$ cannot be hydrogen atom at the same time, and X represents an aryloxy group, alkoxyl group, 1-azolyl group, alkylthio group or arylthio group; or $R_1$, $R_2$ or X may be a divalent group to form a bis-compound; or when the part represented by the general formula (M) is contained in the vinyl monomer, one of $R_1$, $R_2$ and X represents a mere bond or a connecting group through which it is bonded with the vinyl group.

7. A silver halide photosensitive material of claim 1 wherein the magenta coupler is incorporated into the green-sensitive layer and/or a layer adjacent thereto in the total amount of 0.01 to 1.0 g/m$^2$.

8. A silver halide photosensitive material of claim 1 wherein a yellow-colored magent coupler represented by the formula (I) is further incorporated in the green-sensitive layer;

MCP-YD wherein MCP represents a magenta coupler residue, and YD represents a group which is bonded with a coupling group of MCP to cleave the compound into MCP and YD when the coupler is reacted with an oxidation product of the developing agent and which is an atomic group containing a yellow dye or a group bonded with MCP through an azo group to form a yellow azo dye together with MCP.

9. A silver halide color photosensitive material of claim 1 wherein the red-sensitive silver halide emulsion layer contains a coupler of the following general formula [B]:

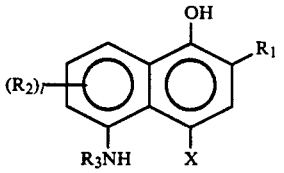

wherein $R_1$ represents —$CONR_4R_5$, —$SO_2NR_4R_5$, —$NHCOR_4$, —$NHCOOR_6$, —$NHSO_2R_6$, —$NHCONR_4R_5$ or —$NHSO_2NR_4R_5$, $R_2$ represents a possible substituent for the naphthalene ring, l represents an integer of 0 to 3, $R_3$ represents a substituent, and X represents a hydrogen atom or a group which can be split off by coupling reaction with an oxidation product of an aromatic primary amine developing agent; and $R_4$ and $R_5$ may be the same or different and each represent a hydrogen atom, alkyl group, aryl group or heterocyclic group, $R_6$ represents an alkyl group, aryl group or heterocyclic group, when l is 2 or more, $R_2$'s may be the same or different from one another or may be bonded together to form a ring, $R_2$ and $R_3$ or $R_3$ and X may be bonded together to form a ring, and $R_1$, $R_2$, $R_3$ or X may form a dimer or polymer by bonding through a divalent or a higher-valent group.

10. A silver halide color photosensitive material of claim 9 wherein the total amount of the cyan coupler of the formula [B] is at least 30 molar % based on the total cyan couplers.

11. A silver halide color photosensitive material of claim 9 wherein the magenta coupler and the cyan coupler are used with a high-boiling organic solvent.

12. A silver halide color photosensitive material of claim 9 wherein a yellow colored cyan coupler is further incorporated into the red-sensitive emulsion layer.

13. A silver halide color photosensitive material of claim 12 wherein the total amount of the yellow colored cyan coupler is 0.005 to 0.30 g/m$^2$.

* * * * *